US006189621B1

(12) United States Patent
Vail, III

(10) Patent No.: US 6,189,621 B1
(45) Date of Patent: Feb. 20, 2001

(54) SMART SHUTTLES TO COMPLETE OIL AND GAS WELLS

(75) Inventor: William Banning Vail, III, Bothell, WA (US)

(73) Assignee: Smart Drilling and Completion, Inc., Bothell, WA (US)

( * ) Notice: Under 35 U.S.C. 154(b), the term of this patent shall be extended for 0 days.

(21) Appl. No.: 09/375,479

(22) Filed: Aug. 16, 1999

(51) Int. Cl.[7] ..... E21B 19/00; E21B 19/22; E21B 47/00

(52) U.S. Cl. ..... 166/385; 166/250.01; 166/77.1; 166/241.5

(58) Field of Search ..... 166/250.01, 117.5, 166/117.6, 77.1, 241.5, 242.5, 385

(56) References Cited

U.S. PATENT DOCUMENTS

| | | | | |
|---|---|---|---|---|
| 3,552,508 | | 1/1971 | Brown | 175/258 |
| 3,603,411 | | 9/1971 | Link | 175/259 |
| 4,009,561 | | 3/1977 | Young | 57/6 |
| 4,651,837 | | 3/1987 | Mayfield | 175/262 |
| 4,909,741 | | 3/1990 | Schasteen et al. | 439/13 |
| 4,962,822 | | 10/1990 | Pascale | 175/258 |
| 5,156,213 | * | 10/1992 | George et al. | 166/297 |
| 5,197,553 | | 3/1993 | Leturno | 175/57 |
| 5,271,472 | | 12/1993 | Leturno | 175/107 |
| 5,305,830 | * | 4/1994 | Wittrisch | 166/250.01 |
| 5,353,872 | * | 10/1994 | Wittrisch | 166/250.01 |
| 5,398,760 | * | 3/1995 | George et al. | 166/385 |
| 5,472,057 | | 12/1995 | Winfree | 175/57 |
| 5,551,521 | * | 9/1996 | Vail, III | 175/65 |
| 5,560,437 | * | 10/1996 | Dickel et al. | 166/385 |
| 6,061,000 | * | 5/2000 | Edwards | 166/250.01 |

OTHER PUBLICATIONS

Cablesa, Inc., Wireline Catalogue, 2000, 6 pages.
Camesa, Inc., "Electromechanical Cable", Dec. 1998, pp. 1–32.
The Rochester Corporation, "Well Logging Cables", Jul. 1999, 9 pages.
Quigley, "Coiled Tubing and Its Applications", SPE Short Course, Houston, TX, Oct. 3, 1999, 9 pages.
"World Oil's Coiled Tubing Handbook", Gulf Publishing Co., 1993, p. 3, p. 5, pp. 45–50.

* cited by examiner

*Primary Examiner*—Brian L. Johnson
*Assistant Examiner*—Joselynn Sliteris

(57) ABSTRACT

Smart shuttles are used to complete oil and gas wells. Following drilling operations into a geological formation, a steel pipe is disposed in the wellbore. The steel pipe may be a standard casing installed into the wellbore using typical industry practices. Alternatively, the steel pipe may be a drill string attached to a rotary drill bit that is to remain in the wellbore following completion during so-called "one-pass drilling operations". Using typical procedures in the industry, the well is "completed" by placing into the steel pipe various standard completion devices, many of which are conveyed into place using the drilling rig. Instead, with this invention, smart shuttles are used to convey into the steel pipe the various smart completion devices necessary to complete the oil and gas well. Smart shuttles may be attached to a wireline, to a coiled tubing, or to a wireline installed within coiled tubing. Of particular interest is a wireline conveyed smart shuttle that possesses an electrically operated internal pump that pumps fluid from below the shuttle, to above the shuttle, that in turn causes the smart shuttle to "pump itself down" and into a horizontal wellbore. Similar comments apply to coiled tubing conveyed smart shuttles.

5 Claims, 18 Drawing Sheets

SMART SHUTTLES TO COMPLETE OIL AND GAS WELLS

This application relates to Ser. No. 08/323,152, filed Oct. 14, 1994, having the title of "Method and Apparatus for Cementing Drill Strings in Place for One Pass Drilling and Completion of Oil and Gas Wells", that issued on Sep. 3, 1996 as U.S. Pat. No. 5,551,521, an entire copy of which is incorporated herein by reference.

This application further relates to application Ser. No. 08/708,396, filed Sep. 3, 1996, having the title of "Method and Apparatus for Cementing Drill Strings in Place for One Pass Drilling and Completion of Oil and Gas Wells", that issued on the date of Apr. 20, 1999 as U.S. Pat. No. 5,894,897, an entire copy of which is incorporated herein by reference.

This application further relates to application Ser. No. 09/294,077, filed Apr. 18, 1999, having the title of "One Pass Drilling and Completion of Wellbores with Drill Bit Attached to Drill String to Make Cased Wellbores to Produce Hydrocarbons", an entire copy of which is incorporated herein by reference.

This application further relates to application Ser. No. 09/295,808, filed Apr. 20, 1999, having the title of "One Pass Drilling and Completion of Extended Reach Lateral Wellbores with Drill Bit Attached to Drill String to Produce Hydrocarbons from Offshore Platforms", an entire copy of which is incorporated herein by reference.

This application relates to disclosure in U.S. Disclosure Document No. 362582, filed on Sep. 30, 1994, that is entitled 'RE: Draft of U.S. patent application Entitled "Method and Apparatus for Cementing Drill Strings in Place for One Pass Drilling and Completion of Oil and Gas Wells'", an entire copy of which is incorporated herein by reference.

This application further relates to disclosure in U.S. Disclosure Document No. 445686, filed on Oct. 11, 1998, that is entitled 'RE:—Invention Disclosure—entitled "William Banning Vail III, Oct. 10, 1998"', an entire copy of which is incorporated herein by reference.

This application further relates to disclosure in U.S. Disclosure Document No. 451044, filed on Feb. 8, 1999, that is entitled 'RE:—Invention Disclosure—"Drill Bit Having Monitors and Controlled Actuators"', an entire copy of which is incorporated herein by reference.

This application further relates to disclosure in U.S. Disclosure Document No. 451292, filed on Feb. 10, 1999, that is entitled 'RE:—Invention Disclosure—"Method and Apparatus to Guide Direction of Rotary Drill Bit" dated Feb. 9, 1999"', an entire copy of which is incorporated herein by reference.

This application further relates to disclosure in U.S. Disclosure Document No. 452648 filed on Mar. 5, 1999 that is entitled 'RE: "—Invention Disclosure—Feb. 28, 1999 One-Trip-Down-Drilling Inventions Entirely Owned by William Banning Vail III"', an entire copy of which is incorporated herein by reference.

This application further relates to disclosure in U.S. Disclosure Document No. 455731 filed on May 2, 1999 that is entitled 'RE:—INVENTION DISCLOSURE—entitled "Summary of One-Trip-Down-Drilling Inventions", an entire copy of which is incorporated herein by reference.

This application further relates to disclosure in U.S. Disclosure Document No. 458978 filed on Jul. 13, 1999 that is entitled in part "RE:—INVENTION DISCLOSURE MAILED JUL. 13, 1999", an entire copy of which is incorporated herein by reference.

Yet further, this application also relates to disclosure in U.S. Disclosure Document No. 459470 filed on Jul. 20, 1999 that is entitled in part 'RE:—INVENTION DISCLOSURE ENTITLED "Different Methods and Apparatus to "Pump-down". . . "', an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". In particular, applicant includes herein by reference entire copies of each and every U.S. Patent cited in U.S. Disclosure Document No. 452648, including all its attachments, that was filed on Mar. 5, 1999. To best knowledge of applicant, all copies of U.S. Patents that were ordered from commercial sources that were specified in the U.S. Disclosure Documents are in the possession of applicant at the time of the filing of the application herein.

BACKGROUND OF THE INVENTION

1. Field of Invention

The field of invention relates to apparatus that uses the steel drill string attached to a drilling bit during drilling operations used to drill oil and gas wells for a second purpose as the casing that is cemented in place during typical oil and gas well completions. The field of invention further relates to methods of operation of said apparatus that provides for the efficient installation of a cemented steel cased well during one single pass down into the earth of the steel drill string. The field of invention further relates to methods of operation of the apparatus that uses the typical mud passages already present in a typical drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single drilling pass into the earth. The field of invention further relates to apparatus and methods of operation that provides the pumping of cement down the drill string, through the mud passages in the drill bit, and into the annulus between the formation and the drill string for the purpose of cementing the drill string and the drill bit into place during one single drilling pass into the formation. The field of invention further relates to a one-way cement valve and related devices installed near the drill bit of the drill string that allows the cement to set up efficiently while the drill string and drill bit are cemented into place during one single drilling pass into the formation. The field of invention further relates to the use of slurry material instead of cement to complete wells, where the term "slurry material" may be any one, or more, of at least the following substances: cement, gravel, water, "cement clinker", a "cement and copolymer mixture", a "blast furnace slag mixture", and/or any mixture thereof; or any known substance that flows under sufficient pressure. The field of invention further relates to the use of slurry materials for the following type of generic well completions: open-hole well completions; typical cemented well completions having perforated casings; gravel well completions having perforated casings; and for any other related well completions. The field of invention relates to using slurry materials to complete extended reach wellbores and extended reach lateral wellbores from offshore platforms. The field of the invention further relates to the use of retrievable instrumentation packages to perform LWD/MWD logging and directional drilling functions while the well is being drilled, which can be retrieved by a wireline attached to a smart shuttle having retrieval apparatus. The field of the invention further relates to the use of smart shuttles having retrieval apparatus that are capable of deploying and installing into pipes smart completion devices to automatically complete oil and gas wells after the pipes are disposed in the wellbore. These pipes includes a drill pipe, a drill string, a casing, a casing string, tubing, a liner, a liner string, a steel pipe, a metallic pipe, or any other pipe used for the completion of oil and gas wells. The smart shuttle may use internal pump means to pump fluid from below the smart shuttle to above it to cause the shuttle to move in the pipe to conveniently install smart completion devices.

2. Description of the Prior Art

At the time of the filing of the application herein, the applicant is unaware of any prior art that is particularly relevant to the invention other than that cited in the above defined "related" U.S. Patents, the "related" co-pending U.S. patent applications, and the "related" U.S. Disclosure Documents that are specified in the first paragraphs of this application.

SUMMARY OF THE INVENTION

In previous disclosure, apparatus and methods of operation of that apparatus are disclosed that allow for cementation of a drill string with attached drill bit into place during one single drilling pass into a geological formation. The process of drilling the well and installing the casing becomes one single process that saves installation time and reduces costs during oil and gas well completion procedures. Apparatus and methods of operation of the apparatus are disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in the Description of the Preferred Embodiments below. The New Drilling Process is now possible because of "Several Recent Changes in the Industry" also described in the Description of the Preferred Embodiments below. In addition, the New Drilling Process also requires new apparatus to properly allow the cement to cure under ambient hydrostatic conditions. That new apparatus includes a Latching Subassembly, a Latching Float Collar Valve Assembly, the Bottom Wiper Plug, and the Top Wiper Plug. Suitable methods of operation are disclosed for the use of the new apparatus. Methods are further disclosed wherein different types of slurry materials are used for well completion that include at least cement, gravel, water, a "cement clinker", and any "blast furnace slag mixture". Methods are further disclosed using a slurry material to complete wells including at least the following: open-hole well completions; cemented well completions having a perforated casing; gravel well completions having perforated casings; extended reach wellbores; and extended reach lateral wellbores as typically completed from offshore drilling platforms.

In the new disclosure, smart shuttles are used to complete the oil and gas wells. Following drilling operations into a geological formation, a steel pipe is disposed in the wellbore. The steel pipe may be a standard casing installed into the wellbore using typical industry practices. Alternatively, the steel pipe may be a drill string attached to a rotary drill bit that is to remain in the wellbore following completion during so-called "one-pass drilling operations". Further, the steel pipe may be a drill pipe from which has been removed a retrievable or retractable drill bit. Or, the steel pipe may be a coiled tubing having a mud motor drilling apparatus at its end. Using typical procedures in the industry, the well is "completed" by placing into the steel pipe various standard completion devices, some of which are conveyed into place with the drilling rig. Here, instead smart shuttles are used to convey into the steel pipe various smart completion devices used to complete the oil and gas well. The smart shuttles are then used to install various smart completion devices. And the smart shuttles may be used to retrieve from the wellbore various smart completion devices. Smart shuttles may be attached to a wireline, coiled tubing, or to a wireline installed within coiled tubing, and such applications are called "tethered smart shuttles". Smart shuttles may be robotically independent of the wireline, etc., provided that large amounts of power are not required for the completion device, and such devices are called "untethered shuttles". The smart completion devices are used in some cases to machine portions of the steel pipe. Completion substances, such as cement, gravel, etc. are introduced into the steel pipe using smart wiper plugs and smart shuttles as required. Smart shuttles may be robotically and automatically controlled from the surface of the earth under computer control so that the completion of a particular oil and gas well proceeds automatically through a progression of steps. A wireline attached to a smart shuttle may be used to energize devices from the surface that consume large amounts of power. Pressure control at the surface is maintained by use of a suitable lubricator device that has been modified to have a smart shuttle chamber suitably accessible from the floor of the drilling rig. A particular smart shuttle of interest is a wireline conveyed smart shuttle that possesses an electrically operated internal pump that pumps fluid from below the shuttle to above the shuttle that causes the smart shuttle to pump itself down into the well. Suitable valves that open allow for the retrieval of the smart shuttle by pulling up on the wireline. Similar comments apply to coiled tubing conveyed smart shuttles. Using smart shuttles to complete oil and gas wells reduces the amount of time the drilling rig is used for standard completion purposes. The smart shuttles therefore allow the use of the drilling rig for its basic purpose—the drilling of oil and gas wells.

DESCRIPTION OF THE PREFERRED EMBODIMENTS

The following disclosure related to FIGS. 1–5 is substantially repeated herein from co-pending Ser. No. 09/295,808. This repeated disclosure related to FIGS. 1–5 is useful information so that the preferred embodiments of the invention herein may be economically described in terms of previous definitions related to those FIGS. 1–5.

Figure 1:
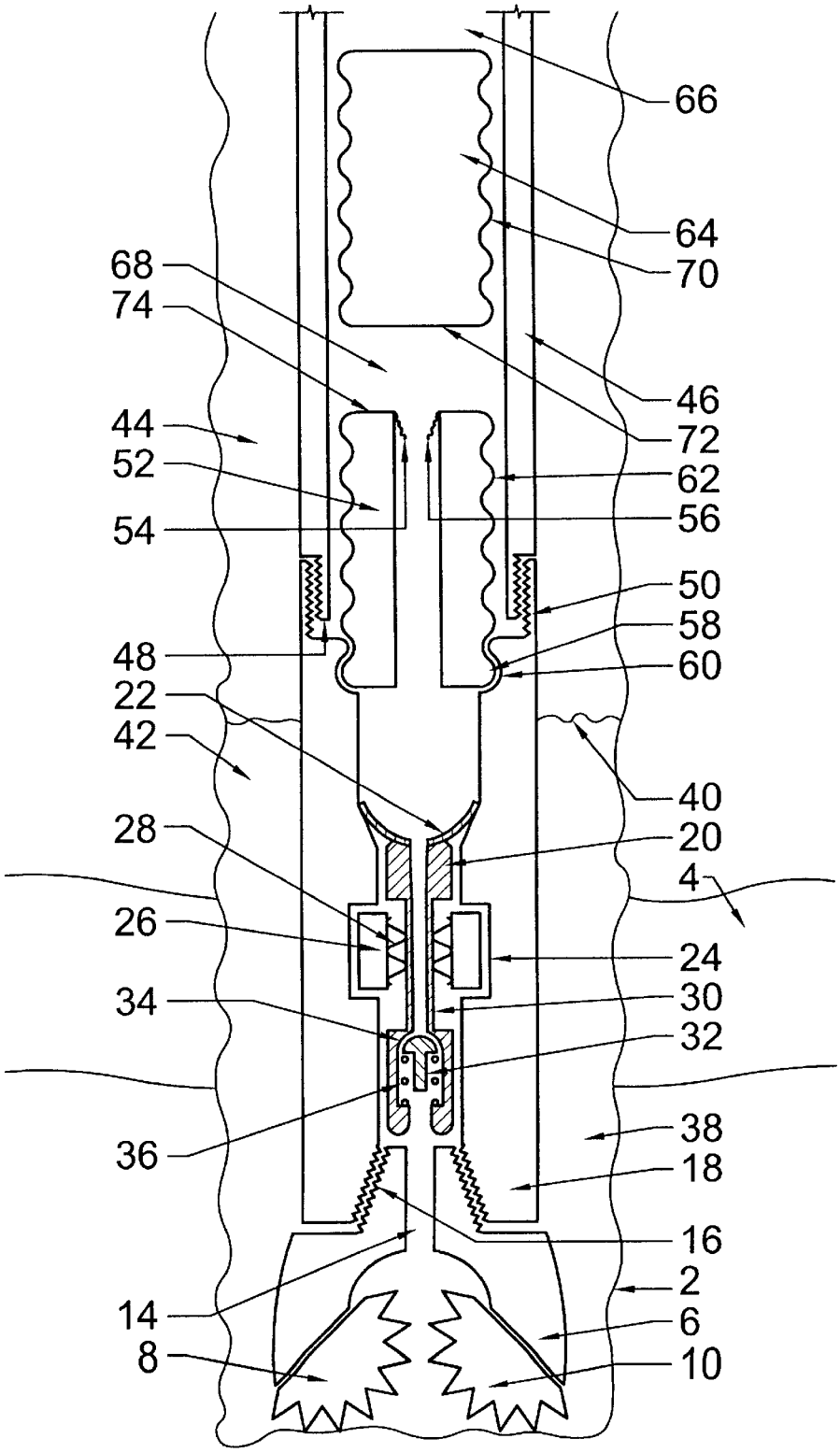
PRIOR ART FIG. 1
FIG. 1 shows a section view of a rotary drill string having a rotary drill bit in the process of being cemented in place during one drilling pass into formation by using a Latching Float Collar Valve Assembly that has been pumped into place above the rotary drill bit that is a preferred embodiment of the invention.

In FIGS. 1–5, apparatus and methods of operation of that apparatus are disclosed herein in the preferred embodiments of the invention that allow for cementation of a drill string with attached drill bit into place during one single drilling pass into a geological formation. The method of drilling the well and installing the casing becomes one single process that saves installation time and reduces costs during oil and gas well completion procedures as documented in the following description of the preferred embodiments of the invention. Apparatus and methods of operation of the apparatus are disclosed herein that use the typical mud passages already present in a typical rotary drill bit, including any watercourses in a "regular bit", or mud jets in a "jet bit", for the second independent purpose of passing cement into the annulus between the casing and the well while cementing the drill string in place. Slurry materials may be used for completion purposes in extended lateral wellbores. Therefore, the following text is substantially quoted from co-pending Ser. No. 09/295,808 related to FIGS. 1–5:

FIG. 1 shows a section view of a drill string in the process of being cemented in place during one drilling pass into formation. A borehole 2 is drilled though the earth including geological formation 4. The borehole is drilled with a milled tooth rotary drill bit 6 having milled steel roller cones 8, 10, and 12 (not shown for simplicity). A standard water passage 14 is shown through the rotary cone drill bit. This rotary bit could equally be a tungsten carbide insert roller cone bit having jets for waterpassages, the principle of operation and the related apparatus being the same for either case for the preferred embodiment herein.

The threads 16 on rotary drill bit 6 are screwed into the Latching Subassembly 18. The Latching Subassembly is also called the Latching Sub for simplicity herein. The Latching Sub is a relatively thick-walled steel pipe having some functions similar to a standard drill collar.

The Latching Float Collar Valve Assembly 20 is pumped downhole with drilling mud after the depth of the well is reached. The Latching Float Collar Valve Assembly is pumped downhole with mud pressure pushing against the Upper Seal 22 of the Latching Float Collar Valve Assembly. The Latching Float Collar Valve Assembly latches into place into Latch Recession 24. The Latch 26 of the Latching Float Collar Valve Assembly is shown latched into place with Latching Spring 28 pushing against Latching Mandrel 30. When the Latch 26 is properly seated into place within the Latch Recession 24, the clearances and materials of the Latch and mating Latch Recession are to be chosen such that very little cement will leak through the region of the Latch Recession 24 of the Latching Subassembly 18 under any back-pressure (upward pressure) in the well. Many means can be utilized to accomplish this task, including fabricating the Latch 26 from suitable rubber compounds, suitably designing the upper portion of the Latching Float Collar Valve Assembly 20 immediately below the Upper Seal 22, the use of various O-rings within or near Latch Recession 24, etc.

The Float 32 of the Latching Float Collar Valve Assembly seats against the Float Seating Surface 34 under the force from Float Collar Spring 36 that makes a one-way cement valve. However, the pressure applied to the mud or cement from the surface may force open the Float to allow mud or cement to be forced into the annulus generally designated as 38 in FIG. 1. This one-way cement valve is a particular example of "a one-way cement valve means installed near the drill bit" which is a term defined herein. The one-way cement valve means may be installed at any distance from the drill bit but is preferentially installed "near" the drill bit.

FIG. 1 corresponds to the situation where cement is in the process of being forced from the surface through the Latching Float Collar Valve Assembly. In fact, the top level of cement in the well is designated as element 40. Below 40, cement fills the annulus of the borehole. Above 40, mud fills the annulus of the borehole. For example, cement is present at position 42 and drilling mud is present at position 44 in FIG. 1.

Relatively thin-wall casing, or drill pipe, designated as element 46 in FIG. 1, is attached to the Latching Sub. The bottom male threads of the drill pipe 48 are screwed into the female threads 50 of the Latching Sub.

The drilling mud was wiped off the walls of the drill pipe in the well with Bottom Wiper Plug 52. The Bottom Wiper Plug is fabricated from rubber in the shape shown. Portions 54 and 56 of the Upper Seal of the Bottom Wiper Plug are shown in a ruptured condition in FIG. 1. Initially, they sealed the upper portion of the Bottom Wiper Plug. Under pressure from cement, the Bottom Wiper Plug is pumped down into the well until the Lower Lobe of the Bottom Wiper Plug 58 latches into place into Latching Sub Recession 60 in the Latching Sub. After the Bottom Wiper Plug latches into place, the pressure of the cement ruptures The Upper Seal of the Bottom Wiper Plug. A Bottom Wiper Plug Lobe 62 is shown in FIG. 1. Such lobes provide an efficient means to wipe the mud off the walls of the drill pipe while the Bottom Wiper Plug is pumped downhole with cement.

Top Wiper Plug 64 is being pumped downhole by water 66 under pressure in the drill pipe. As the Top Wiper Plug 64 is pumped down under water pressure, the cement remaining in region 68 is forced downward through the Bottom Wiper Plug, through the Latching Float Collar Valve Assembly, through the waterpassages of the drill bit and into the annulus in the well. A Top Wiper Plug Lobe 70 is shown in FIG. 1. Such lobes provide an efficient means to wipe the cement off the walls of the drill pipe while the Top Wiper Plug is pumped downhole with water.

After the Bottom Surface 72 of the Top Wiper Plug is forced into the Top Surface 74 of the Bottom Wiper Plug, almost the entire "cement charge" has been forced into the annulus between the drill pipe and the hole. As pressure is reduced on the water, the Float of the Latching Float Collar Valve Assembly seals against the Float Seating Surface 34. As the water pressure is reduced on the inside of the drill pipe, then the cement in the annulus between the drill pipe and the hole can cure under ambient hydrostatic conditions. This procedure herein provides an example of the proper operation of a "one-way cement valve means".

Therefore, the preferred embodiment in FIG. 1 provides apparatus that uses the steel drill string attached to a drilling bit during drilling operations used to drill oil and gas wells for a second purpose as the casing that is cemented in place during typical oil and gas well completions.

The preferred embodiment in FIG. 1 provides apparatus and methods of operation of said apparatus that results in the efficient installation of a cemented steel cased well during one single pass down into the earth of the steel drill string thereby making a steel cased borehole or cased well.

The steps described herein in relation to the preferred embodiment in FIG. 1 provides a method of operation that uses the typical mud passages already present in a typical rotary drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single pass into the earth.

The preferred embodiment of the invention further provides apparatus and methods of operation that results in the pumping of cement down the drill string, through the mud passages in the drill bit, and into the annulus between the formation and the drill string for the purpose of cementing the drill string and the drill bit into place during one single drilling pass into the formation.

The apparatus described in the preferred embodiment in FIG. 1 also provide a one-way cement valve and related devices installed near the drill bit of the drill string that allows the cement to set up efficiently while the drill string and drill bit are cemented into place during one single drilling pass into the formation.

Methods of operation of apparatus disclosed in FIG. 1 have been disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in detail below. The New Drilling Process is now possible because of "Several Recent Changes in the Industry" also described in detail below.

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is included herein by reference in its entirety comprised of the following: Unit I—"The Rig and Its Maintenance" (12 Lessons); Unit II—"Normal Drilling Operations" (5 Lessons); Unit III—Nonroutine Rig Operations (4 Lessons); Unit IV—Man Management and Rig Management (1 Lesson); and Unit V—Offshore Technology (9 Lessons). All of the individual Glossaries of all of the above Lessons in their entirety are also explicitly included herein, and all definitions in those Glossaries shall be considered to be explicitly referenced and/or defined herein.

Additional procedures used in the oil and gas industries to drill and complete wells are well documented in the series entitled "Lessons in Well Servicing and Workover" published by the Petroleum Extension Service of The University of Texas at Austin, Austin, Tex. that is included herein by reference in its entirety comprised of all 12 Lessons. All of the individual Glossaries of all of the above Lessons in their entirety are also explicitly included herein, and any and all definitions in those Glossaries shall be considered to be explicitly referenced and/or defined herein.

With reference to typical practices in the oil and gas industries, a typical drilling process may therefore be described in the following.

Typical Drilling Process

From an historical perspective, completing oil and gas wells using rotary drilling techniques have in recent times comprised the following typical steps:

Step 1. With a pile driver or rotary rig, install any necessary conductor pipe on the surface for attachment of the blowout preventer and for mechanical support at the wellhead.

Step 2. Install and cement into place any surface casing necessary to prevent washouts and cave-ins near the surface, and to prevent the contamination of freshwater sands as directed by state and federal regulations.

Step 3. Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Step 4. Drill the production well using a succession of rotary drill bits attached to the drill string until the hole is drilled to its final depth.

Step 5. After the final depth is reached, pull out the drill string and its attached drill bit.

Step 6. Perform open-hole logging of the geological formations to determine the amount of oil and gas present. This typically involves measurements of the porosity of the rock, the electrical resistivity of the water present, the electrical resistivity of the rock, certain neutron measurements from within the open hole, and the use of Archie's Equations. If no oil and gas is present from the analysis of such open-hole logs, an option can be chosen to cement the well shut. If commercial amounts of oil and gas are present, continue the following steps.

Step 7. Typically reassemble drill bit and drill string into the well to clean the well after open-hole logging.

Step 8. Pull out the drill string and its attached drill bit.

Step 9. Attach the casing shoe into the bottom male pipe threads of the first length of casing to be installed into the well. This casing shoe may or may not have a one-way valve ("casing shoe valve") installed in its interior to prevent fluids from back-flowing from the well into the casing string.

Step 10. Typically install the float collar onto the top female threads of the first length of casing to be installed into the well which has a one-way valve ("float collar valve") that allows the mud and cement to pass only one way down into the hole thereby preventing any fluids from back-flowing from the well into the casing string. Therefore, a typical installation has a casing shoe attached to the bottom and the float collar valve attached to the top portion of the first length of casing to be lowered into the well. Please refer to the book entitled "Casing and Cementing", Unit II, Lesson 4, Second Edition, of the Rotary Drilling Series, Petroleum Extension Service, The University of Texas at Austin, Austin, Tex., 1982 (hereinafter defined as "Ref.1"), an entire copy of which is included herein by reference. In particular, please refer to pages 28–31 of that book (Ref. 1). All of the individual definitions of words and phrases in the Glossary of Ref. 1 are also explicitly and separately included herein in their entirety by reference.

Step 11. Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

Step 12. To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps:

A. Introduce the Bottom Wiper Plug into the interior of the steel casing assembled in the well and pump down with cement that cleans the mud off the walls and separates the mud and cement (Ref. 1, pages 28–31).

B. Introduce the Top Wiper Plug into the interior of the steel casing assembled into the well and pump down with water under pump pressure thereby forcing the cement through the float collar valve and any other one-way valves present (Ref. 1, pages 28–31).

C. After the Bottom Wiper Plug and the Top Wiper Plug have seated in the float collar, release the pump pressure on the water column in the casing that results in the closing of the float collar valve which in turn prevents cement from backing up into the interior of the casing. The resulting interior pressure release on the inside of the casing upon closure of the float collar valve prevents distortions of the casing that might prevent a good cement seal (Ref. 1, page 30). In such circumstances, "the cement is cured under ambient hydrostatic conditions".

Step 13. Allow the cement to cure.

Step 14. Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Austin, Tex., 1971 (hereinafter defined as "Ref. 2"), an entire copy of which is included herein by reference. All of the individual definitions of words and phrases in the Glossary of Ref. 2 are also explicitly and separately included herein in their entirety by reference. Other methods of completing the well are described therein that shall, for the purposes of this application herein, also be called "final completion operations".

Several Recent Changes in the Industry

Several recent concurrent changes in the industry have made it possible to reduce the number of steps defined above. These changes include the following:

a. Until recently, drill bits typically wore out during drilling operations before the desired depth was reached by the production well. However, certain drill bits have recently been able to drill a hole without having to be changed. For example, please refer to the book entitled "The Bit", Unit I, Lesson 2, Third Edition, of the Rotary Drilling Series, The University of Texas at Austin, Austin, Tex., 1981 (hereinafter defined as "Ref. 3"), an entire copy of which is included herein by reference. All of the individual definitions of words and phrases in the Glossary of Ref. 3 are also explicitly and separately included herein in their entirety by reference. On page 1 of Ref. 3 it states: "For example, often only one bit is needed to make a hole in which the casing will be set." On page 12 of Ref. 3 it states in relation to tungsten carbide insert roller cone bits: "Bit runs as long as 300 hours have been achieved; in some instances, only one or two bits have been needed to drill a well to total depth." This is particularly so since the advent of the sealed bearing tri-cone bit designs appeared in 1959 (Ref. 3, page 7) having tungsten carbide inserts (Ref. 3, page 12). Therefore, it is now practical to talk about drill bits lasting long enough for drilling a well during one pass into the formation, or "one pass drilling".

b. Until recently, it has been impossible or impractical to obtain sufficient geophysical information to determine the presence or absence of oil and gas from inside steel pipes in wells. Heretofore, either standard open-hole logging tools or Measurement-While-Drilling ("MWD") tools were used in the open hole to obtain such information. Therefore, the industry has historically used various open-hole tools to measure formation characteristics. However, it has recently become possible to measure the various geophysical quantities listed in Step 6 above from inside steel pipes such as drill strings and casing strings. For example, please refer to the book entitled "Cased Hole Log Interpretation Principles/Applications", Schlumberger Educational Services, Houston, Tex., 1989, an entire copy of which is included herein by reference. Please also refer to the article entitled "Electrical Logging: State-of-the-Art", by Robert E. Maute, The Log Analyst, May–June 1992, pages 206–227, an entire copy of which is included herein by reference.

Because drill bits typically wore out during drilling operations until recently, different types of metal pipes have historically evolved which are attached to drilling bits, which, when assembled, are called "drill strings". Those drill strings are different than typical "casing strings" run into the well. Because it was historically absolutely necessary to do open-hole logging to determine the presence or absence of oil and gas, the fact that different types of pipes were used in "drill strings" and "casing strings" was of little consequence to the economics of completing wells. However, it is possible to choose the "drill string" to be acceptable for a second use, namely as the "casing string" that is to be installed after drilling has been completed.

New Drilling Process

Therefore, the preferred embodiments of the invention herein reduces and simplifies the above 14 steps as follows:

Repeat Steps 1–2 above.

Steps 3–5 (Revised). Choose the drill bit so that the entire production well can be drilled to its final depth using only one single drill bit. Choose the dimensions of the drill bit for desired size of the production well. If the cement is to be cured under ambient hydrostatic conditions, attach the drill bit to the bottom female threads of the Latching Subassembly ("Latching Sub"). Choose the material of the drill string from pipe material that can also be used as the casing string. Attach the first section of drill pipe to the top female threads of the Latching Sub. Then rotary drill the production well to its final depth during "one pass drilling" into the well. While drilling, simultaneously circulate drilling mud to carry the rock chips to the surface, to prevent blowouts, to prevent excessive mud loss into formation, to cool the bit, and to clean the bit.

Step 6 (Revised). After the final depth of the production well is reached, perform logging of the geological formations to determine the amount of oil and gas present from inside the drill pipe of the drill string. This typically involves measurements from inside the drill string of the necessary geophysical quantities as summarized in Item "b." of "Several Recent Changes in the Industry". If such logs obtained from inside the drill string show that no oil or gas is present, then the drill string can be pulled out of the well and the well filled in with cement. If commercial amounts of oil and gas are present, continue the following steps.

Steps 7–11 (Revised). If the cement is to be cured under ambient hydrostatic conditions, pump down a Latching Float Collar Valve Assembly with mud until it latches into place in the notches provided in the Latching Sub located above the drill bit.

Steps 12–13 (Revised). To "cure the cement under ambient hydrostatic conditions", typically execute a two-plug cementing procedure involving a first Bottom Wiper Plug before and a second Top Wiper Plug behind the cement that also minimizes cement contamination comprised of the following individual steps:

A. Introduce the Bottom Wiper Plug into the interior of the drill string assembled in the well and pump down with cement that cleans the mud off the walls and separates the mud and cement.

B. Introduce the Top Wiper Plug into the interior of the drill string assembled into the well and pump down with water thereby forcing the cement through any Float Collar Valve Assembly present and through the watercourses in "a regular bit" or through the mud nozzles of a "jet bit" or through any other mud passages in the drill bit into the annulus between the drill string and the formation.

C. After the Bottom Wiper Plug, and Top Wiper Plug have seated in the Latching Float Collar Valve Assembly, release the pressure on the interior of the drill string that results in the closing of the float collar which in turn prevents cement from backing up in the drill string. The resulting pressure release upon closure of the float collar prevents distortions of the drill string that might prevent a good cement seal as described earlier. I.e., "the cement is cured under ambient hydrostatic conditions".

Repeat Step 14 above.

Therefore, the "New Drilling Process" has only 7 distinct steps instead of the 14 steps in the "Typical Drilling Process". The "New Drilling Process" consequently has fewer steps, is easier to implement, and will be less expensive.

The preferred embodiment of the invention disclosed in FIG. 1 requires a Latching Subassembly and a Latching Float Collar Valve Assembly. An advantage of this approach is that the Float 32 of the Latching Float Collar Valve Assembly and the Float Seating Surface 34 in FIG. 1 are installed at the end of the drilling process and are not subject to any wear by mud passing down during normal drilling operations.

Another preferred embodiment of the invention provides a float and float collar valve assembly permanently installed within the Latching Subassembly at the beginning of the drilling operations. However, such a preferred embodiment has the disadvantage that drilling mud passing by the float and the float collar valve assembly during normal drilling operations could subject the mutually sealing surfaces to potential wear. Nevertheless, a float collar valve assembly can be permanently installed above the drill bit before the drill bit enters the well.

Figure 2:
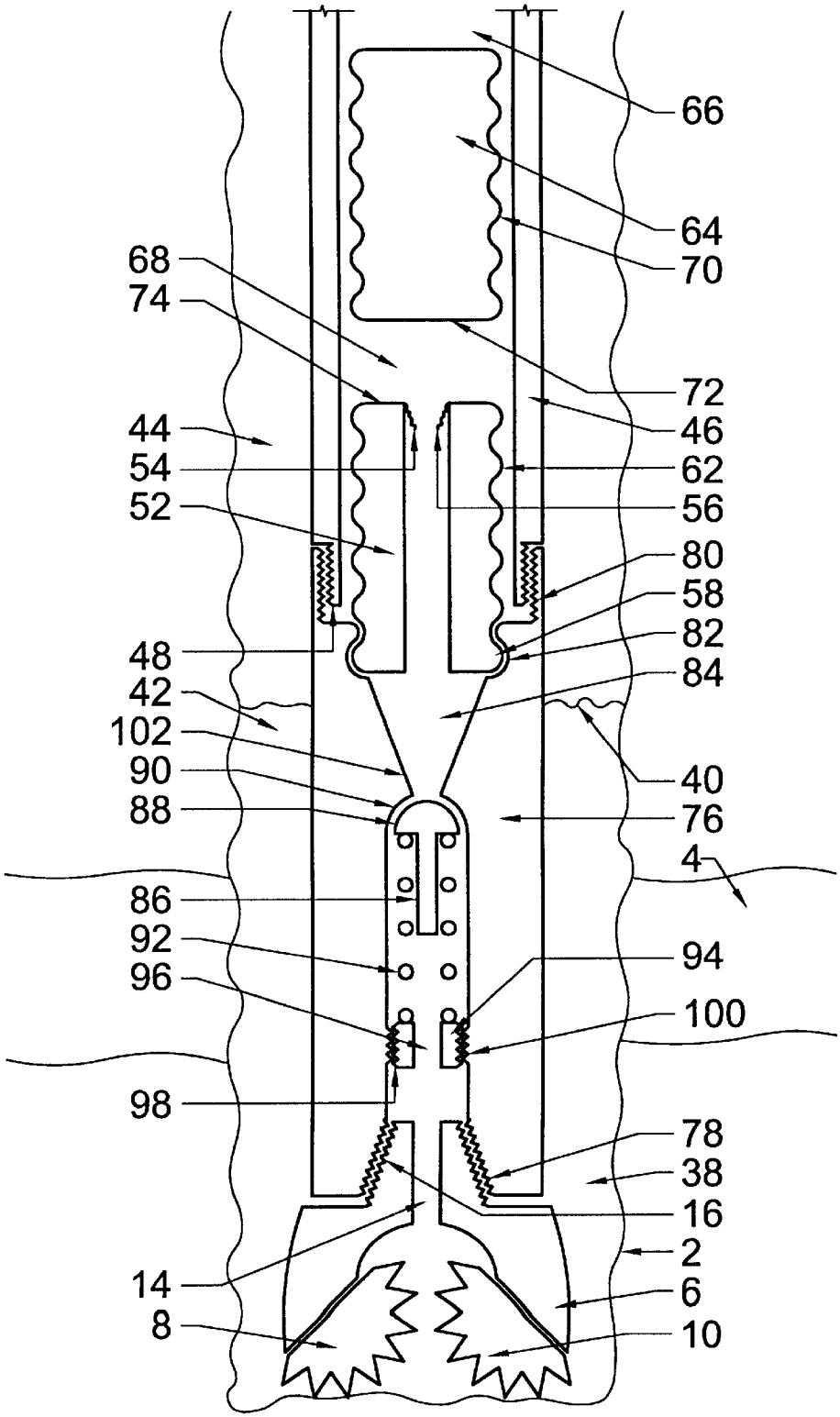
PRIOR ART FIG. 2
FIG. 2 shows a section view of a rotary drill string having a rotary drill bit in the process of being cemented into place during one drilling pass into formation by using a Permanently Installed Float Collar Valve Assembly that is permanently installed above the rotary drill bit that is a preferred embodiment of the invention.

FIG. 2 shows another preferred embodiment of the invention that has such a float collar valve assembly permanently installed above the drill bit before the drill bit enters the well. FIG. 2 shows many elements common to FIG. 1. The Permanently Installed Float Collar Valve Assembly 76, hereinafter abbreviated as the "PIFCVA", is installed into the drill string on the surface of the earth before the drill bit enters the well. On the surface, the threads 16 on the rotary drill bit 6 are screwed into the lower female threads 78 of the PIFCVA. The bottom male threads of the drill pipe 48 are screwed into the upper female threads 80 of the PIFCVA. The PIFCVA Latching Sub Recession 82 is similar in nature and function to element 60 in FIG. 1. The fluids flowing through the standard water passage 14 of the drill bit flow through PIFCVA Guide Channel 84. The PIFCVA Float 86 has a Hardened Hemispherical Surface 88 that seats against the hardened PIFCVA Float Seating Surface 90 under the force PIFCVA Spring 92. Surfaces 88 and 90 may be fabricated from very hard materials such as tungsten carbide. Alternatively, any hardening process in the metallurgical arts may be used to harden the surfaces of standard steel parts to make suitable hardened surfaces 88 and 90. The PIFCVA Spring 92 and the PIVCVA Threaded Spacer 94 are shown in FIG. 2. The lower surfaces of the PIFCVA Spring 92 seat against the upper portion of the PIFCVA Threaded Spacer 94 that has PIFCVA Threaded Spacer Passage 96. The PIFCVA Threaded Spacer 94 has exterior threads 98 that thread into internal threads 100 of the PIFCVA (that is assembled into place within the PIFCVA prior to attachment of the drill bit to the PIFCVA). Surface 102 facing the lower portion of the PIFCVA Guide Channel 84 may also be made from hardened materials, or otherwise surface hardened, so as to prevent wear from the mud flowing through this portion of the channel during drilling.

Once the PIFCVA is installed into the drill string, then the drill bit is lowered into the well and drilling commenced. Mud pressure from the surface opens PIFCVA Float 86. The steps for using the preferred embodiment in FIG. 2 are slightly different than using that shown in FIG. 1. Basically, the "Steps 7–11 (Revised)" of the "New Drilling Process" are eliminated because it is not necessary to pump down any type of Latching Float Collar Valve Assembly of the type described in FIG. 1. In "Steps 3–5 (Revised)" of the "New Drilling Process", it is evident that the PIFCVA is installed into the drill string instead of the Latching Subassembly appropriate for FIG. 1. In Steps 12–13 (Revised) of the "New Drilling Process", it is also evident that the Lower Lobe of the Bottom Wiper Plug 58 latches into place into the PIFCVA Latching Sub Recession 82.

The PIFCVA installed into the drill string is another example of a one-way cement valve means installed near the drill bit to be used during one-pass drilling of the well. Here, the term "near" shall mean within 500 feet of the drill bit. Consequently, FIG. 2 describes a rotary drilling apparatus to drill a borehole into the earth comprising a drill string attached to a rotary drill bit and one-way cement valve means installed near the drill bit to cement the drill string and rotary drill bit into the earth to make a steel cased well. Here, the method of drilling the borehole is implemented with a rotary drill bit having mud passages to pass mud into the borehole from within a steel drill string that includes at least one step that passes cement through such mud passages to cement the drill string into place to make a steel cased well.

The drill bits described in FIG. 1 and FIG. 2 are milled steel toothed roller cone bits. However, any rotary bit can be used with the invention. A tungsten carbide insert roller cone bit can be used. Any type of diamond bit or drag bit can be used. The invention may be used with any drill bit described in Ref. 3 above that possesses mud passages, waterpassages, or passages for gas. Any type of rotary drill bit can be used possessing such passageways. Similarly, any type of bit whatsoever that utilizes any fluid or gas that passes through passageways in the bit can be used whether or not the bit rotates.

As another example of ". . . any type of bit whatsoever . . . " described in the previous sentence, a new type of drill bit invented by the inventor of this application can be used for the purposes herein that is disclosed in U.S. Pat. No. 5,615,747, that is entitled "Monolithic Self Sharpening Rotary Drill Bit Having Tungsten Carbide Rods Cast in Steel Alloys", that issued on Apr. 1, 1997 (hereinafter Vail{747}), an entire copy of which is incorporated herein by reference. That new type of drill bit is further described in a Continuing application of Vail{747} that is now U.S. Pat. No. 5,836,409, that is also entitled "Monolithic Self Sharpening Rotary Drill Bit Having Tungsten Carbide Rods Cast in Steel Alloys", that issued on the date of Nov. 17, 1998 (hereinafter Vail{409}), an entire copy of which is incorporated herein by reference. That new type of drill bit is further described in a Continuation-in-Part application of Vail{409} that is Ser. No. 09/192,248, that has the filing date of Nov. 16, 1998, that is entitled "Rotary Drill Bit Compensating for Changes in Hardness of Geological Formations", an entire copy of which is incorporated herein by reference. As yet another example of ". . . any type of bit whatsoever . . . " described in the last sentence of the previous paragraph, FIG. 3 shows the use of the invention using coiled-tubing drilling techniques.

Coiled Tubing Drilling

Figure 3:
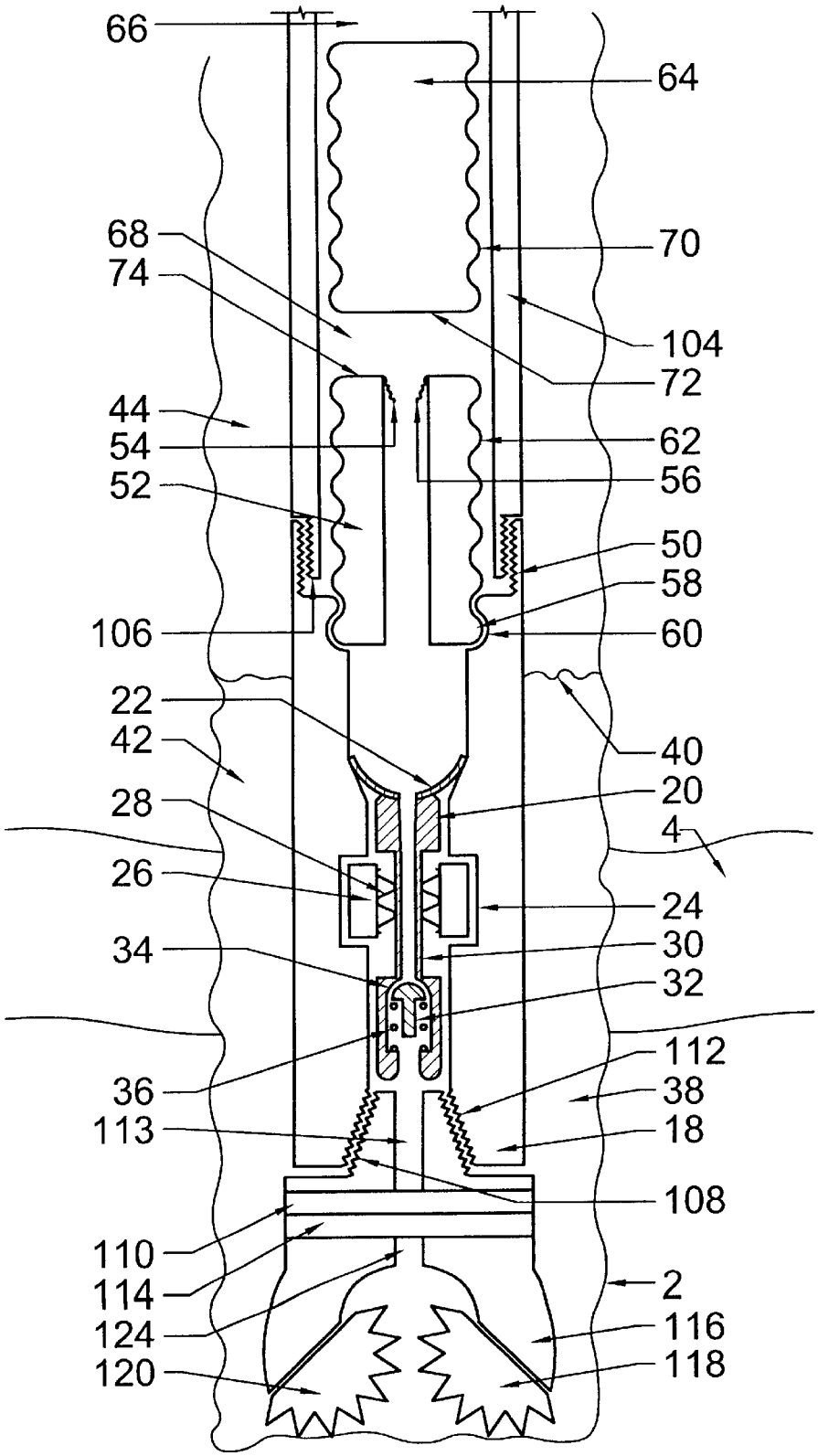
PRIOR ART FIG. 3
FIG. 3 shows a section view of a tubing conveyed mud motor drilling apparatus in the process of being cemented into place during one drilling pass into formation by using a Latching Float Collar Valve Assembly that has been pumped into place above the rotary drill bit that is a preferred embodiment of the invention.

FIG. 3 shows another preferred embodiment of the invention that is used for certain types of coiled-tubing drilling applications. FIG. 3 shows many elements common to FIG. 1. It is explicitly stated at this point that all the standard coiled-tubing drilling arts now practiced in the industry are incorporated herein by reference. Not shown in FIG. 3 is the coiled tubing drilling rig on the surface of the earth having among other features, the coiled tubing unit, a source of mud, mud pump, etc. In FIG. 3, the well has been drilled. This well can be: (a) a freshly drilled well; or (b) a well that has been sidetracked to a geological formation from within a casing string that is an existing cased well during standard re-entry applications; or (c) or a well that has been sidetracked from within a tubing string that is in turn suspended within a casing string in an existing well during certain other types of re-entry applications. Therefore, regardless of how drilling is initially conducted, in an open hole, or from within a cased well that may or may not have a tubing string, the apparatus shown in FIG. 3 drills a borehole 2 through the earth including through geological formation 4.

Before drilling commences, the lower end of the coiled tubing 104 is attached to the Latching Subassembly 18. The bottom male threads of the coiled tubing 106 thread into the female threads of the Latching Subassembly 50.

The top male threads 108 of the Stationary Mud Motor Assembly 110 are screwed into the lower female threads 112 of Latching Subassembly 18. Mud under pressure flowing through channel 113 causes the Rotating Mud Motor Assembly 114 to rotate in the well. The Rotating Mud Motor Assembly 114 causes the Mud Motor Drill Bit Body 116 to rotate. That Mud Motor Drill Bit Body holds in place milled steel roller cones 118, 120, and 122 (not shown for simplicity). A standard water passage 124 is shown through the Mud Motor Drill Bit Body. During drilling operations, as mud is pumped down from the surface, the Rotating Mud Motor Assembly 114 rotates causing the drilling action in the well. It should be noted that any fluid pumped from the surface under sufficient pressure that passes through channel 113 goes through the mud motor turbine (not shown) that causes the rotation of the Mud Motor Drill Bit Body and then flows through standard water passage 124 and finally into the well.

The steps for using the preferred embodiment in FIG. 3 are slightly different than using that shown in FIG. 1. In drilling an open hole, "Steps 3–5 (Revised)" of the "New Drilling Process" must be revised here to site attachment of the Latching Subassembly to one end of the coiled tubing and to site that standard coiled tubing drilling methods are employed. The coiled tubing can be on the coiled tubing unit at the surface for this step or the tubing can be installed into a wellhead on the surface for this step. In "Step 6 (Revised)" of the "New Drilling Process", measurements are to be performed from within the coiled tubing when it is disposed in the well. In "Steps 12–13 (Revised)" of the "New Drilling Process", the Bottom Wiper Plug and the Top Wiper Plug are introduced into the upper end of the coiled tubing at the surface. The coiled tubing can be on the coiled tubing unit at the surface for these steps or the tubing can be installed into a wellhead on the surface for these steps. In sidetracking from within an existing casing, in addition to the above steps, it is also necessary to lower the coiled tubing drilling apparatus into the cased well and drill through the casing into the adjacent geological formation at some predetermined depth. In sidetracking from within an existing tubing string suspended within an existing casing string, it is also necessary to lower the coiled tubing drilling apparatus into the tubing string and then drill through the tubing string and then drill through the casing into the adjacent geological formation at some predetermined depth.

Therefore, FIG. 3 shows a tubing conveyed mud motor drill bit apparatus, to drill a borehole into the earth comprising tubing attached to a mud motor driven rotary drill bit and one-way cement valve means installed above the drill bit to cement the drill string and rotary drill bit into the earth to make a tubing encased well. The tubing conveyed mud motor drill bit apparatus is also called a tubing conveyed mud motor drilling apparatus, that is also called a tubing conveyed mud motor driven rotary drill bit apparatus. Put another way, FIG. 3 shows a section view of a coiled tubing conveyed mud motor driven rotary drill bit apparatus in the process of being cemented into place during one drilling pass into formation by using a Latching Float Collar Valve Assembly that has been pumped into place above the rotary drill bit. Methods of operating the tubing conveyed mud motor drilling apparatus in FIG. 3 include a method of drilling a borehole with a coiled tubing conveyed mud motor driven rotary drill bit having mud passages to pass mud into the borehole from within the tubing that includes at least one step that passes cement through said mud passages to cement the tubing into place to make a tubing encased well.

In the "New Drilling Process", Step 14 is to be repeated, and that step is quoted in part in the following paragraph as follows:

> 'Step 14. Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Austin, Tex., 1971 (hereinafter defined as "Ref. 2"), an entire copy of which is included herein by reference. All of the individual definitions of words and phrases in the Glossary of Ref. 2 are also explicitly and separately included herein in their entirety by reference. Other methods of completing the well are described therein that shall, for the purposes of this application herein, also be called "final completion operations".'

With reference to the last sentence above, there are indeed many 'Other methods of completing the well that for the purposes of this application herein, also be called "final completion operations"'. For example, Ref. 2 on pages 10–11 describe "Open-Hole Completions". Ref. 2 on pages 13–17 describe "Liner Completions". Ref. 2 on pages 17–30 describe "Perforated Casing Completions" that also includes descriptions of centralizers, squeeze cementing, single zone completions, multiple zone completions, tubingless completions, multiple tubingless completions, and deep well liner completions among other topics.

Similar topics are also discussed a previously referenced book entitled "Testing and Completing", Unit II, Lesson 5, Second Edition, of the Rotary Drilling Series, Petroleum Extension Service, The University of Texas at Austin, Austin, Tex., 1983 (hereinafter defined as "Ref. 4"), an entire copy of which is included herein by reference. All of the individual definitions of words and phrases in the Glossary of Ref. 1 are also explicitly and separately included herein in their entirety by reference.

For example, on page 20 of Ref. 4, the topic "Completion Design" is discussed. Under this topic are described various different "Completion Methods". Page 21 of Ref. 4 describes "Open-hole completions". Under the topic of "Perforated completion" on pages 20–22, are described both standard cementing completions and gravel completions using slotted liners.

Well Completions with Slurry Materials

Standard cementing completions are described above in the new "New Drilling Process". However, it is evident that any slurry like material or "slurry material" that flows under pressure, and behaves like a multicomponent viscous liquid like material, can be used instead of "cement" in the "New Drilling Process". In particular, instead of "cement", water, gravel, or any other material can be used provided it flows through pipes under suitable pressure.

At this point, it is useful to review several definitions that are routinely used in the industry. First, the glossary of Ref. 4 defines several terms of interest.

The Glossary of Ref. 4 defines the term "to complete a well" to be the following: "to finish work on a well and bring it to productive status. See well completion."

The Glossary of Ref. 4 defines term the "well completion" to be the following: "1. the activities and methods of preparing a well for the production of oil and gas; the method by which one or more flow paths for hydrocarbons is established between the reservoir and the surface. 2. the systems of tubulars, packers, and other tools installed beneath the wellhead in the production casing, that is, the tool assembly that provides the hydrocarbon flow path or paths." To be precise for the purposes herein, the term "completing a well" or the term "completing the well" are each separately equivalent to performing all the necessary steps for a "well completion".

The Glossary of Ref. 4 defines the term "gravel" to be the following: "in gravel packing, sand or glass beads of uniform size and roundness."

The Glossary of Ref. 4 defines the term "gravel packing" to be the following: "a method of well completion in which a slotted or perforated liner, often wire-wrapper, is placed in the well and surrounded by gravel. If open-hole, the well is sometimes enlarged by underreaming at the point were the gravel is packed. The mass of gravel excludes sand from the wellbore but allows continued production."

Other pertinent terms are defined in Ref. 1.

The Glossary of Ref. 1 defines the term "cement" to be the following: "a powder, consisting of alumina, silica, lime, and other substances that hardens when mixed with water. Extensively used in the oil industry to bond casing to walls of the wellbore."

The Glossary of Ref. 1 defines the term "cement clinker" to be the following: "a substance formed by melting ground limestone, clay or shale, and iron ore in a kiln. Cement clinker is ground into a powdery mixture and combined with small accounts of gypsum or other materials to form a cement".

The Glossary of Ref. 1 defines the term "slurry" to be the following: "a plastic mixture of cement and water that is pumped into a well to harden; there it supports the casing and provides a seal in the wellbore to prevent migration of underground fluids."

The Glossary of Ref. 1 defines the term "casing" as is typically used in the oil and gas industries to be the following: "steel pipe placed in an oil or gas well as drilling progresses to prevent the wall of the hole from caving in during drilling, to prevent seepage of fluids, and to provide a means of extracting petroleum if the well is productive". Of course, in light of the invention herein, the "drill pipe" becomes the "casing", so the above definition needs modification under certain usages herein.

U.S. Pat. No. 4,883,125, that issued on Nov. 28, 1994, that is entitled "Cementing Oil and Gas Wells Using Converted Drilling Fluid", an entire copy of which is incorporated herein by reference, describes using "a quantity of drilling fluid mixed with a cement material and a dispersant such as a sulfonated styrene copolymer with or without an organic acid". Such a "cement and copolymer mixture" is yet another example of a "slurry material" for the purposes herein.

U.S. Pat. No. 5,343,951, that issued on Sep. 6, 1994, that is entitled "Drilling and Cementing Slim Hole Wells", an entire copy of which is incorporated herein by reference, describes "a drilling fluid comprising blast furnace slag and water" that is subjected thereafter to an activator that is "generally, an alkaline material and additional blast furnace slag, to produce a cementitious slurry which is passed down a casing and up into an annulus to effect primary cementing." Such an "blast furnace slag mixture" is yet another example of a "slurry material" for the purposes herein.

Therefore, and in summary, a "slurry material" may be any one, or more, of at least the following substances as rigorously defined above: cement, gravel, water, cement clinker, a "slurry" as rigorously defined above, a "cement and copolymer mixture", a "blast furnace slag mixture", and/or any mixture thereof. Virtually any known substance that flows under sufficient pressure may be defined the purposes herein as a "slurry material".

Therefore, in view of the above definitions, it is now evident that the "New Drilling Process" may be performed with any "slurry material". The slurry material may be used in the "New Drilling Process" for open-hole well completions; for typical cemented well completions having perforated casings; and for gravel well completions having perforated casings; and for any other such well completions.

Accordingly, a preferred embodiment of the invention is the method of drilling a borehole with a rotary drill bit having mud passages for passing mud into the borehole from within a steel drill string that includes at least the one step of passing a slurry material through those mud passages for the purpose of completing the well and leaving the drill string in place to make a steel cased well.

Further, another preferred embodiment of the inventions is the method of drilling a borehole into a geological formation with a rotary drill bit having mud passages for passing mud into the borehole from within a steel drill string that includes at least one step of passing a slurry material through said mud passages for the purpose of completing the well and leaving the drill string in place following the well completion to make a steel cased well during one drilling pass into the geological formation.

Yet furthers another preferred embodiment of the invention is a method of drilling a borehole with a coiled tubing conveyed mud motor driven rotary drill bit having mud passages for passing mud into the borehole from within the tubing that includes at the least one step of passing a slurry material through said mud passages for the purpose of completing the well and leaving the tubing in place to make a tubing encased well.

And further, yet another preferred embodiment of the invention is a method of drilling a borehole into a geological formation with a coiled tubing conveyed mud motor driven rotary drill bit having mud passages for passing mud into the borehole from within the tubing that includes at least the one step of passing a slurry material through said mud passages for the purpose of completing the well and leaving the tubing in place following the well completion to make a tubing encased well during one drilling pass into the geological formation.

Yet further, another preferred embodiment of the invention is a method of drilling a borehole with a rotary drill bit having mud passages for passing mud into the borehole from within a steel drill string that includes at least steps of: attaching a drill bit to the drill string; drilling the well with said rotary drill bit to a desired depth; and completing the well with the drill bit attached to the drill string to make a steel cased well.

Still further, another preferred embodiment of the invention is a method of drilling a borehole with a coiled tubing conveyed mud motor driven rotary drill bit having mud passages for passing mud into the borehole from within the tubing that includes at least the steps of: attaching the mud motor driven rotary drill bit to the coiled tubing; drilling the well with said tubing conveyed mud motor driven rotary drill bit to a desired depth; and completing the well with the mud motor driven rotary drill bit attached to the drill string to make a steel cased well.

And still further, another preferred embodiment of the invention is the method of one pass drilling of a geological formation of interest to produce hydrocarbons comprising at least the following steps: attaching a drill bit to a casing string; drilling a borehole into the earth to a geological formation of interest; providing a pathway for fluids to enter into the casing from the geological formation of interest; completing the well adjacent to said formation of interest with at least one of cement, gravel, chemical ingredients, mud; and passing the hydrocarbons through the casing to the surface of the earth while said drill bit remains attached to said casing.

The term "extended reach boreholes" is a term often used in the oil and gas industry. For example, this term is used in U.S. Pat. No. 5,343,950, that issued Sep. 6, 1994, having the Assignee of Shell Oil Company, that is entitled "Drilling and Cementing Extended Reach Boreholes". An entire copy of U.S. Pat. No. 5,343,950 is included herein by reference. This term can be applied to very deep wells, but most often is used to describe those wells typically drilled and completed from offshore platforms. To be more explicit, those "extended reach boreholes" that are completed from offshore platforms may also be called for the purposes herein "extended reach lateral boreholes". Often, this particular term, "extended reach lateral boreholes", implies that substantial portions of the wells have been completed in one more or less "horizontal formation". The term "extended reach lateral borehole" is equivalent to the term "extended reach lateral Smart shuttles are used to complete oil and gas wells. Following drilling operations into a geological formation, a steel pipe is disposed in the wellbore. The steel pipe may be a standard casing installed into the wellbore using typical industry practices. Alternatively, the steel pipe may be a drill string attached to a rotary drill bit that is to remain in the wellbore following completion during so-called "one-pass drilling operations". Using typical procedures in the industry, the well is "completed" by placing into the steel pipe various standard completion devices, many of which are conveyed into place using the drilling rig. Instead, with this invention, smart shuttles are used to convey into the steel pipe the various smart completion devices necessary to complete the oil and gas well. Smart shuttles may be attached to a wireline, to a coiled tubing, or to a wireline installed within coiled tubing. Of particular interest is a wireline conveyed smart shuttle that possesses an electrically operated internal pump that pumps fluid from below the shuttle, to above the shuttle, that in turn causes the smart shuttle to "pump itself down" and into a horizontal wellbore. Similar comments apply to coiled tubing conveyed smart shuttles. wellbore" for the purposes herein. The term "extended reach borehole" is equivalent to the term "extended reach wellbore" for the purposes herein. The invention herein is particularly useful to drill and complete "extended reach wellbores" and "extend reach lateral wellbores".

Therefore, the preferred embodiments above generally disclose the one pass drilling and completion of wellbores with drill bit attached to drill string to make cased wellbores to produce hydrocarbons. The preferred embodiments above are also particularly useful to drill and complete "extended reach wellbores" and "extended reach lateral wellbores".

Figure 4:
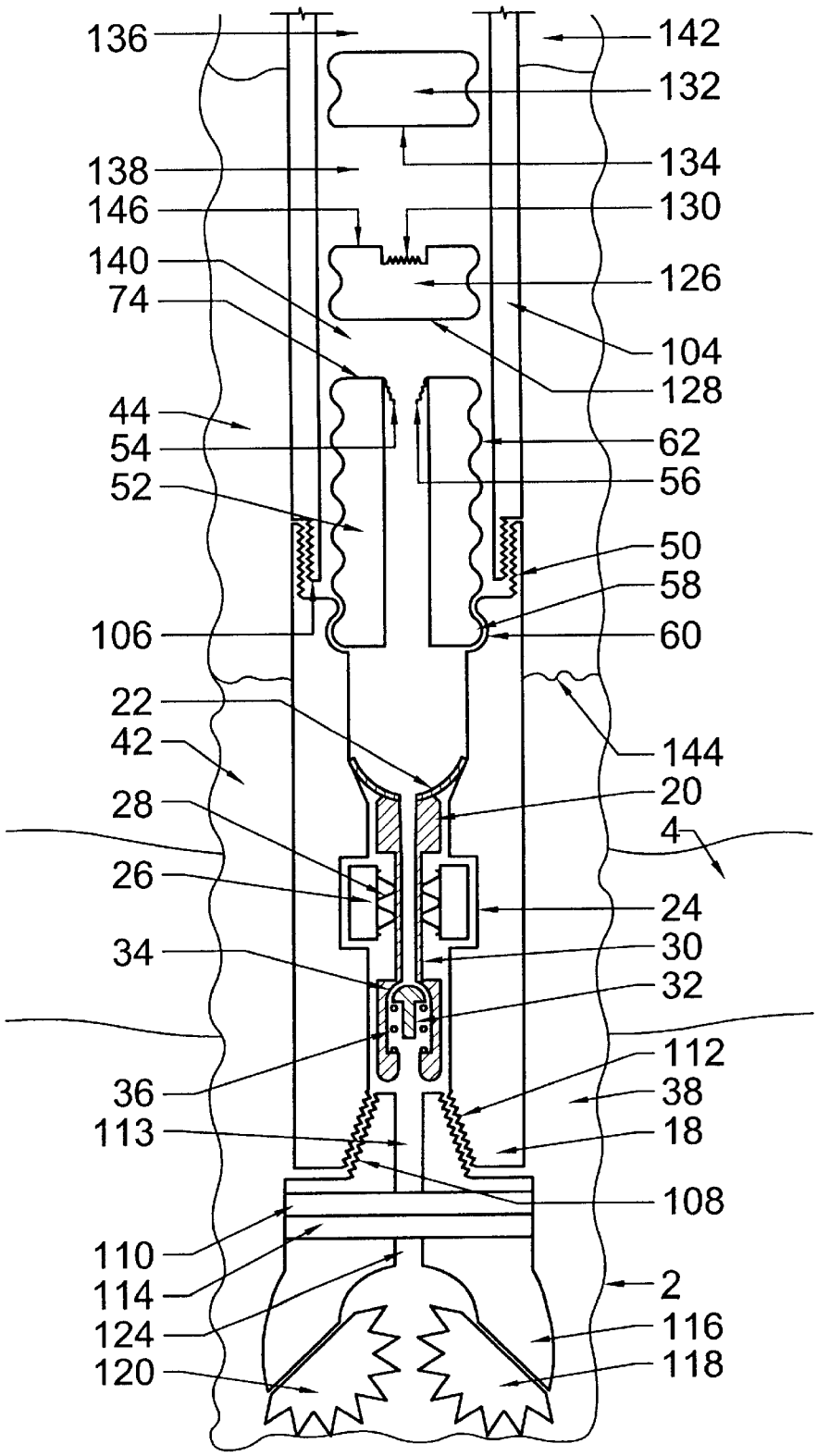
FIG. 4 shows a section view of a tubing conveyed mud motor drilling apparatus that in addition has several wiper plugs in the process of sequentially completing the well with gravel and then with cement.

For methods and apparatus particularly suitable for the one pass drilling and completion of extended reach lateral wellbores please refer to FIG. 4. FIG. 4 shows another preferred embodiment of the invention that is closely related to FIG. 3. Those elements numbered in sequence through element number 124 have already been defined previously. In FIG. 4, the previous single "Top Wiper Plug 64" in FIGS. 1, 2, and 3 has been removed, and instead, it has been replaced with two new wiper plugs, respectively called "Wiper Plug A" and "Wiper Plug B". Wiper Plug A is labeled with numeral 126, and Wiper Plug A has a bottom surface. That surface is defined as the Bottom Surface of Wiper Plug A that is numeral 128. The Upper Plug Seal of Wiper Plug A is labeled with numeral 130, and as it is shown in FIG. 4, is not ruptured. The Upper Plug Seal of Wiper Plug A that is numeral 130 functions analogously to elements 54 and 56 of the Upper Seal of the Bottom Wiper Plug (52) that are shown in a ruptured conditions in FIGS. 1, 2 and 3.

In FIG. 4, Wiper Plug B is labeled with numeral 132. It has a lower surface that is called the "Bottom Surface of Wiper Plug B" that is labeled with numeral 134. Wiper Plug A and Wiper Plug B are introduced separately into the interior of the tubing to pass multiple slurry materials into the wellbore to complete the well.

Using analogous methods described above in relation to FIGS. 1, 2 and 3, water 136 in the tubing is used to push on Wiper Plug B (132), that in turn pushes on cement 138 in the tubing, that in turn is used to push on gravel 140, that in turn pushes on the Float 32, that in turn and forces gravel into the wellbore past Float 32, that in turn forces mud 142 upward in the annulus of the wellbore. An explicit boundary between the mud and gravel is shown in the annulus of the wellbore in FIG. 4, and that boundary is labeled with numeral 144.

After the Bottom Surface of Wiper Plug A that is element 128 positively "bottoms out" on the Top Surface 74 of the Bottom Wiper Plug, then a predetermined amount of gravel has been injected into the wellbore forcing mud 142 upward in the annulus. Thereafter, forcing additional water 136 into the tubing will cause the Upper Plug Seal of Wiper Plug A (130) to rupture, thereby forcing cement 138 to flow toward the Float 32. Forcing yet additional water 136 into the tubing will in turn cause the Bottom Surface of Wiper Plug B 134 to "bottom out" on the Top Surface of Wiper Plug A that is labeled with numeral 146. At this point in the process, mud has been forced upward in the annulus of wellbore by gravel. The purpose of this process is to have suitable amounts of gravel and cement placed sequentially into the annulus between the wellbore for the completion of the tubing encased well and for the ultimate production of oil and gas from the completed well. This process is particularly useful for the drilling and completion of extended reach lateral wellbores with a tubing conveyed mud motor drilling apparatus to make tubing encased wellbores for the production of oil and gas.

Figure 5:
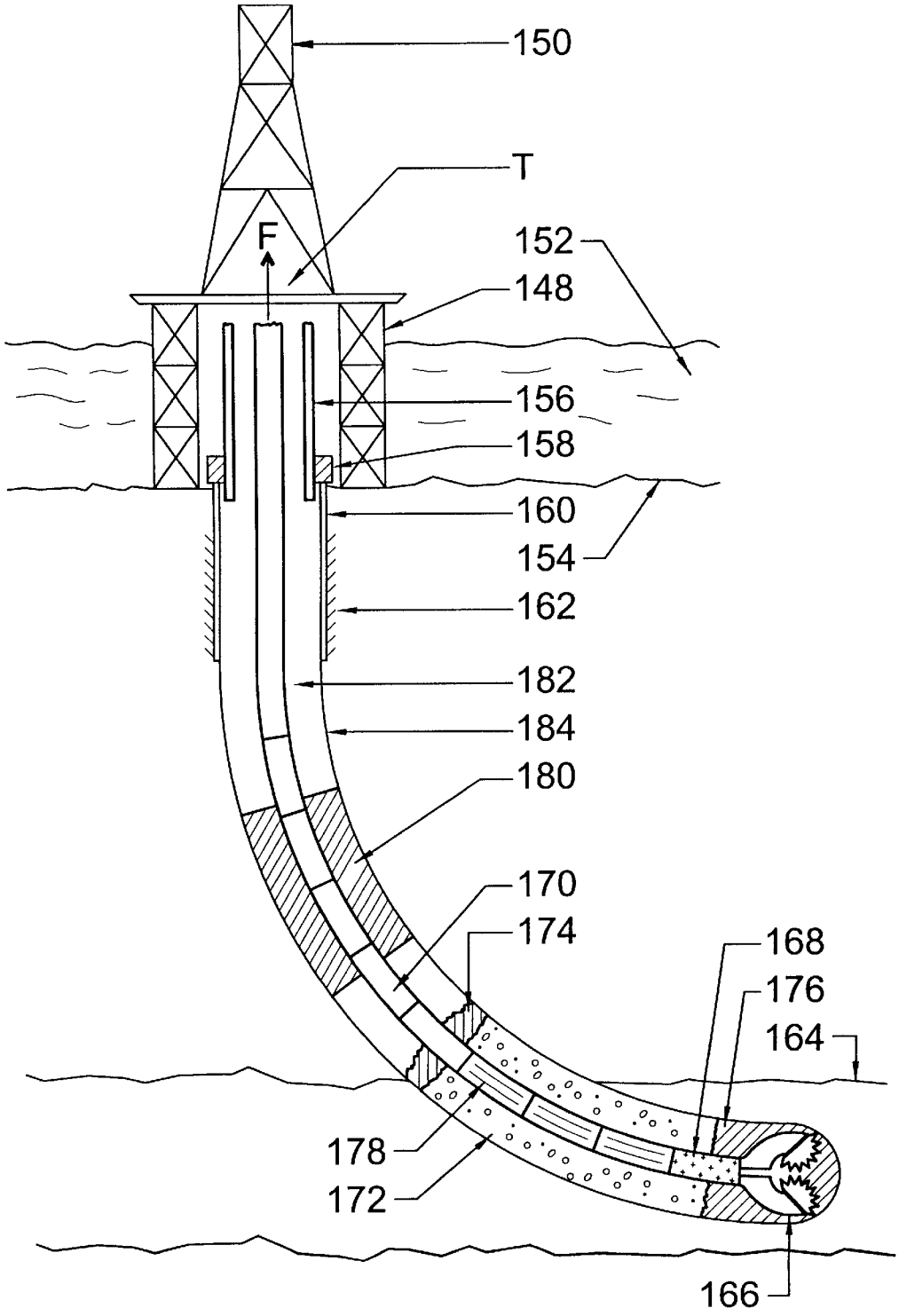
FIG. 5 shows a section view of an apparatus for the one pass drilling and completion of extended reach lateral wellbores with drill bit attached to drill string to produce hydrocarbons from offshore platforms.

It is clear that FIG. 1 could be modified with suitable Wiper Plugs A and B as described above in relation to FIG. 4. Put simply, in light of the disclosure above, FIG. 4 could be suitably altered to show a rotary drill bit attached to lengths of casing. However, in an effort to be brief, that detail will not be described. Instead, FIG. 5 shows one "snapshot" in the one pass drilling and completion of an extended reach lateral wellbore with drill bit attached to the drill string that is used to produce hydrocarbons from offshore platforms. This figure was substantially disclosed in U.S. Disclosure Document No. 452648 that was filed on Mar. 5, 1999.

Extended Reach Lateral Wellbores

In FIG. 5, An offshore platform 148 has a rotary drilling rig 150 surrounded by ocean 152 that is attached to the bottom of the sea 154. Riser 156 is attached to blow-out preventer 158. Surface casing 160 is cemented into place with cement 162. Other conductor pipe, surface casing, intermediate casings, liner strings, or other pipes may be present, but are not shown for simplicity. The drilling rig 150 has all typical components of a normal drilling rig as defined in the figure entitled "The Rig and its Components" opposite of page 1 of the book entitled "The Rotary Rig and Its Components", Third Edition, Unit I, Lesson 1, that is part of the "Rotary Drilling Series" published by the Petroleum Extension Service, Division of Continuing Education, The University of Texas at Austin, Austin, Tex., 1980, 39 pages, and entire copy of which is incorporated herein by reference.

FIG. 5 shows that oil bearing formation 164 has been drilled into with rotary drill bit 166. Drill bit 166 is attached to a "Completion Sub" having the appropriate float collar valve assembly, or other suitable float collar device, and other suitable completion devices as required that are shown in FIGS. 1, 2, 3, and 4. That "Completion Sub" is labeled with numeral 168 in FIG. 5. Completion Sub 168 is in turn attached to many lengths of drill pipe, one of which is labeled with numeral 170 in FIG. 5. The drill pipe is supported by usual drilling apparatus provided by the drilling rig. Such drilling apparatus provides an upward force at the surface labeled with legend "F" in FIG. 5, and the drill string is turned with torque provided by the drilling apparatus of the drilling rig, and that torque is figuratively labeled with the legend "T" in FIG. 5.

The previously described methods and apparatus were used to first, in sequence, force gravel 172 in the portion of the oil bearing formation 164 having producible hydrocarbons. If required, a cement plug formed by a "squeeze job" is figuratively shown by numeral 174 in FIG. 5 to prevent contamination of the gravel. Alternatively, an external casing packer, or other types of controllable packer means may be used for such purposes as previously disclosed by applicant in U.S. Disclosure Document No. 445686, filed on Oct. 11, 1998. Yet further, the cement plug 174 can be pumped into place ahead of the gravel using the above procedures using yet another wiper plug as may be required.

The cement 176 introduced into the borehole through the mud passages of the drill bit using the above defined methods and apparatus provides a seal near the drill bit, among other locations, that is desirable under certain situations.

Slots in the drill pipe have been opened after the drill pipe reached final depth. The slots can be milled with a special milling cutter having thin rotating blades that are pushed against the inside of the pipe. As an alternative, standard perforations may be fabricated in the pipe. Yet further, special types of expandable pipe may be manufactured that when pressurized from the inside against a cement plug near the drill bit or against a solid strong wiper plug, or against a bridge plug, suitable slots are forced open. Or, different materials may be used in solid slots along the length of steel pipe when the pipe is fabricated that can be etched out with acid during the well completion process to make the slots and otherwise leaving the remaining steel pipe in place. Accordingly, there are many ways to make the required slots. One such slot is labeled with numeral 178 in FIG. 5, and there are many such slots.

Therefore, hydrocarbons in zone 164 are produced through gravel 172 that flows through slots 178 and into the interior of the drill pipe to implement the one pass drilling and completion of an extended reach lateral wellbore with drill bit attached to drill string to produce hydrocarbons from an offshore platform. For the purposes of this preferred embodiment, such a completion is called a "gravel pack" completion, whether or not cement 174 or cement 176 are introduced into the wellbore.

It should be noted that cement is not necessarily needed. In some situations, the float need not be required depending upon the pressures in the formation.

FIG. 5 also shows a zone that has been cemented shut with a "squeeze job", a term known in the industry representing perforating and then forcing cement into the annulus using suitable packers to cement certain formations. This particular cement introduced into the annulus of the wellbore in FIG. 5 is shown as element 180. Such additional cementations may be needed to isolate certain formations as is typically done in the industry. As a final comment, the annulus 182 of the open hole 184 may be otherwise completed using typical well completion procedures in the oil and gas industries.

Therefore, FIG. 5 and the above description discloses a preferred method of drilling an extended reach lateral wellbore from an offshore platform with a rotary drill bit having mud passages for passing mud into the borehole from within a steel drill string that includes at least one step of passing a slurry material through said mud passages for the purpose of completing the well and leaving the drill string in place to make a steel cased well to produce hydrocarbons from the offshore platform. As stated before, the term "slurry material" may be any one, or more, of at least the following substances: cement, gravel, water, "cement clinker", a "cement and copolymer mixture", a "blast furnace slag mixture", and/or any mixture thereof; or any known substance that flows under sufficient pressure.

Further, the above provides disclosure of a method of drilling an extended reach lateral wellbore from an offshore platform with a rotary drill bit having mud passages for passing mud into the borehole from within a steel drill string that includes at least the steps of passing sequentially in order a first slurry material and then a second slurry material through the mud passages for the purpose of completing the well and leaving the drill string in place to make a steel cased well to produce hydrocarbons from offshore platforms.

Yet another preferred embodiment of the invention provides a method of drilling an extended reach lateral wellbore from an offshore platform with a rotary drill bit having mud passages for passing mud into the borehole from within a steel drill string that includes at least the step of passing a multiplicity of slurry materials through said mud passages for the purpose of completing the well and leaving the drill string in place to make a steel cased well to produce hydrocarbons from the offshore platform.

It is evident from the disclosure in FIGS. 3 and 4, that a tubing conveyed mud motor drilling apparatus may replace the rotary drilling apparatus in FIG. 5. Consequently, the above has provided another preferred embodiment of the invention that discloses the method of drilling an extended reach lateral wellbore from an offshore platform with a coiled tubing conveyed mud motor driven rotary drill bit having mud passages for passing mud into the borehole from within the tubing that includes at least one step of passing a slurry material through the mud passages for the purpose of completing the well and leaving the tubing in place to make a tubing encased well to produce hydrocarbons from the offshore platform.

And yet further, another preferred embodiment of the invention provides a method of drilling an extended reach lateral wellbore from an offshore platform with a coiled tubing conveyed mud motor driven rotary drill bit having mud passages for passing mud into the borehole from within the tubing that includes at least the steps of passing sequentially in order a first slurry material and then a second slurry material through said mud passages for the purpose of completing the well and leaving the tubing in place to make a tubing encased well to produce hydrocarbons from the offshore platform.

And yet another preferred embodiment of the invention discloses passing a multiplicity of slurry materials through the mud passages of the tubing conveyed mud motor driven rotary drill bit to make a tubing encased well to produce hydrocarbons from the offshore platform.

For the purposes of this disclosure, any reference cited above is incorporated herein in its entirely by reference herein. Further, any document, article, or book cited in any such above defined reference is also included herein in its entirety by reference herein.

It should also be stated that the invention pertains to any type of drill bit having any conceivable type of passage way for mud that is attached to any conceivable type of drill pipe that drills to a depth in a geological formation wherein the drill bit is thereafter left at the depth when the drilling stops and the well is completed. Any type of drilling apparatus that has at least one passage way for mud that is attached to any type of drill pipe is also an embodiment of this invention, where the drilling apparatus specifically includes any type of rotary drill bit, any type of mud driven drill bit, any type of hydraulically activated drill bit, or any type of electrically energized drill bit, or any drill bit that is any combination of the above. Any type of drilling apparatus that has at least one passage way for mud that is attached to any type of casing is also an embodiment of this invention, and this includes any metallic casing, and any plastic casing. Any type of drill bit attached to any type of drill pipe made from any material, including aluminum drill pipe, any metallic drill pipe, any type of ceramic drill pipe, or any type of plastic drill pipe, is also an embodiment of this invention. Any drill bit attached to any drill pipe that remains at depth following well completion is further an embodiment of this invention, and this specifically includes any retractable type drill bit, or retrievable type drill bit, that because of failure, or choice, remains attached to the drill string when the well is completed.

As had been stated earlier, the above disclosure related to FIGS. 1–5 had been substantially repeated herein from co-pending Ser. No. 09/295,808, and that this disclosure is used so that the new preferred embodiments of the invention can be economically described in terms of those figures. The following disclosure describes FIGS. 6–18 which present preferred embodiments of the invention herein.

However before describing those new features, perhaps a bit of nomenclature should be discussed at this point. In various descriptions of preferred embodiments herein described, inventor frequently uses the designation of "one pass drilling", that is also called "One-Trip-Drilling" for the purposes herein, and otherwise also called "One-Trip-Down-Drilling" for the purposes herein. For the purposes herein, a first definition of the phrases "one pass drilling", "One-Trip-Drilling", and "One-Trip-Down-Drilling" mean the process that results in the last long piece of pipe put in the wellbore to which a drill bit is attached is left in place after total depth is reached, and is completed in place, and oil and gas is ultimately produced from within the wellbore through that long piece of pipe. Of course, other pipes, including risers, conductor pipes, surface casings, intermediate casings, etc., may be present, but the last very long pipe attached to the drill bit that reaches the final depth is left in place and the well is completed using this first definition. This process is directed at dramatically reducing the number of steps to drill and complete oil and gas wells.

Figure 6:
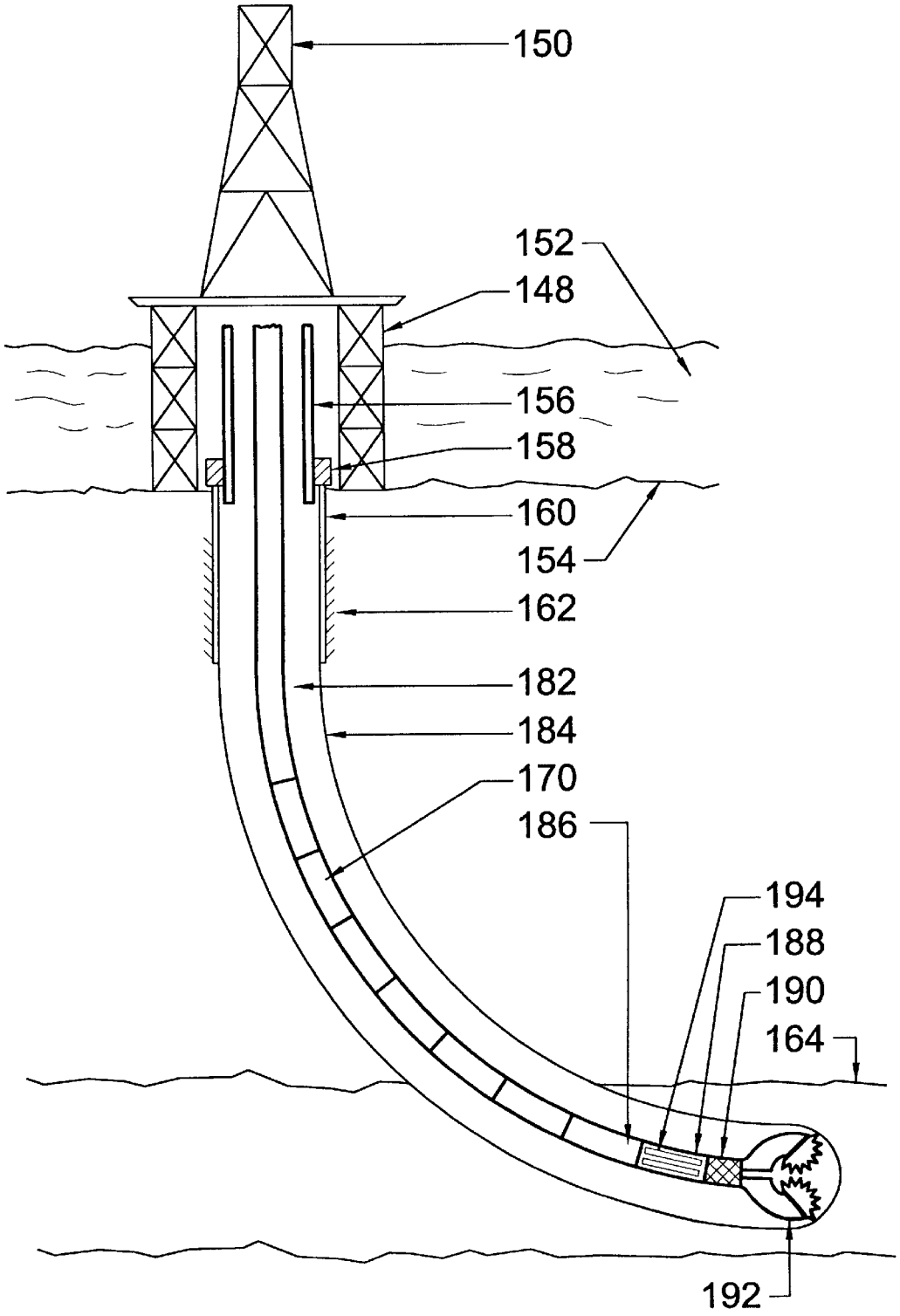
FIG. 6 shows a section view of a embodiment of the invention that is particularly configured so that Measurement-While-Drilling (MWD) and Logging-While-Drilling (LWD) can be done during rotary drilling operations with a Retrievable Instrumentation Package in place in a Smart Drilling and Completion Sub near the drill bit.

Please note that several steps in the One-Trip-Down-Drilling process had already been completed in FIG. 5. However, it is instructive to take a look at one preferred method of well completion that leads to the configuration in FIG. 5. FIG. 6 shows one of the earlier steps in that preferred embodiment of well completion that leads to the configuration in FIG. 5. Further, FIG. 6 shows an embodiment of the invention that may be used with MWD/LWD measurements as described below.

Retrievable Instrumentation Packages

FIG. 6 shows an embodiment of the invention that is particularly configured so that Measurement-While-Drilling (MWD) and Logging-While-Drilling (LWD) can be done during the drilling operations, but that following drilling operations employing MWD/LWD measurements, smart shuttles may be used thereafter to complete oil and gas production from the offshore platform using procedures and apparatus described in the following. Numerals 150 through 184 had been previously described in relation to FIG. 5. In addition in FIG. 6, the last section of standard drill pipe 186 is connected by threaded means to Smart Drilling and Completion Sub 188, that in turn is connected by threaded means to Bit Adaptor Sub 190, that is in turn connected by threaded means to rotary drill bit 192. As an option, this drill bit may be chosen by the operator to be a "Smart Bit" as described in the following.

The Smart Drilling and Completion Sub has provisions for many features. Many of these features are optional, so that some or all of them may be used during the drilling and completion of any one well. Many of those features are described in detail in U.S. Disclosure Document No. 452648 filed on Mar. 5, 1999 that has been previously recited above. In particular, that U.S. Disclosure Document discloses the utility of "Retrievable Instrumentation Packages" that is described in detail in FIGS. 7 and 7A therein. Specifically, the preferred embodiment herein provides Smart Drilling and Completion Sub 188 that in turn surrounds the Retrievable Instrumentation Package 194 as shown in FIG. 6.

As described in U.S. Disclosure Document No. 452648, to maximize the drilling distance of extended reach lateral drilling, a preferred embodiment of the invention possess the option to have means to perform measurements with sensors to sense drilling parameters, such as vibration, temperature, and lubrication flow in the drill bit—to name just a few. The sensors may be put in the drill bit 192, and if any such sensors are present, the bit is called a "Smart Bit" for the purposes herein. Suitable sensors to measure particular drilling parameters, particularly vibration, may also be placed in the Retrievable Instrumentation Package 194 in FIG. 6. So, the Retrievable Instrumentation Package 194 may have "drilling monitoring instrumentation" that is an example of "drilling monitoring instrumentation means".

Any such measured information in FIG. 6 can be transmitted to the surface. This can be done directly from the drill bit, or directly from any locations in the drill string having suitable electronic receivers and transmitters ("repeaters"). As a particular example, the measured information may be relayed from the Smart Bit to the Retrievable Instrumentation Package for final transmission to the surface. Any measured information in the Retrievable Instrumentation Package is also sent to the surface from its transmitter. As set forth in the above U.S. Disclosure Documents No. 452648, an actuator in the drill bit in certain embodiments of the invention can be controlled from the surface that is another optional feature of Smart Bit 192 in FIG. 6. If such an actuator is in the drill bit, and/or if the drill bit has any type communication means, then the bit is also called a Smart Bit for the purposes herein. As various options, commands could be sent directly to the drill bit from the surface or may be relayed from the Retrievable Instrumentation Package to the drill bit. Therefore, the Retrievable Instrumentation Package may have "drill bit control instrumentation" that is an example of "drill bit control instrumentation means" which is used to control such actuators in the drill bit.

In one preferred embodiment of the invention, commands sent to any Smart Bit to change the configuration of the drill bit to optimize drilling parameters in FIG. 6 are sent from the surface to the Retrievable Instrumentation Package using a "first communication channel" which are in turn relayed by repeater means to the rotary drill bit 192 that itself in this case is a "Smart Bit" using a "second communications channel". Any other additional commands sent from the surface to the Retrievable Instrumentation Package could also be sent in that "first communications channel". As another preferred embodiment of the invention, information sent from any Smart Bit that provides measurements during drilling to optimize drilling parameters can be sent from the Smart Bit to the Retrievable Instrumentation Package using a "third communications channel", which are in turn relayed to the surface from the Retrievable Instrumentation Package using a "fourth communication channel". Any other information measured by the Retrievable Instrumentation Package such as directional drilling information and/or information from MWD/LWD measurements would also be added to that fourth communications channel for simplicity. Ideally, the first, second, third, and fourth communications channels can send information in real time simultaneously. Means to send information includes acoustic modulation means, electromagnetic means, etc., that includes any means typically used in the industry suitably adapted to make said first, second, third, and fourth communications channels. In principle, any number of communications channels "N" can be used, all of which can be designed to function simultaneously. The above is one description of a "communications instrumentation". Therefore, the Retrievable Instrumentation Package has "communications instrumentation" that is an example of "communications instrumentation means".

In a preferred embodiment of the invention the Retrievable Instrumentation package includes a "directional assembly" meaning that it possesses means to determine precisely the depth, orientation, and all typically required information about the location of the drill bit and the drill string during drilling operations. The "directional assembly" may include accelerometers, magnetometers, gravitational measurement devices, or any other means to determine the depth, orientation, and all other information that has been obtained during typical drilling operations. In principle this directional package can be put in many locations in the drill string, but in a preferred embodiment of the invention, that information is provided by the Retrievable Instrumentation Package. Therefore, the Retrievable Instrumentation Package has a "directional measurement instrumentation" that is an example of a "directional measurement instrumentation means".

As another option, and as another preferred embodiment, and means used to control the directional drilling of the drill bit, or Smart Bit, in FIG. 6 can also be similarly incorporated in the Retrievable Instrumentation Package. Any hydraulic contacts necessary with formation can be suitably fabricated into the exterior wall of the Smart Drilling and Completion Sub 188. Therefore, the Retrievable Instrumentation Package may have "directional drilling control apparatus and instrumentation" that is an example of "directional drilling control apparatus and instrumentation means".

As an option, and as a preferred embodiment of the invention, the characteristics of the geological formation can be measured using the device in FIG. 6. In principle, MWD ("Measurement-While-Drilling") or LWD ("Logging-While-Drilling") packages can be put in the drill string at many locations. In a preferred embodiment shown in FIG. 6, the MWD and LWD electronics are made a part of the Retrievable Instrumentation Package inside the Smart Drilling and Completion Sub 188. Not shown in FIG. 6, any sensors that require external contact with the formation such as electrodes to conduct electrical current into the formation, acoustic modulator windows to let sound out of the assembly, etc., are suitably incorporated into the exterior walls of the Smart Drilling and Completion Sub. Therefore, the Retrievable Instrumentation Package may have "MWD/LWD instrumentation" that is an example of "MWD/LWD instrumentation means".

Yet further, the Retrievable Instrumentation Package may also have active vibrational control devices. In this case, the "drilling monitoring instrumentation" is used to control a feedback loop that provides a command via the "communications instrumentation" to an actuator in the Smart Bit that adjusts or changes bit parameters to optimize drilling, and avoid "chattering", etc. See the article entitled "Directional drilling performance improvement", by M. Mims, World Oil, May 1999, pages 40–43, an entire copy of which is incorporated herein. Therefore, the Retrievable Instrumentation Package may also have "active feedback control instrumentation and apparatus to optimize drilling parameters" that is an example of "active feedback and control instrumentation and apparatus means to optimize drilling parameters".

Therefore, the Retrieval Instrumentation Package in the Smart Drilling and Completion Sub in FIG. 6 may have one or more of the following elements:

(a) mechanical means to pass mud through the body of 188 to the drill bit;

(b) retrieving means, including latching means, to accept and align the Retrievable Instrumentation Package within the Smart Drilling and Completion Sub;

(c) "drilling monitoring instrumentation" or "drilling monitoring instrumentation means";

(d) "drill bit control instrumentation" or "drill bit control instrumentation means";

(e) "communications instrumentation" or "communications instrumentation means";

(f) "directional measurement instrumentation" or "directional measurement instrumentation means";

(g) "directional drilling control apparatus and instrumentation" or "directional drilling control apparatus and instrumentation means";

(h) "MWD/LWD instrumentation" or "MWD/LWD instrumentation means";

(i) "active feedback and control instrumentation and apparatus to optimize drilling parameters" or "active feedback and control instrumentation and apparatus means to optimize drilling parameters";

(j) an on-board power source in the Retrievable Instrumentation Package or "on-board power source means in the Retrievable Instrumentation Package";

(k) an on-board mud-generator as is used in the industry to provide energy to (j) above or "mud-generator means".

(l) batteries as are used in the industry to provide energy to (j) above or "battery means";

For the purposes of this invention, any apparatus having one or more of the above features (a), (b) , . . . , (j), (k), or (l), AND which can also be removed from the Smart Drilling and Completion Sub as described below in relation to FIG. 7, shall be defined herein as a Retrievable Instrumentation Package.

Figure 7:
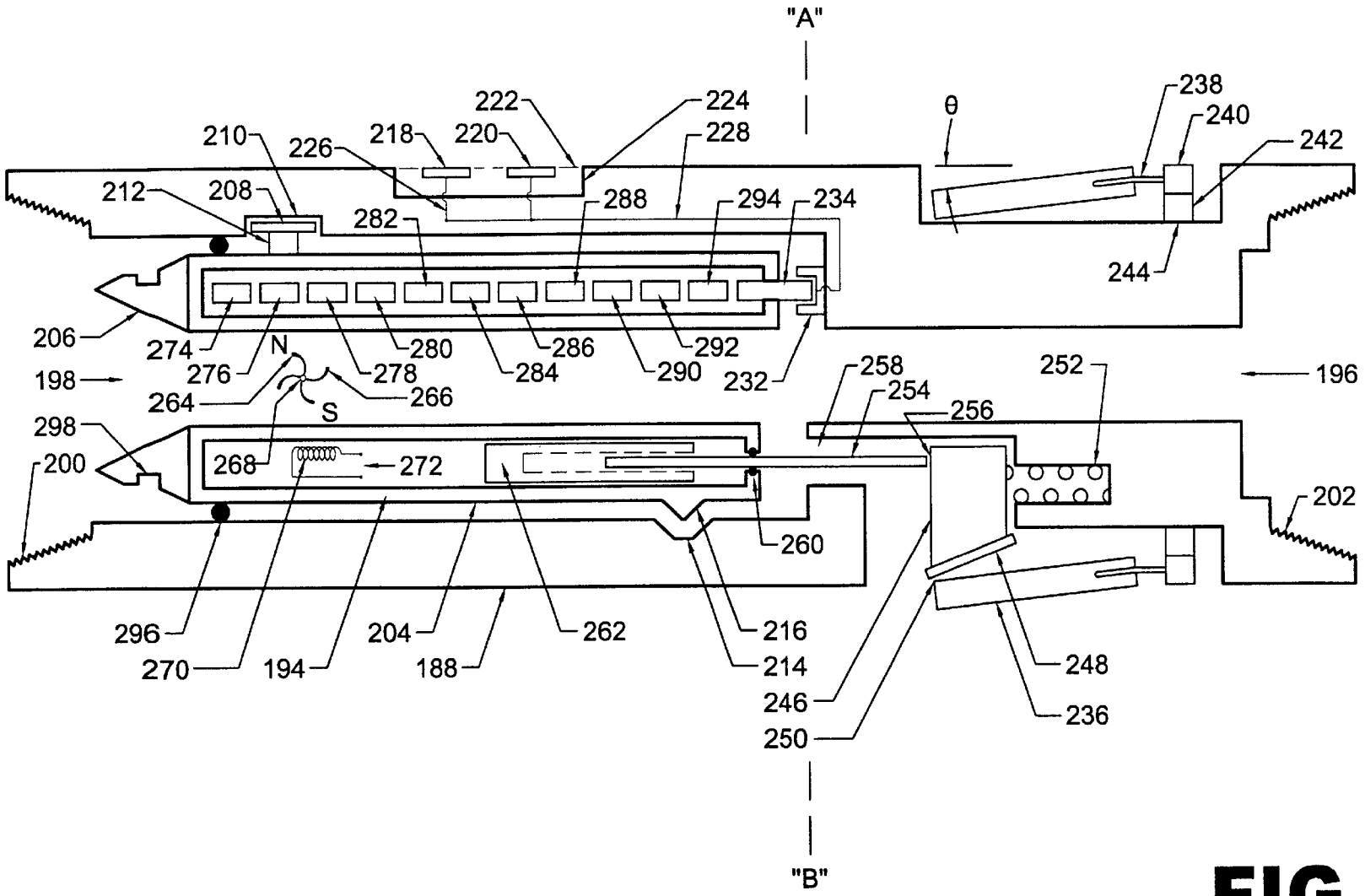
FIG. 7 shows a section view of the Retrievable Instrumentation Package and the Smart Drilling and Completion Sub that also has directional drilling control apparatus and instrumentation.

FIG. 7 shows a preferred embodiment of the invention that is explicitly configured so that following drilling operations that employ MWD/LWD measurements of formation properties during those drilling operations, smart shuttles may be used thereafter to complete oil and gas production from the offshore platform. As in FIG. 6, Smart Drilling and Completion Sub 188 has disposed inside it Retrievable Instrumentation Package 194. The Smart Drilling and Completion Sub has mud passage 196 through it. The Retrievable Instrumentation Package has mud passage 198 through it. The Smart Drilling and Completion Sub has upper threads 200 that engage the last section of standard drill pipe 186 in FIG. 6. The Smart Drilling and Completion Sub has lower threads 202 that engage the upper threads of the Bit Adaptor Sub 190 in FIG. 6.

In FIG. 7, the Retrievable Instrumentation Package has high pressure walls 204 so that the instrumentation in the package is not damaged by pressure in the wellbore. It has an inner payload radius r1, an outer payload radius r2, and overall payload length L that are not shown for the purposes of brevity. The Retrievable Instrumentation Package has retrievable means 206 that allows a wireline conveyed device from the surface to "lock on" and retrieve the Retrievable Instrumentation Package. Element 206 is the "Retrieval Means Attached to the Retrievable Instrumentation Package".

As shown in FIG. 7, the Retrievable Instrumentation Package may have latching means 208 that is disposed in latch recession 210 that is actuated by latch actuator means 212. The latching means 208 and latch recession 210 may function as described above in previous embodiments or they may be electronically controlled as required from inside the Retrievable Instrumentation Package.

Guide recession 214 in the Smart Drilling and Completion Sub is used to guide into place the Retrievable Instrumentation Package having alignment spur 216. These elements are used to guide the Retrievable Instrumentation Package into place and for other purposes as described below. These are examples of "alignment means".

Acoustic transmitter/receiver 218 and current conducting electrode 220 are used to measure various geological parameters as is typical in the MWD/LWD art in the industry, and they are "potted" in insulating rubber-like compounds 222 in the wall recession 224 shown in FIG. 7. Power and signals for acoustic transmitter/receiver 218 and current conducting electrode 220 are sent over insulated wire bundles 226 and 228 to mating electrical connectors 232 and 234. Electrical connector 234 is a high pressure connector that provides power to the MWD/LWD sensors and brings their signals into the pressure free chamber within the Retrievable Instrumentation Package as are typically used in the industry. Geometric plane "A" "B" is defined by those legends appearing in FIG. 7 for reasons which will be explained later.

A first directional drilling control apparatus and instrumentation is shown in FIG. 7. Cylindrical drilling guide 236 is attached by flexible spring coupling device 238 to moving bearing 240 having fixed bearing race 242 that is anchored to the housing of the Smart Drilling and Completion Sub near the location specified by the numeral 244. Sliding block 246 has bearing 248 that makes contact with the inner portion of the cylindrical drilling guide at the location specified by numeral 250 that in turn sets the angle θ. The cylindrical drilling guide 236 is free to spin when it is in physical contact with the geological formation. So, during rotary drilling, the cylindrical drilling guide spins about the axis of the Smart Drilling and Completion Sub that in turn rotates with the remainder of the drill string. The angle θ determines the direction of drilling in the plane defined by the section view shown in FIG. 7. Sliding block 246 is spring loaded with spring 252 in one direction (to the left in FIG. 7) and is acted upon by piston 254 in the opposite direction (to the right as shown in FIG. 7). Piston 254 makes contact with the sliding block at the position designated by numeral 256 in FIG. 7. Piston 254 passes through bore 258 in the body of the Smart Drilling and Completion Sub and enters the Retrievable Instrumentation Package through o-ring 260. Hydraulic piston actuator assembly 262 actuates the hydraulic piston 254 under electronic control from instrumentation within the Retrievable Instrumentation Package as described below. The position of the cylindrical drilling guide 236 and its angle θ is held stable in the two dimensional plane specified in FIG. 7 by two competing forces described as (a) and (b) in the following: (a) the contact between the inner portion of the cylindrical drilling guide 236 and the bearing 248 at the location specified by numeral 250; and (c) the net "return force" generated by the flexible spring coupling device 238. The return force generated by the flexible spring coupling device is zero only when the cylindrical drilling guide 236 is parallel to the body of the Smart Drilling and Completion Sub.

There is a second such directional drilling control apparatus located rotationally 90 degrees from the first apparatus shown in FIG. 7 so that the drill bit can be properly guided in all directions for directional drilling purposes. However, this second assembly is not shown in FIG. 7 for the purposes of brevity. This second assembly sets the angle β in analogy to the angle θ defined above.

For a general review of the status of developments on directional drilling control systems in the industry, please refer to the following references: (a) the article entitled "ROTARY-STEERABLE TECHNOLOGY—Part 1, Technology gains momentum", by T. Warren, Oil and Gas Journal, Dec. 21, 1998, pages 101–105, an entire copy of which is incorporated herein by reference; and (b) the article entitled "ROTARY-STEERABLE TECHNOLOGY—Conclusion, Implementation issues concern operators", by T. Warren, Oil and Gas Journal, Dec. 28, 1998, pages 80–83, an entire copy of which is incorporated herein by reference. Furthermore, all references cited in the articles defined as (a) and (b) in this paragraph are also incorporated herein in their entirety by reference. Specifically, all 17 references cited on page 105 of the article defined in (a) and all 3 references cited on page 83 of the article defined in (b) are incorporated herein by reference.

FIG. 7 also shows a mud-motor electrical generator. The mud-motor generator is only shown FIGURATIVELY in FIG. 7. This mud-motor electrical generator is incorporated within the Retrievable Instrumentation Package so that the mud-motor electrical generator is substantially removed when the Retrievable Instrumentation Package is removed from the Smart Drilling and Completion Sub. Such a design can be implemented using a split-generator design, where a permanent magnet is turned by mud flow, and pick-up coils inside the Retrievable Instrumentation Package are used to sense the changing magnetic field resulting in a voltage and current being generated. Such a design does not necessarily, need high pressure seals for turning shafts of the mud-motor electrical generator itself. To figuratively show a preferred embodiment of the mud-motor electrical generator in FIG. 7, element 264 is a permanently magnetized turbine blade having magnetic polarity N and S as shown. Element 266 is another such permanently magnetized turbine blade having similar magnetic polarity, but the N and S is not marked on element 266 in FIG. 7. These two turbine blades spin about a bearing at the position designated by numeral 268 where the two turbine blades cross in FIG. 7. The details for the support of that shaft are not shown in FIG. 7 for the purposes of brevity. The mud flowing through the mud passage 198 of the Retrievable Instrumentation Package causes the magnetized turbine blades to spin about the bearing at position 268. A pick-up coil mounted on magnetic bar material designated by numeral 270 senses the changing magnetic field caused by the spinning magnetized turbine blades and produces electrical output 272 that in turn provides time varying voltage V(t) and time varying current I(t) to yet other electronic described below that is used to convert these waveforms into usable power as is required by the Retrievable Instrumentation Package. The changing magnetic field penetrates the high pressure walls 204 of the Retrievable Instrumentation Package. For the figurative embodiment of the mud-motor electrical generator shown in FIG. 7, non-magnetic steel walls are probably better to use than walls made of magnetic materials. Therefore, the Retrievable Instrumentation Package and the Smart Drilling and Completion Sub may have a mud-motor electrical generator for the purposes herein.

The following block diagram elements are also shown in FIG. 7: element 274, the electronic instrumentation to sense, accept, and align (or release) the "Retrieval Means Attached to the Retrievable Instrumentation Package" and to control the latch actuator means 212 during acceptance (or release); element 276, "power source" such as batteries and/or electronics to accept power from mud-motor electrical generator system and to generate and provide power as required to the remaining electronics and instrumentation in the Retrievable Instrumentation Package; element 278, "downhole computer" controlling various instrumentation and sensors that includes downhole computer apparatus that may include processors, software, volatile memories, non-volatile memories, data buses, analogue to digital converters as required, input/output devices as required, controllers, battery back-ups, etc.; element 280, "communications instrumentation" as defined above; element 282, "directional measurement instrumentation" as defined above; element 284, "drilling monitoring instrumentation" as defined above; element 286, "directional drilling control apparatus and instrumentation" as defined above; element 288, "active feedback and control instrumentation to optimize drilling parameters", as defined above; element 290, general purpose electronics and logic to make the system function properly including timing electronics, driver electronics, computer interfacing, computer programs, processors, etc.; element 292, reserved for later use herein; and element 294 "MWD/LWD instrumentation", as defined above.

FIG. 7 also shows optional mud seal 296 on the outer portion of the Retrievable Instrumentation Package that prevents drilling mud from flowing around the outer portion of that Package. Most of the drilling mud as shown in FIG. 7 flows through mud passages 196 and 198. Mud seal 296 is shown figuratively only in FIG. 7, and may be a circular mud ring, but any type of mud sealing element may be used, including the designs of elastomeric mud sealing elements normally associated with wiper plugs as described above and as used in the industry for a variety of purposes.

It should be evident that the functions attributed to the single Smart Drilling and Completion Sub 188 and Retrievable Instrumentation Package 194 may be arbitrarily assigned to any number of different subs and different pressure housings as is typical in the industry. However, "breaking up" the Smart Drilling and Completion Sub and the Retrievable Instrumentation Package are only minor variations of the preferred embodiment described herein.

Perhaps it is also worth noting that a primary reason for inventing the Retrievable Instrumentation Package 194 is because in the event of One-Trip-Down-Drilling, then the drill bit and the Smart Drilling and Completion Sub are left in the wellbore to save the time and effort to bring out the drill pipe and replace it with casing. However, if the MWD/LWD instrumentation is used as in FIG. 7, the electronics involved is often considered too expensive to abandon in the wellbore. Further, major portions of the directional drilling control apparatus and instrumentation and the mud-motor electrical generator are also relatively expensive, and those portions often need to be removed to minimize costs. Therefore, the Retrievable Instrumentation Package 194 is retrieved from the wellbore before the well is thereafter completed to produce hydrocarbons.

The preferred embodiment of the invention in FIG. 7 has one particular virtue that is of considerable value. When the Retrievable Instrumentation Package 194 is pulled to the left with the Retrieval Means Attached to the Retrievable Instrumentation Package 194, then mating connectors 232 and 234 disengage, and piston 254 is withdrawn through the bore 258 in the body of the Smart Drilling and Completion Sub. The piston 254 had made contact with the sliding block 246 at the location specified by numeral 256, and when the Retrievable Instrumentation Package 194 is withdrawn, the piston 254 is free to be removed from the body of the Smart Drilling and Completion Sub. The Retrievable Instrumentation Package "splits" from the Smart Drilling and Completion Sub approximately along plane "A" "B" defined in FIG. 7. In this way, most of the important and expensive electronics and instrumentation can be removed after the desired depth is reached. With suitable designs of the directional drilling control apparatus and instrumentation, and with suitable designs of the mud-motor electrical generator, the most expensive portions of these components can be removed with the Retrievable Instrumentation Package.

The preferred embodiment in FIG. 7 has yet another important virtue. If there is any failure of the Retrievable Instrumentation Package before the desired depth has been reached, it can be replaced with another unit from the surface without removing the pipe from the well using methods to be described in the following. This feature would save considerable time and money that is required to "trip out" a standard drill string to replace the functional features of the instrumentation now in the Retrievable Instrumentation Package.

In any event, after the total depth is reached in FIG. 6, and if the Retrievable Instrumentation Package had MWD and LWD measurement packages as described in FIG. 7, then it is evident that sufficient geological information is available vs. depth to complete the well and to commence hydrocarbon production. Then, the Retrievable Instrumentation Package can be removed from the pipe using techniques to be described in the following.

It should also be noted that in the event that the wellbore had been drilled to the desired depth, but on the other hand, the MWD and LWD information had NOT been obtained from the Retrievable Instrumentation Package during that drilling, and following its removal from the pipe, that measurements of the required geological formation properties can still be obtained from within the steel pipe using the logging techniques described above under the topic of "Several Recent Changes in the Industry"—and please refer to item (b) under this category. Logging through steel pipes and logging through casings to obtain the required geophysical information are now possible.

In any event, let us assume that at this point in the One-Trip-Down-Drilling Process that the following is the situation: (a) the wellbore has been drilled to final depth; and (b) the configuration is as shown in FIG. 6 with the Retrievable Instrumentation Package at depth; and that (c) complete geophysical information has been obtained with the Retrievable Instrumentation Package.

As described earlier in relation to FIG. 7, the Retrievable Instrumentation Package has retrieval means 206 that allows a wireline conveyed device operated from the surface to "lock on" and retrieve the Retrievable Instrumentation Package. Element 206 is the "Retrieval Means Attached to the Retrievable Instrumentation Package" in FIG. 7. As one form of the preferred embodiment shown in FIG. 7, element 206 may have retrieval grove 298 that will assist the wireline conveyed device from the surface to "lock on" and retrieve the Retrievable Instrumentation Package.

Smart Shuttles

Figure 8:
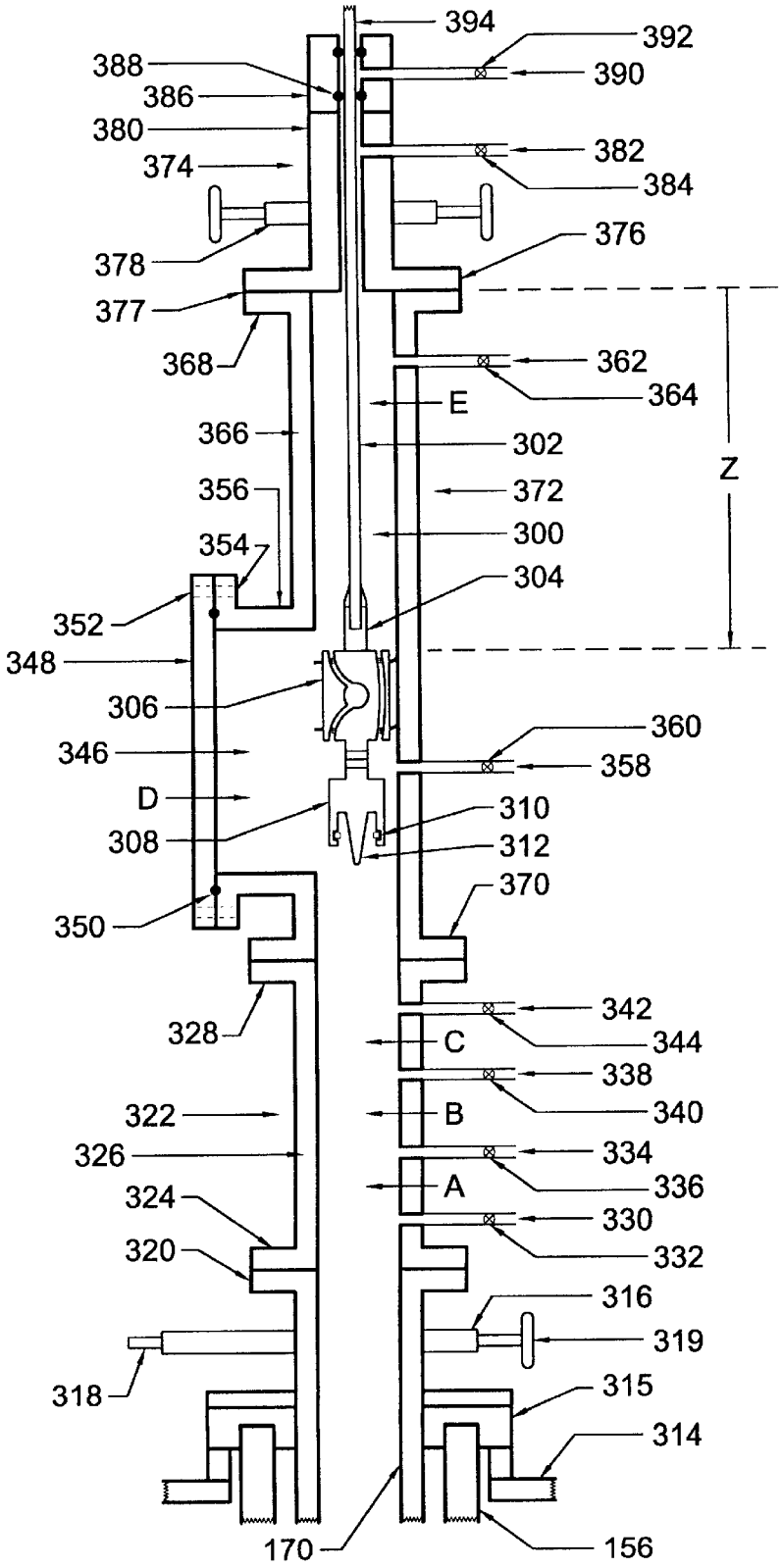
FIG. 8 shows a section view of the wellhead, the Wiper Plug Pump-Down Stack, the Smart Shuttle Chamber, the Wireline Lubricator System, the Smart Shuttle and the Retrieval Sub suspended by the wireline.

FIG. 8 shows an example of such a wireline conveyed device operated from the surface of the earth used to retrieve devices within the steel drill pipe that is generally designated by numeral 300. A wireline 302, typically having 7 electrical conductors with an armor exterior, is attached to the cablehead, generally labeled with numeral 304 in FIG. 8. Such wirelines may be obtained commercially from Camesa, Inc. of Rosenburg, Tex.; from the Rochester Corporation of Culpeper, Va.; and from Cablesa, Inc. of Houston, Tex. U.S. Pat. No. 4,009,561 shows typical methods to manufacture such wirelines, and U.S. Pat. No. 4,909,741 shows detailed methods for attaching such wirelines to cableheads. Cablehead 304 is in turn attached to the Smart Shuttle that is generally shown as numeral 306 in FIG. 8, which in turn is connected to an attachment. In this case, the attachment is the "Retrieval & Installation Subassembly", otherwise abbreviated as the "Retrieval/Installation Sub", also simply abbreviated as the "Retrieval Sub", and it is generally shown as numeral 308 in FIG. 8. The Smart Shuttle is used for a number of different purposes, but in the case of FIG. 8, and in the sequence of events described in relation to FIGS. 6 and 7, it is now appropriate to retrieve the Retrievable Instrumentation Package installed in the drill string as shown in FIGS. 6 and 7. To that end, please note that electronically controllable retrieval snap ring assembly 310 is designed to snap into the retrieval grove 298 of element 206 when the mating nose 312 of the Retrieval Sub enters mud passage 198 of the Retrievable Instrumentation Package. Mating nose 312 of the Retrieval Sub also has retrieval sub electrical connector 313 (not shown in FIG. 8) that provides electrical commands and electrical power received from the wireline and from the Smart Shuttle as is appropriate. (For the record, the retrieval sub electrical connector 313 is not shown explicitly in FIG. 8 because the scale of that drawing is too large, but electrical connector 313 is explicitly shown in FIG. 9 where the scale is appropriate.)

FIG. 8 shows a portion of an entire system to automatically complete oil and gas wells. This system is called the "Automated Smart Shuttle Oil and Gas Completion System", or also abbreviated as the "Automated Smart Shuttle System", or the "Smart Shuttle Oil and Gas Completion System". In FIG. 8, the floor of the offshore platform 314 is attached to riser 156 having riser hanger apparatus 315 as is typically used in the industry. The drill string 170 is composed of many lengths of drill pipe and a first blow-out preventer 316 is suitably installed on an upper section of the drill pipe using typical art in the industry. This first blow-out preventer 316 has automatic shut off apparatus 318 and manual back-up apparatus 319 as is typical in the industry. A top drill pipe flange 320 is installed on the top of the drill string.

The "Wiper Plug Pump-Down Stack" is generally shown as numeral 322 in FIG. 8. The reason for the name for this assembly will become clear in the following. "Wiper Plug Pump-Down Stack" 322 is comprised various elements including the following: lower pump-down stack flange 324, cylindrical steel pipe wall 326, upper pump-down stack flange 328, first inlet tube 330 with first inlet tube valve 332, second inlet tube 334 with second inlet tube valve 336, third inlet tube 338 with third inlet tube valve 340, with primary injector tube 342 with primary injector tube valve 344. Particular regions within the "Wiper Plug Pump-Down Stack" are identified respectively with legends A, B and C that are shown in FIG. 8. Bolts and bolt patterns for the lower pump-down stack flange 324, and its mating part that is top drill pipe flange 320, are not shown for simplicity. Bolts and bolt patterns for the upper pump down stack flange 328, and its respective mating part to be describe in the following, are also not shown for simplicity. In general in FIG. 8, flanges may have bolts and bolt patterns, but those are not necessarily shown for the purposes of simplicity.

The "Smart Shuttle Chamber" 346 is generally shown in FIG. 8. Smart shuttle chamber door 348 is pressure sealed with a one-piece O-ring identified with the numeral 350. That O-ring is in a standard O-ring grove as is used in the industry. Bolt hole 352 through the smart shuttle chamber door mates with mounting bolt hole 354 on the mating flange body 356 of the Smart Shuttle Chamber. Tightened bolts will firmly hold the smart shuttle chamber door 348 against the mating flange body 356 that will suitably compress the one-piece O-ring 350 to cause the Smart Shuttle Chamber to seal off any well pressure inside the Smart Shuttle Chamber.

Smart Shuttle Chamber 346 also has first smart shuttle chamber inlet tube 358 and first smart shuttle chamber inlet tube valve 360. Smart Shuttle Chamber 346 also has second smart shuttle chamber inlet tube 362 and second smart shuttle chamber inlet tube valve 364. Smart Shuttle Chamber 346 has upper smart shuttle chamber cylindrical wall 366 and upper smart shuttle chamber flange 368 as shown in FIG. 8. The Smart Shuttle Chamber 346 has two general regions identified with the legends D and E in FIG. 8. Region D is the accessible region where accessories may be attached or removed from the Smart Shuttle, and region E has a cylindrical geometry below second smart shuttle chamber inlet tube 362. The Smart Shuttle and its attachments can be "pulled up" into region E from region D for various purposes to be described later. Smart Shuttle Chamber 346 is attached by the lower smart shuttle flange 370 to upper pump-down stack flange 328. The entire assembly from the lower smart shuttle flange 370 to the upper smart shuttle chamber flange 368 is called the "Smart Shuttle Chamber System" that is generally designated with the numeral 372 in FIG. 8. The Smart Shuttle Chamber System 372 includes the Smart Shuttle Chamber itself that is numeral 346 which is also referred to as region D in FIG. 8.

The "Wireline Lubricator System" 374 is also generally shown in FIG. 8. Bottom flange of wireline lubricator system 376 is designed to mate to upper smart shuttle chamber flange 368. These two flanges join at the position marked by numeral 377. In FIG. 8, the legend Z shows the depth from this position 377 to the top of the Smart Shuttle. Measurement of this depth Z, and knowledge of the length L1 of the Smart Shuttle (not shown in FIG. 8 for simplicity), and the length L2 of the Retrieval Sub (not shown in FIG. 8 for simplicity), and all other pertinent lengths L3, L4 , . . . , of any apparatus in the wellbore, allows the calculation of the "depth to any particular element in the wellbore" using standard art in the industry.

The Wireline Lubricator System in FIG. 8 has various additional features, including a second blow-out preventer 378, lubricator top body 380, fluid control pipe 382 and its fluid control valve 384, a hydraulic packing gland generally designated by numeral 386 in FIG. 8, having gland sealing apparatus 388, grease packing pipe 390 and grease packing valve 392. Typical art in the industry is used to fabricate and operate the Wireline Lubricator System, and for additional information on such systems, please refer to FIG. 9, page 11, of Lesson 4, entitled "Well Completion Methods", of series entitled "Lessons in Well Servicing and Workover", published by the Petroleum Extension Service of The University of Texas at Austin, Austin, Tex., 1971, that is incorporated herein by reference in its entirety, which series was previously referred to above as "Ref. 2". In FIG. 8, the upper portion of the wireline 394 proceeds to sheaves as are used in the industry and to a wireline drum under computer control as described in the following. However, at this point, it is necessary to further describe relevant attributes of the Smart Shuttle.

Figure 9:
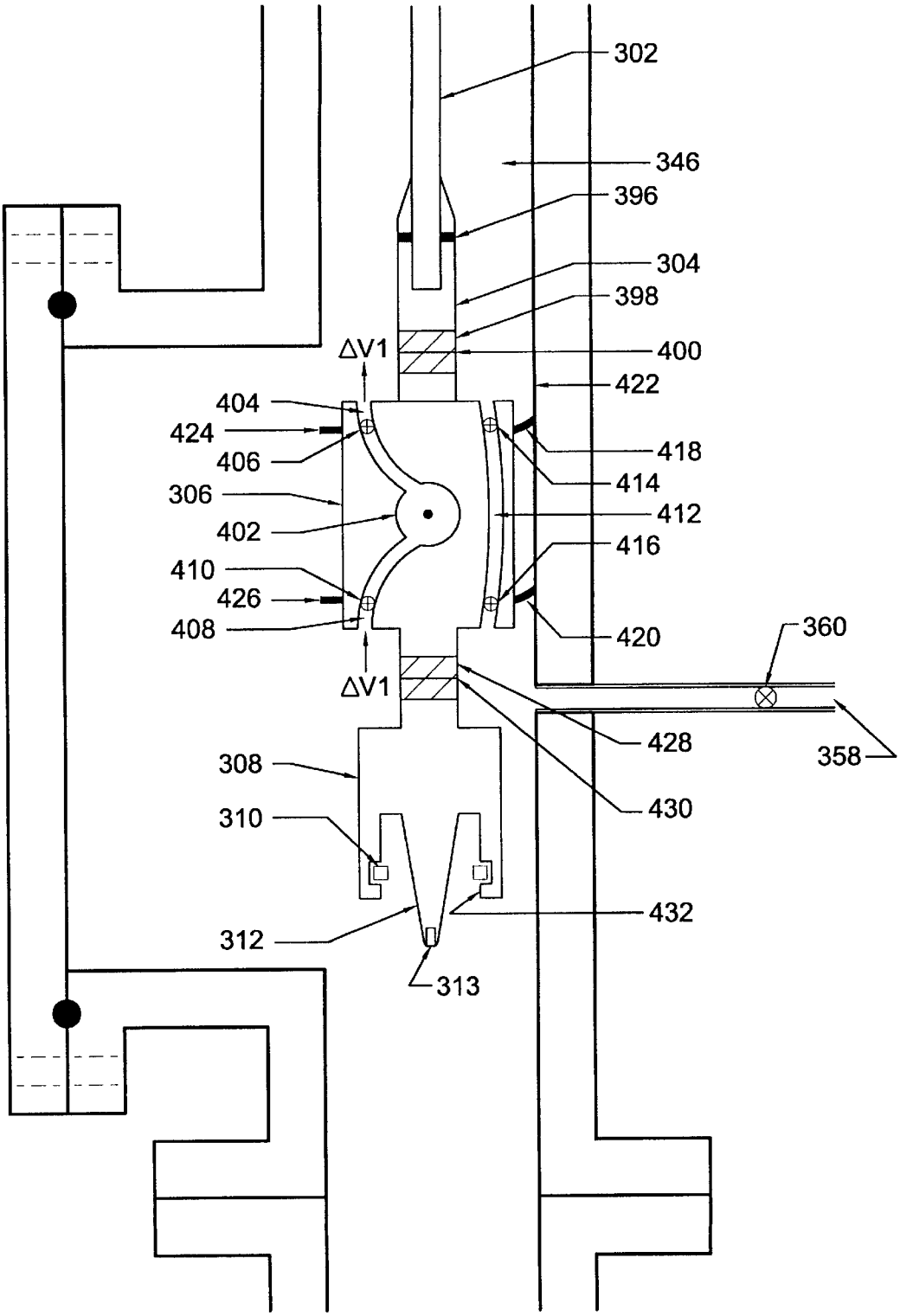
FIG. 9 shows a section view in detail of the Smart Shuttle and the Retrieval Sub while located in the Smart Shuttle Chamber.

FIG. 9 shows an enlarged view of the Smart Shuttle 306 and the "Retrieval Sub" 308 that are attached to the cablehead 304 suspended by wireline 302. The cablehead has shear pins 396 as are typical in the industry. A threaded quick change collar 398 causes the mating surfaces of the cablehead and the Smart Shuttle to join together at the location specified by numeral 400. Typically 7 insulated electrical conductors are passed through the location specified by numeral 400 by suitable connectors and O-rings as are used in the industry. Several of these wires will supply the needed electrical energy to run the electrically operated pump in the Smart Shuttle and other devices as described below.

In FIG. 9, a particular embodiment of the Smart Shuttle is described which, in this case, has an electrically operated internal pump, and this pump is called the "internal pump of the smart shuttle" that is designated by numeral 402. Numeral 402 designates an "internal pump means". The upper inlet port 404 for the pump has electronically controlled upper port valve 406. The lower inlet port 408 for the pump has electronically controlled lower port valve 410. Also shown in FIG. 9 is the bypass tube 412 having upper bypass tube valve 414 and lower bypass tube valve 416. In a preferred embodiment of the invention, the electrically operated internal pump 402 is a "positive displacement pump". For such a pump, and if valves 406 and 410 are open, then during any one specified time interval $\Delta t$, a specific volume of fluid $\Delta V1$ is pumped from below the Smart Shuttle to above the Smart Shuttle through inlets 404 and 410 as they are shown in FIG. 9. For further reference, the "down side" of the Smart Shuttle in FIG. 9 is the "first side" of the Smart Shuttle and the "up side" of the Smart Shuttle in FIG. 9 is the "second side" of the Smart Shuttle. Such up and down designations loose their meaning when the wellbore is substantially a horizontal wellbore where the Smart Shuttle will have great utility. Please refer to the legends $\Delta V1$ on FIG. 9. This volume $\Delta V1$ relates to the movement of the Smart Shuttle as described later below.

In FIG. 9, the Smart Shuttle also has elastomer sealing elements. The elastomer sealing elements on the right-hand side of FIG. 9 are labeled as elements 418 and 420. These elements are shown in a flexed state which are mechanically loaded against the right-hand interior cylindrical wall 422 of the Smart Shuttle Chamber 346 by the hanging weight of the Smart Shuttle and related components. The elastomer sealing elements on the left-hand side of FIG. 9 are labeled as elements 424 and 426, and are shown in a relaxed state (horizontal) because they are not in contact with any portion of a cylindrical wall of the Smart Shuttle Chamber. These elastomer sealing elements are examples of "lateral sealing means" of the Smart Shuttle. In the preferred embodiment shown in FIG. 9, it is contemplated that the right-hand element 418 and the left-hand element 424 are portions of one single elastomeric seal. It is further contemplated that the right-hand element 420 and the left-hand element 426 are portions of yet another separate elastomeric seal. Many different seals are possible, and these are examples of "sealing means" associated with the Smart Shuttle.

FIG. 9 further shows quick change collar 428 causes the mating surfaces of the lower portion of the Smart Shuttle to join together to the upper mating surfaces of the Retrieval Sub at the location specified by numeral 430. Typically, 7 insulated electrical conductors are also passed through the location specified by numeral 430 by suitable mating electrical connectors as are typically used in the industry. Therefore, power, control signals, and measurements can be relayed from the Smart Shuttle to the Retrieval Sub and from the Retrieval Sub to the Smart Shuttle by suitable mating electrical connectors at the location specified by numeral 430. To be thorough, it is probably worthwhile to note here that numeral 431 is reserved to figuratively designate the top electrical connector of the Retrieval Sub, although that connector 431 is not shown in FIG. 9 for the purposes of simplicity. The position of the electronically controllable retrieval snap ring assembly 310 is controlled by signals from the Smart Shuttle. With no signal, the snap ring of assembly 310 is spring-loaded into the position shown in FIG. 9. With a "release command" issued from the surface, electronically controllable retrieval snap ring assembly 310 is retracted so that it does NOT protrude outside vertical surface 432 (i.e., snap ring assembly 310 is in its full retracted position). Therefore, electronic signals from the surface are used to control the electronically controllable retrieval snap ring assembly 310, and it may be commanded from the surface to "release" whatever this assembly had been attached. In particular, once suitably aligned, assembly 310 may be commanded to "engage" or "lock-on" retrieval grove 298 in the Retrievable Instrumentation Package 206, or it can be commanded to "release" or "pull back from" the retrieval grove 298 in the Retrievable Instrumentation Package as may be required during deployment or retrieval of that Package, as the case may be.

One method of operating the Smart Shuttle is as follows. With reference to FIG. 8, the first smart shuttle chamber inlet tube valve 360 in its open position, fluids, such as water or drilling mud as required, are introduced into the first smart shuttle chamber inlet tube 358. With second smart shuttle chamber inlet tube valve 364 in its open position, then the injected fluids are allowed to escape through second smart shuttle chamber inlet tube 362 until substantially all the air in the system has been removed. In a preferred embodiment, the internal pump of the smart shuttle 402 is a self-priming pump, so that even if any air remains, the pump will still pump fluid from below the Smart Shuttle to above the Smart Shuttle. Similarly, inlets 330, 334, 338, and 342, with their associated valves, can also be used to "bleed the system" to get rid of trapped air using typical procedures often associated with hydraulic systems. With reference to FIG. 9, it would further help the situation if valves 406, 410, 414 and 416 in the Smart Shuttle were all open simultaneously during "bleeding operations", although this may not be necessary. The point is that using typical techniques in the industry, the entire volume within the regions A, B, C, D, and E within the interior of the apparatus in FIG. 8 can be fluid filled with fluids such as drilling mud, water, etc. This state of affairs is called the "priming" of the Automated Smart Shuttle System in this preferred embodiment of the invention.

Figure 10:
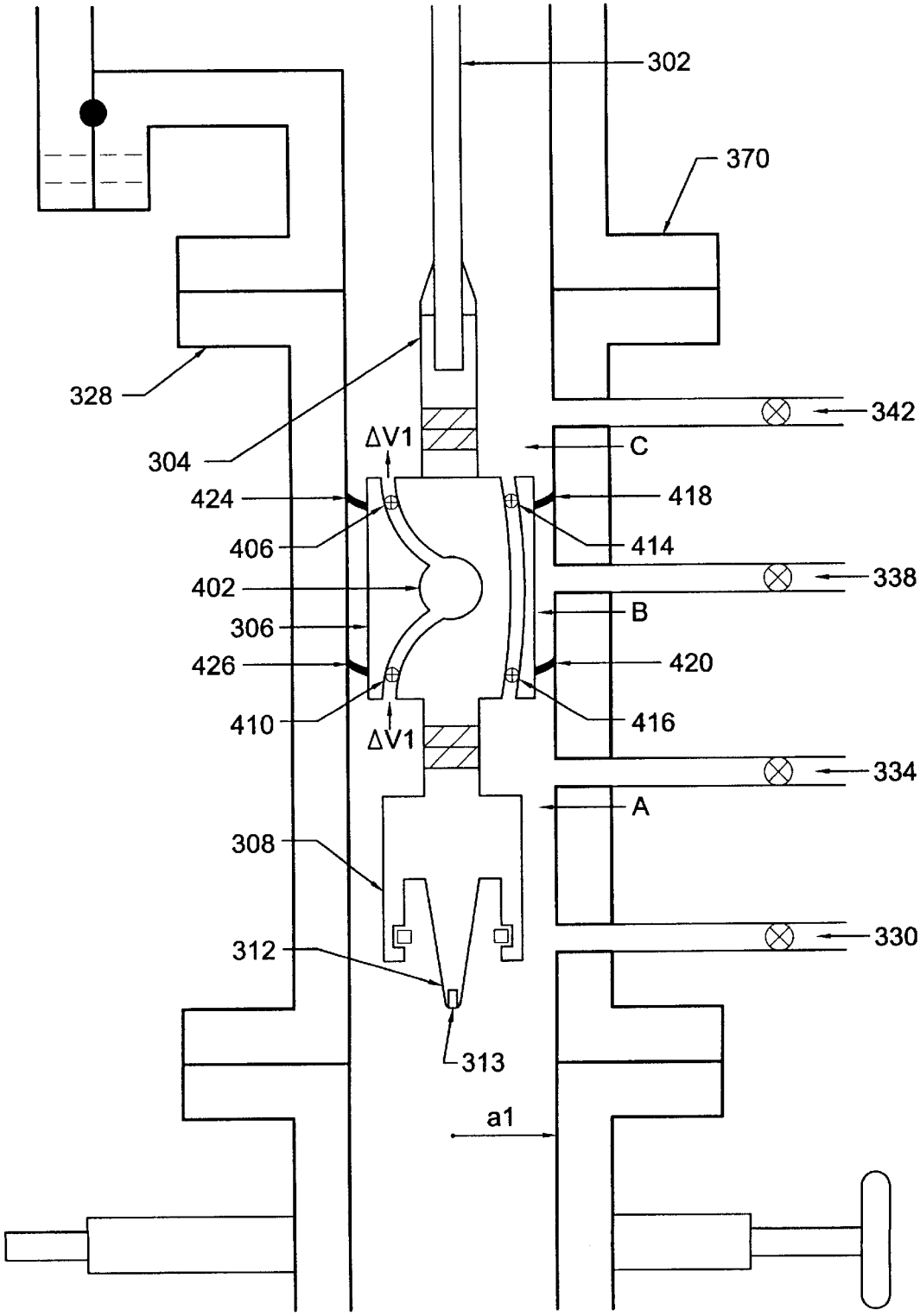
FIG. 10 shows a section view of the Smart Shuttle and the Retrieval Sub in a position where the elastomer sealing elements of the Smart Shuttle have sealed against the interior of the pipe, and the internal pump of the smart shuttle is ready to pump fluid volumes $\Delta V1$ from below the Smart Shuttle to above it so that the Smart Shuttle translates downhole.

After the Automated Smart Shuttle System is primed, then the wireline drum is operated to allow the Smart Shuttle and the Retrieval Sub to be lowered from region D of FIG. 8 to the part of the system that includes regions A, B, and C. FIG. 10 shows the Smart Shuttle and Retrieval Sub in that location.

In FIG. 10, all the numerals and legends in FIG. 10 have been previously defined. When the Smart Shuttle and the Retrieval Sub are located in regions A, B, and C, then the elastomer sealing elements 418, 420, 424, and 426 positively seal against the cylindrical walls of the now fluid filled enclosure. Please notice the change in shape of the elastomer sealing elements 424 and 426 in FIG. 9 and in FIG. 10. The reason for this change is because the regions A, B, and C are bounded by cylindrical metal surfaces with intervening pipes such as inlet tubes 330, 334, 338, and primary injector tube 342. In a preferred embodiment of the invention, the vertical distance between elastomeric units 418 and 420 are chosen so that they do simultaneously overlap any two inlet pipes to avoid loss a positive seal along the vertical extent of the Smart Shuttle.

Then, in FIG. 10, valves 414 and 416 are closed, and valves 406 and 410 are opened. Thereafter, the electrically operated internal pump 402 is turned "on". In a preferred embodiment of the invention, the electrically operated internal pump is a "positive displacement pump". For such a pump, and as had been previously described, during any one specified time interval $\Delta t$, a specific volume of fluid $\Delta V1$ is pumped from below the Smart Shuttle to above the Smart Shuttle through valves 406 and 410. Please refer to the legends $\Delta V1$ on FIG. 10. In FIG. 10, The top of the Smart Shuttle is at depth Z, and that legend was defined in FIG. 8 in relation to position 377 in that figure. In FIG. 10, the inside radius of the cylindrical portion of the wellbore is defined by the legend a1. However, first it is perhaps useful to describe several different embodiments of Smart Shuttles and associated Retrieval Subs.

Element 306 in FIG. 8 is the "Smart Shuttle". This apparatus is "smart" because the "Smart Shuttle" has one or more of the following features (hereinafter, "List of Smart Shuttle Features"):

(a) it provides depth measurement information, ie., it has "depth measurement means"

(b) it provides orientation information within the metallic pipe, drill string, or casing, whatever is appropriate, including the angle with respect to vertical, and any azimuthal angle in the pipe as required, and any other orientational information required, ie., it has "orientational information measurement means"

(c) it possesses at least one power source, such as a battery, or apparatus to convert electrical energy from the wireline to power any sensors, electronics, computers, or actuators as required, ie., it has "power source means"

(d) it possesses at least one sensor and associated electronics including any required analogue to digital converter devices to monitor pressure, and/or temperature, such as vibrational spectra, shock sensors, etc., ie., it has "sensor measurement means"

(e) it can receive commands sent from the surface, ie., it has "command receiver means from surface"

(f) it can send information to the surface, ie., it has "information transmission means to surface"

(g) it can relay information to one or more portions of the drill string, ie., it has "tool relay transmission means"

(h) it can receive information from one or more portions of the drill string, ie., it has "tool receiver means"

(i) it can have one or more means to process information, ie., it has at least one "processor means"

(j) it can have one or more computers to process information, and/or interpret commands, and/or send data, ie., it has one or more "computer means"

(k) it can have one or more means for data storage (l) it can have one or more means for nonvolatile data storage if power is interrupted (m) it can have one or more recording devices, ie., it has one or more "recording means"

(n) it can have one or more read only memories (o) it may have one or more electronic controllers to process information, ie., it has one or more "electronic controller means"

(p) it can have one or more actuator means to change at least one physical element of the device in response to measurements within the device, and/or commands received from the surface, and/or relayed information from any portion of the drill string (q) the device can be deployed into the metallic pipe, the drill string, or the casing as is appropriate, by any means, including means to pump it down with mud pressure by analogy to a wiper plug, or it may use any type of mechanical means including gears and wheels to engage the casing (r) the device can be deployed with any coiled tubing device and may be retrieved with any coiled tubing device, ie., it can be deployed and retrieved with any "coiled tubing means"

(s) the device can be deployed with any coiled tubing device having wireline inside the coiled tubing device (t) the device may have "standard geophysical depth control sensors" including natural gamma ray measurement devices, casing collar locators, etc., ie., the device can have "standard depth control measurement means"

(u) the device may have any typical geophysical measurement device described in the art including its own MWD/LWD measurement devices described elsewhere above, ie., it can have any "geophysical measurement means"

(v) the device may have one or more electrically operated pumps including positive displacement pumps, turbine pumps, centrifugal pumps, impulse pumps, etc., ie., it may have one or more "internal pump means"

(w) the device may have a positive displacement pump coupled to a transmission device for providing relatively large pulling forces, ie., it may have one or more "transmission means"

(x) the device may have two pumps in one unit, a positive displacement pump to provide large forces and relatively slow smart shuttle speeds and a turbine pump to provide lesser forces at relatively high smart shuttle speeds, ie., it may have "two or more internal pump means"

Figure 11:
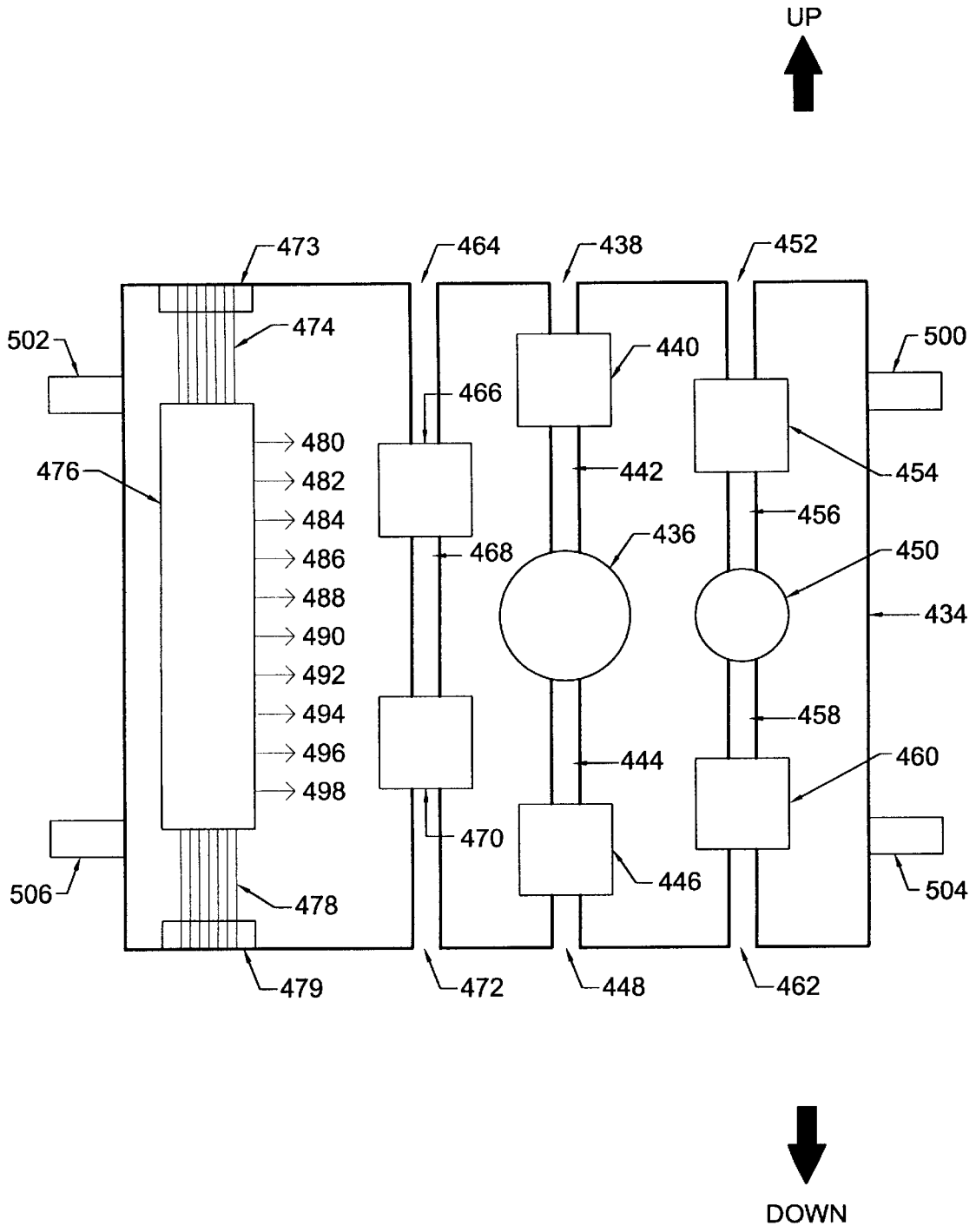
FIG. 11 is a generalized block diagram of one embodiment of a Smart Shuttle having a first electrically operated positive displacement pump and a second electrically operated pump.

(y) the device may have one or more pumps operated by other energy sources (z) the device may have one or more bypass assemblies such as the bypass assembly comprised of elements 464, 466, 468, 470, and 472 in FIG. 11, ie., it may have one or more "bypass means"

(aa) the device may have one or more electrically operated valves, ie., it may have one or more electrically operated "valve means"

(ab) it may have attachments to it or devices incorporated in it that install into the well and/or retrieve from the well various "Well Completion Devices" as are defined below The "Retrieval & Installation Subassembly", otherwise abbreviated as the "Retrieval/Installation Sub", also simply abbreviated as the "Retrieval Sub", and it is generally shown as numeral 308, has one or more of the following features (hereinafter, "List of Retrieval Sub Features"):

(a) it is attached to or is made a portion of the Smart Shuttle (b) it has means to retrieve apparatus disposed in a steel pipe (c) it has means to install apparatus into a steel pipe (d) it has means to install various completion devices into steel pipes (e) it has means to retrieve various completion devices from steel pipes Element 402 that is the "internal pump of the smart shuttle" may be any electrically operated pump, or any hydraulically operated pump that in turn, derives its power in any way from the wireline. Standard art in the field is used to fabricate the components of the Smart Shuttle and that art includes all pump designs typically used in the industry. Standard literature on pumps, fluid mechanics, and hydraulics is also used to design and fabricate the components of the Smart Shuttle, and specifically, the book entitled "Theory and Problems of Fluid Mechanics and Hydraulics", Third Edition, by R. V. Giles, J. B. Evett, and C. Liu, Schaum's Outline Series, McGraw-Hill, Inc., New York, N.Y., 1994, 378 pages, is incorporated herein in its entirety by reference.

For the purposes of several preferred embodiments of this invention, an example of a "wireline conveyed smart shuttle means having retrieval and installation means" is comprised of the Smart Shuttle and the Retrieval Sub shown in FIG. 8. From the above description, a Smart Shuttle may have many different features that are defined in the above "List of Smart Shuttle Features" and the Smart Shuttle by itself is called for the purposes herein a "wireline conveyed smart shuttle means" or simply a "wireline conveyed shuttle means". A Retrieval Sub may have many different features that are defined in the above "List of Retrieval Sub Features" and for the purposes herein, it is also described as a "retrieval and installation means". Accordingly, a particular preferred embodiment of a "wireline conveyed shuttle means" has one or more features from the "List of Smart Shuttle Features" and one or more features from the "List of Retrieval Sub Features". Therefore, any given "wireline conveyed shuttle means having retrieval and installation means" may have a vast number of different features as defined above. Depending upon the context, the definition of a "wireline conveyed shuttle means having retrieval and installation means" may include any first number of features on the "List of Smart Shuttle Features" and may include any second number of features on the "List of Retrieval Sub Features". In this context, and for example, a "wireline conveyed shuttle means having retrieval and installation means" may 4 particular features on the "List of Smart Shuttle Features" and may have 3 features on the "List of Retrieval Sub Features". The phrase "wireline conveyed smart shuttle means having retrieval and installation means" is also equivalently described for the purposes herein as "wireline conveyed shuttle means possessing retrieval and installation means"

It is now appropriate to discuss a generalized block diagram of one type of Smart Shuttle. The block diagram of another preferred embodiment of a Smart Shuttle is identified as numeral 434 in FIG. 11. Element 436 represents a block diagram of a first electrically operated internal pump, and in this preferred embodiment, it is a positive displacement pump, which associated with an upper port 438, electrically controlled upper valve 440, upper tube 442, lower tube 444, electrically controlled lower valve 446, and lower port 448, which subsystem is collectively called herein "the Positive Displacement Pump System". In FIG. 11, there is another second electrically operated internal pump, which in this case is an electrically operated turbine pump 450, which is associated with an upper port 452, electrically operated upper valve 454, upper tube 456, lower tube 458, electrically operated lower valve 460, and lower tube 462, which system is collectively called herein "the Secondary Pump System". FIG. 11 also shows upper bypass tube 464, electrically operated upper bypass valve 466, connector tube 468, electrically operated lower bypass valve 470, and lower bypass tube 472, which subsystem is collectively called herein "the Bypass System". The 7 conductors (plus armor) from the cablehead are connected to upper electrical plug 473 in the Smart Shuttle. The 7 conductors then proceed through the upper portion of the Smart Shuttle that are figuratively shown as numeral 474 and those electrically insulated wires are connected to smart shuttle electronics system module 476. The pass through typically 7 conductors that provide signals and power from the wireline and the Smart Shuttle to the Retrieval Sub are figuratively shown as element 478 and these in turn are connected to lower electrical connector 479. Signals and power from lower electrical connector 479 within the Smart Shuttle are provided as necessary to mating top electrical connector 431 (not shown in FIG. 11) of the Retrieval Sub and then those signals and power are in turn passed through the Retrieval Sub to the retrieval sub electrical connector 313 as shown in FIG. 9. Smart shuttle electronics system module 476 carries out all the other possible functions listed as items (a) to (z) in the above defined list of "List of Smart Shuttle Features" and those functions include all necessary electronics, computers, processors, measurement devices, etc. to carry out the functions of the Smart Shuttle. Various outputs from the smart shuttle electronics system module 476 are figuratively shown as elements 480 to 498. As an example, element 480 provides electrical energy to pump 436; element 482 provides electrical energy to pump 450; element 484 provides electrical energy to valve 440; element 486 provides electrical energy to valve 446; element 488 provides electrical energy to valve 454; element 490 provides electrical energy to valve 460; element 492 provides electrical energy to valve 466; element 494 provides electrical energy to valve 468; etc. In the end, there may be a hundred or more additional electrical connections to and from the smart shuttle electronics system module 476 that are collectively represented by numerals 496 and 498. In FIG. 11, the right-hand and left-hand portions of upper smart shuttle seal are labeled respectively 500 and 502. Further, the right-hand and left-hand portions of lower smart shuttle seal are labeled respectively with numerals 504 and 506. Not shown in FIG. 11 are apparatus that may be used to retract these seals under electronic control that would protect the seals from wear during long trips into the hole within mostly vertical well sections where the weight of the smart shuttle means is sufficient to deploy it into the well under its own weight. These seals would also be suitably retracted when the smart shuttle means is pulled up by the wireline.

The preferred embodiment of the block diagram for a Smart Shuttle has a particular virtue. Electrically operated pump 450 is an electrically operated turbine pump, and when it is operating with valves 454 and 460 open, and the rest closed, it can drag significant loads downhole at relatively high speeds. However, when the well goes horizontal, these loads increase. If electrically operated pump 450 stalls or cavitates, etc., then electrically operated pump 436 that is a positive displacement pump takes over, and in this case, valves 440 and 446 are open, with the rest closed. Pump 436 is a particular type of positive displacement pump that may be attached to a pump transmission device so that the load presented to the positive displacement pump does not exceed some maximum specification independent of the external load. See FIG. 12 for additional details.

Figure 12:
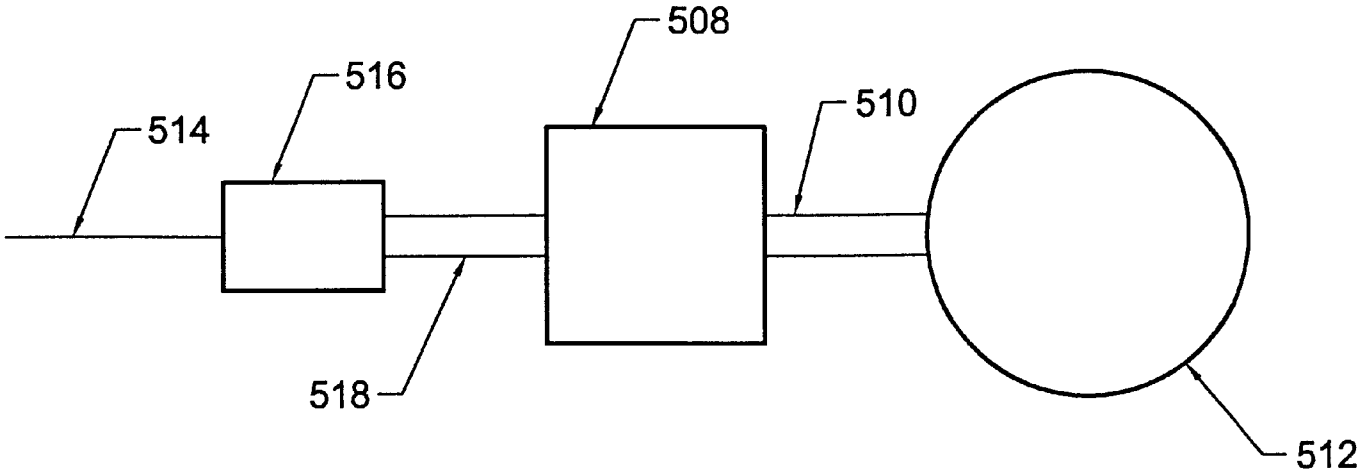
FIG. 12 shows a block diagram of a pump transmission device that prevents pump stalling, and other pump problems, by matching the load seen by the pump to the power available by the motor.

FIG. 12 shows a block diagram of a pump transmission device 508 that provides a mechanical drive 510 to positive displacement pump 512. Electrical power from the wireline is provided by wire bundle 514 to electric motor 516 and that motor provides a mechanical coupling 518 to pump transmission device 508. Pump transmission device 508 may be an "automatic pump transmission device" in analogy to the operation of an automatic transmission in a vehicle, or pump transmission device 508 may be a "standard pump transmission device" that has discrete mechanical gear ratios that are under control from the surface of the earth. Such a pump transmission device prevents pump stalling, and other pump problems, by matching the load seen by the pump to the power available by the motor. Otherwise, the remaining block diagram for the system would resemble that shown in FIG. 11, but that is not shown here for the purposes of brevity.

Another preferred embodiment of the Smart Shuttle contemplates using a "hybrid pump/wheel device". In this approach, a particular hydraulic pump in the Smart Shuttle can be alternatively used to cause a traction wheel to engage the interior of the pipe. In this hybrid approach, a particular hydraulic pump in the Smart Shuttle is used in a first manner as is described in FIGS. 8–12. In this hybrid approach, and by using a set of electrically controlled valves, a particular hydraulic pump in the Smart Shuttle is used in a second manner to cause a traction wheel to rotate and to engage the pipe that in turn causes the Smart Shuttle to translate within the pipe. There are many designs possible using this "hybrid approach".

Figure 13:
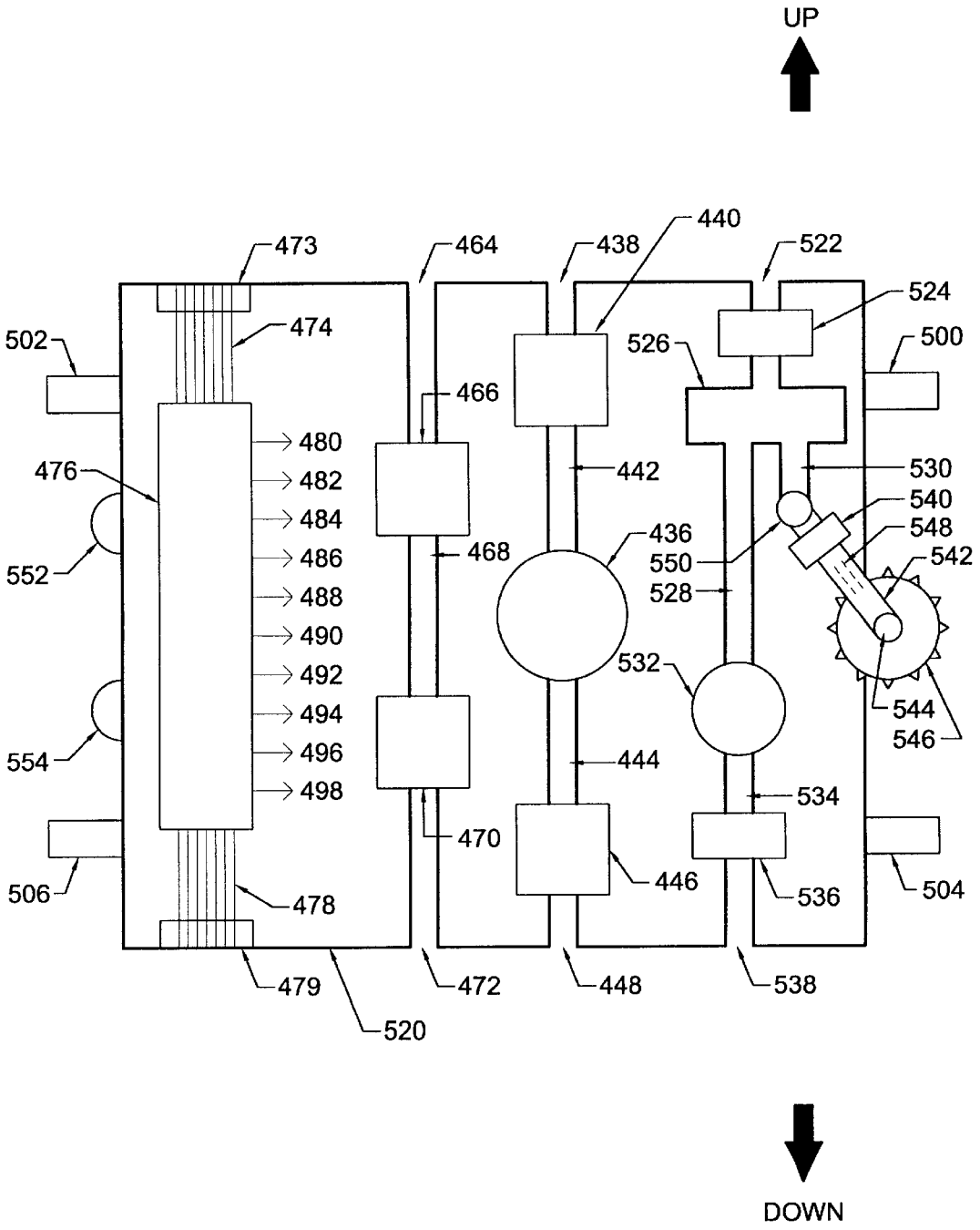
FIG. 13 shows a block diagram of preferred embodiment of a Smart Shuttle having a hybrid pump design that is also provides for a turbine assembly that causes a traction wheel to engage the casing to cause translation of the smart shuttle.

FIG. 13 shows a block diagram of the preferred embodiment of a Smart Shuttle having a hybrid pump design that is generally designated with the numeral 520. Selected elements ranging from element 436 to element 506 in FIG. 13 have otherwise been defined in relation to FIG. 11. In addition, inlet port 522 is connected to electrically controlled valve 524 that is in turn connected to two-state valve 526 that may be commanded from the surface of the earth to selectively switch between two states as follows: "state 1"—the inlet port 522 is connected to secondary pump tube 528 and the traction wheel tube 530 is closed; or "state 2"—the inlet port 522 is closed, and the secondary pump tube 528 is connected to the traction wheel tube 530. Secondary pump tube 528 in turn is connected to second electrically operated pump 532, tube 534, electrically operated valve 536 and port 538 and operates analogously to elements 452–462 in FIG. 11 provided the two-state valve 526 is in state 1.

In FIG. 13, in "state 2", with valve 536 open, and when energized, electrically operated pump 532 forces well fluids through tube 528 and through two-state valve 526 and out tube 530. If valve 540 is open, then the fluids continue through tube 542 and to turbine assembly 544 that causes the traction wheel 546 to move the Smart Shuttle downward in the well. In FIG. 13, the "turbine bypass tube" for fluids to be sent to the top of the Smart Shuttle AFTER passage through turbine assembly 544 is NOT shown in detail for the purposes of simplicity only in FIG. 13, but this "turbine bypass tube" is figuratively shown by dashed lines as element 548.

In FIG. 13, the actuating apparatus causing the traction wheel 546 to engage the pipe on command from the surface is shown figuratively as element 550 in FIG. 13. The point is that in "state 2", fluids forced through the turbine assembly 544 cause the traction wheel 546 to make the Smart Shuttle go downward in the well, and during this process, fluids forced through the turbine assembly 544 are "vented" to the "up" side of the Smart Shuttle through "turbine bypass tube" 548. Backing rollers 552 and 554 are figuratively shown in FIG. 13, and these rollers take side thrust against the pipe when the traction wheel 546 engages the inside of the pipe.

In the event that seals 500–502 or 504–506 in FIG. 13 were to loose hydraulic sealing with the pipe, then "state 2" provides yet another means to cause the Smart Shuttle to go downward in the well under control from the surface. The wireline can provide arbitrary pull in the vertical direction, so in this preferred embodiment, "state 2" is primarily directed at making the Smart Shuttle go downward in the well under command from the surface. Therefore, in FIG. 13, there are a total of three independent ways to make the Smart Shuttle go downward under command from the surface of the earth ("standard" use of pump 436; "standard" use of pump 532 in "state 1"; and the use of the traction wheel in "state 2").

The downward velocity of the Smart Shuttle can be easily determined assuming that electrically operated pump 402 in FIGS. 9 and 10 are positive displacement pumps so that there is no "pump slippage" caused by pump stalling, cavitation effects, or other pump "imperfections". The following also applies to any pump that pumps a given volume per unit time without any such non-ideal effects. As stated before, in the time interval $\Delta t$, a quantity of fluid $\Delta V1$ is pumped from below the Smart Shuttle to above it. Therefore, if the position of the Smart Shuttle changes downward by $\Delta Z$ in the time interval $\Delta t$, and with radius a1 defined in FIG. 10, it is evident that:

$$\Delta V1/\Delta t = \Delta Z/\Delta t\{\pi(a1)^2\} \qquad \text{Equation 1.}$$

$$\text{Downward Velocity} = \Delta Z/\Delta t \qquad \text{Equation 2.}$$

$$= \{\Delta V1/\Delta t\}/\{\pi(a1)^2\}$$

Here, the "Downward Velocity" defined in Equation 2 is the average downward velocity of the Smart Shuttle that is averaged over many cycles of the pump. After the Smart Shuttle the Automated Smart Shuttle System is primed, then the Smart Shuttle and its pump resides in a standing fluid column and the fluids are relatively non-compressible. Further, with the above pump transmission device 508 in FIG. 12, or equivalent, the electrically operated pump system will not stall. Therefore, when a given volume of fluid $\Delta V$ is pumped from below the Smart Shuttle to above it, the Shuttle will move downward provided the elastomeric seals like elements 500, 502, 504 and 506 in FIGS. 9, 11, and 12 do not lose hydraulic seal with the casing. Again there are many designs for such seals, and of course, more than two seals can be used along the length of the Smart Shuttle. If the seals momentarily loose their hydraulic sealing ability, then a "hybrid pump/wheel device" as described in FIG. 13 can be used momentarily until the seals again make suitable contact with the interior of the pipe.

The preferred embodiment of the Smart Shuttle having internal pump means to pump fluid from below the smart shuttle to above it to cause the shuttle to move in the pipe may also be used to replace relatively slow and inefficient "well tractors" that are now commonly used in the industry.

Figure 14:
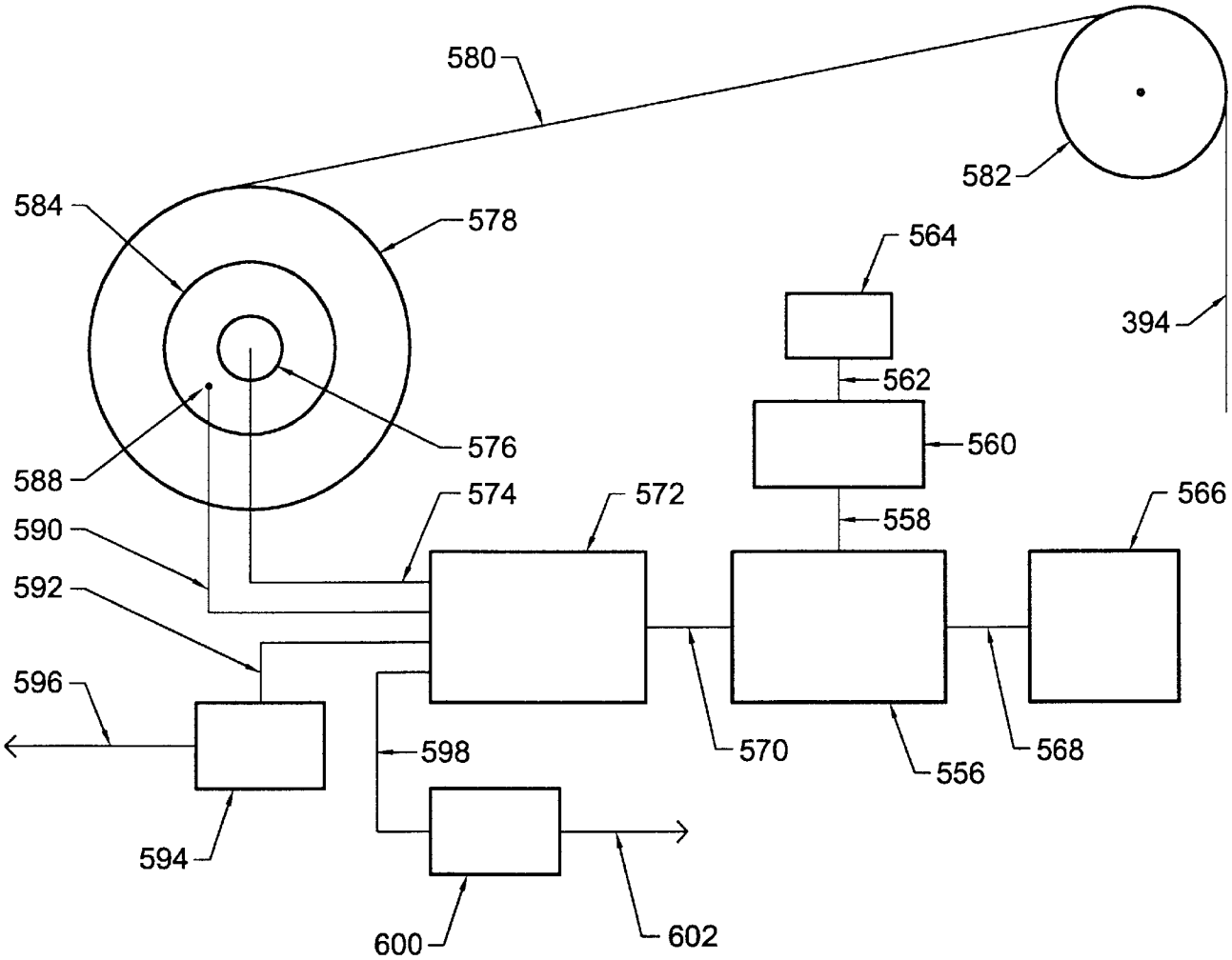
FIG. 14 shows the computer control of the wireline drum and the Smart Shuttle in a preferred embodiment of the invention that allows the system to be operated as an Automated Smart Shuttle System.

FIG. 14 shows a remaining component of the Automated Smart Shuttle System. FIG. 14 shows the computer control of the wireline drum and of the Smart Shuttle in a preferred embodiment of the invention. Computer system 556 has typical components in the industry including one or more processors, one or more non-volatile memories, one or more volatile memories, many software programs that can run concurrently or alternatively as the situation requires, etc., and all other features as necessary to provide computer control the Automated Shuttle System. In this preferred embodiment, this same computer system 556 also has the capability to acquire data from, and send commands to, and otherwise properly operate and control all instruments in the Retrievable Instrumentation Package. Therefore LWD and MWD data is acquired by this same computer system when appropriate. Therefore, in one preferred embodiment, the computer system 556 has all necessary components to interact with the Retrievable Instrumentation Package. The computer system 556 has a cable 558 that connects it to display console 560. The display console 560 displays data, program steps, and any information required to operate the Smart Shuttle System. The display console is also connected via cable 562 to alarm and communications system 564 that provides proper notification to crews that servicing is required—particularly if the smart shuttle chamber 346 in FIG. 8 needs servicing that in turn generally involves changing various devices connected to the Smart Shuttle. Data entry and programming console 566 provides means to enter any required digital or manual data, commands, or software as needed by the computer system, and it is connected to the computer system via cable 568. Computer system 556 provides commands over cable 570 to the electronics interfacing system 572 that has many functions. One function of the electronics interfacing system is to provide information to and from the Smart Shuttle through cabling 574 that is connected to the slip-ring 576, as is typically used in the industry. The slip-ring 576 is suitably mounted on the side of the wireline drum 578 in FIG. 14. Information provided to slip-ring 576 then proceeds to wireline 580 that generally has 7 electrical conductors enclosed in armor. That wireline 580 proceeds to overhead sheave 582 that is suitably suspended above the Wireline Lubricator System in FIG. 8. In particular, the lower portion of the wireline 394 shown in FIG. 14 is also shown as the top portion of the wireline 394 that enters the Wireline Lubricator System in FIG. 8. That particular portion of the wireline 394 is the same in FIG. 14 and in FIG. 8, and this equality provides a logical connection between these two figures. Electronics interfacing system 572 also provides power and electronic control of the wireline drum hydraulic motor and pump assembly 584 as is typically used in the industry today (that replaced earlier chain drive systems). Wireline drum hydraulic motor and pump assembly 584 controls the motion of the wireline drum, and when it winds up in the counter-clockwise direction as observed in FIG. 14, the Smart Shuttle goes upwards in the wellbore in FIG. 8, and Z decreases. Similarly, when the wireline drum hydraulic motor and pump assembly 584 provides motion in the clockwise direction as observed in FIG. 14, then the Smart Shuttle goes down in FIG. 8 and Z increases. The wireline drum hydraulic motor and pump assembly 584 is connected to cable connector 588 that is in turn connected to cabling 590 that is in turn connected to electronics interfacing system 572 that is in turn controlled by computer system 556. Electronics interfacing system 572 also provides power and electronic control of any coiled tubing rig designated by element 591 (not shown in FIG. 14), including the coiled tubing drum hydraulic motor and pump assembly of that coiled tubing rig, but such a coiled tubing rig is not shown in FIG. 14 for the purposes of simplicity. In addition, electronics interfacing system 572 has output cable 592 that provides commands and control to drilling rig hardware control system 594 that controls various drilling rig functions and apparatus including the rotary drilling table motors, the mud pump motors, the pumps that control cement flow and other slurry materials as required, and all electronically controlled valves, and those functions are controlled through cable bundle 596 which has an arrow on it in FIG. 14 to indicate that this cabling goes to these enumerated items. A preferred embodiment of a portion of the Automated Smart Shuttle System shown in FIG. 8 has electronically controlled valves, so that valves 392, 384, 364, 360, 344, 340, 336, and 332 as seen from top to bottom in FIG. 8, and are all electronically controlled in this embodiment, and may be opened or shut remotely from drilling rig hardware control system 594. In addition, electronics interfacing system 572 also has cable output 598 to ancillary surface transducer and communications control system 600 that provides any required surface transducers and/or communications devices required for the instrumentation within the Retrievable Instrumentation Package. In a preferred embodiment, ancillary surface and communications system 600 provides acoustic transmitters and acoustic receivers as may be required to communicate to and from the Retrievable Instrumentation Package. The ancillary surface and communications system 600 is connected to the required transducers, etc. by cabling 602 that has an arrow in FIG. 14 designating that this cabling proceeds to those enumerated transducers and other devices as may be required. Standard electronic feedback control systems and designs are used to implement the entire system as described above, including those described in the book entitled "Theory and Problems of Feedback and Control Systems", "Second Edition", "Continuous(Analog) and Discrete(Digital)", by J. J. DiStefano III, A. R. Stubberud, and I. J. Williams, Schaum's Outline Series, McGraw-Hill, Inc., New York, N.Y., 1990, 512 pages, an entire copy of which is incorporated herein by reference. Therefore, in FIG. 14, the computer system 556 has the ability to communicate with, and to control, all of the above enumerated devices and functions that have been described in this paragraph. Furthermore, the entire system represented in FIG. 14 is provides the automation for the "Automated Smart Shuttle Oil and Gas Completion System", or also abbreviated as the "Automated Smart Shuttle System", or the "Smart Shuttle Oil and Gas Completion System". This system is the "automatic control means" for the "wireline conveyed shuttle means having retrieval and installation means" or simply the "automatic control means" for the "smart shuttle means".

Steps to Complete Well Shown in FIG. 6

The following describes the completion of one well commencing with the well diagram shown in FIG. 6. In FIG. 6, it is assumed that the well has been drilled to total depth. Furthermore, it is also assumed here that all geophysical information is known about the geological formation because the embodiment of the Retrievable Instrumentation Package shown in FIG. 6 has provided complete LWD/MWD information.

The first step is to disconnect the top of the drill string 170 in FIG. 6 from the drilling rig apparatus. In this step, the kelly, etc. is disconnected and removed from the drill string that is otherwise held in place with slips as necessary until the next step.

The second step is to attach to the top of that drill pipe first blow-out preventer 316 and top drill pipe flange 320 as shown in FIG. 8, and to otherwise attach to that flange 320 various portions of the Automated Smart Shuttle System shown in FIG. 8 including the "Wiper Plug Pump-Down Stack" 322, the "Smart Shuttle Chamber" 346, and the "Wireline Lubricator System" 374, which are subassemblies that are shown in their final positions after assembly in FIG. 8.

The third step is the "priming" of the Automated Smart Shuttle System as described in relation to FIG. 8.

The fourth step is to retrieve the Retrievable Instrumentation Package. Please recall that the Retrievable Instrumentation Package has heretofore provided all information about the wellbore, including the depth, geophysical parameters, etc. Therefore, computer system 556 in FIG. 14 already has this information in its memory and is available for other programs. "Program A" of the computer system 556 is instigated that automatically sends the Smart Shuttle 306 and its Retrieval Sub 308 (see FIG. 9) down into the drill string, and causes the electronically controllable retrieval snap ring assembly 310 in FIG. 9 to positively snap into the retrieval grove 298 of element 206 of the Retrievable Instrumentation Package in FIG. 7 when the mating nose 312 of the Retrieval Sub in FIG. 9 enters mud passage 198 of the Retrievable Instrumentation Package in FIG. 7. Thereafter, the Retrieval Sub has "latched onto" the Retrievable Instrumentation Package. Thereafter, a command is given to the computer system that pulls up on the wireline thereby disengaging mating electrical connectors 232 and 234 in FIG. 7, and pulling piston 254 through bore 258 in the body of the Smart Drilling and Completion Sub in FIG. 7. Thereafter, the Smart Shuttle, the Retrieval Sub, and the Retrievable Instrumentation Package under automatic control of "Program A" return to the surface as one unit. Thereafter, "Program A" causes the Smart Shuttle and the Retrieval Sub to "park" the Retrievable Instrumentation Package within the "Smart Shuttle Chamber" 346 and adjacent to the smart shuttle chamber door 348. Thereafter, the alarm and communications system 564 sounds a suitable "alarm", to the crew that servicing is required—in this case the Retrievable Instrumentation Package needs to be retrieved from the Smart Shuttle Chamber. The fourth step is completed when the Retrievable Instrumentation Package is removed from the Smart Shuttle Chamber.

Figure 15:
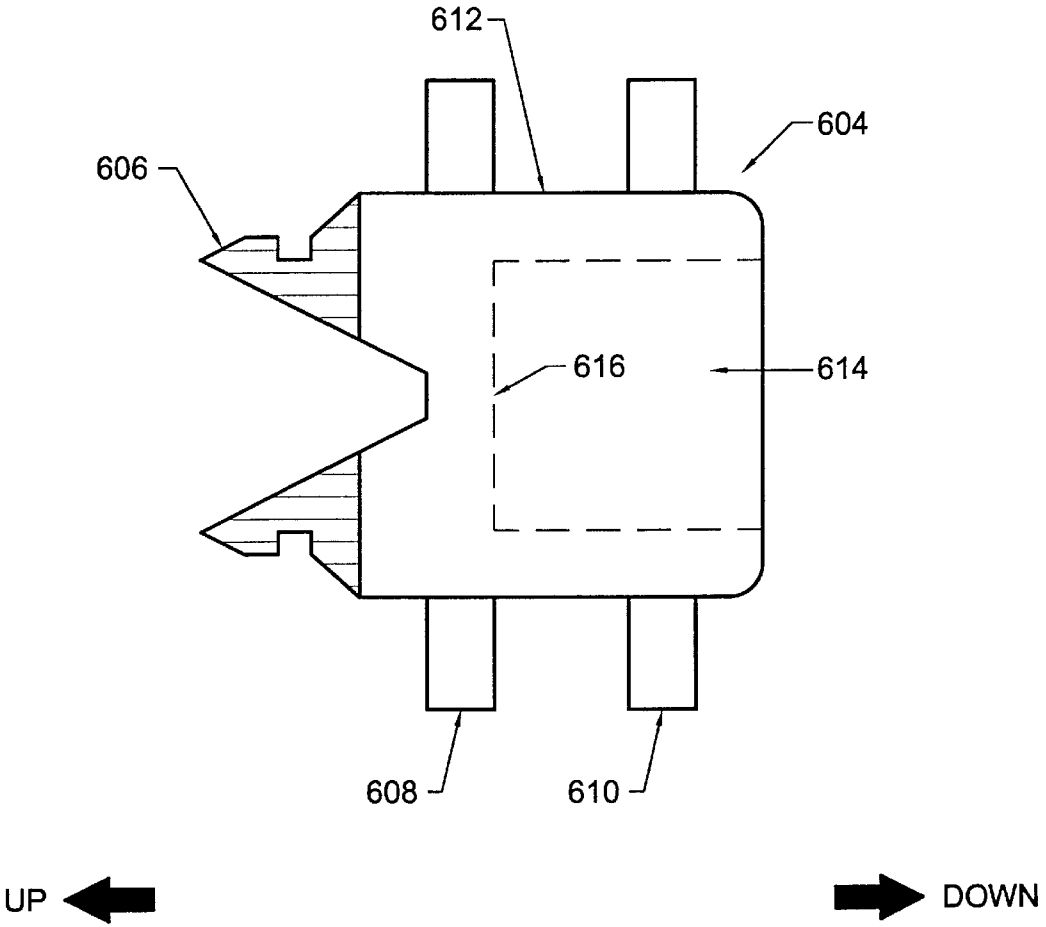
FIG. 15 shows a section view of a rubber-type material wiper plug that can be attached to the Retrieval Sub and placed into the Wiper Plug Pump-Down Stack and subsequently used for the well completion process.

The fifth step is to pump down cement and gravel using a suitable pump-down latching one-way valve means and a series of wiper plugs to prepare the bottom portion of the drill string for the final completion steps. The procedure here is followed in analogy with those described in relation to FIGS. 1–4 above. Here, however, the pump-down latching one-way valve means that is similar to the Latching Float Collar Valve Assembly 20 in FIG. 1 is also fitted with apparatus attached to its Upper Seal 22 that provides similar apparatus and function to element 206 of the Retrievable Instrumentation Package in FIG. 7. Put simply, a device similar to the Latching Float Collar Valve Assembly 20 in FIG. 1 is fitted with additional apparatus so that it may be conveniently deployed in the well by the Retrieval Sub. Wiper plugs are similarly fitted with such apparatus so that they can also be deployed in the well by the Retrieval Sub. As an example of such fitted apparatus, wiper plugs are fabricated that have rubber attachment features so that they can be mated to the Retrieval Sub in the Smart Shuttle Chamber. A cross section of such a rubber-type material wiper plug is generally shown as element 604 in FIG. 15; which has upper wiper attachment apparatus 606 that provides similar apparatus and function to element 206 of the Retrievable Instrumentation Package in FIG. 7; and which has flexible upper wiper blade 608 to fit the interior of the pipe present; flexible lower wiper blade 610 to fit the interior of the pipe present; wiper plug indentation region between the blades specified by numeral 612; wiper plug interior recession region 614; and wiper plug perforation wall 616 that perforates under suitable applied pressure; and where in some forms of the wiper plugs called "solid wiper plugs", there is no such wiper plug interior recession region and no portion of the plug wall can be perforated; and where the legends of "UP" and "DOWN" are also shown in FIG. 15. Accordingly, a pump-down latching one-way valve means is attached to the Retrieval Sub in the Smart Shuttle Chamber, and the computer system is operated using "Program B", where the pump-down latching one-way valve means is placed at, and is released in the pipe adjacent to riser hanger apparatus 315 in FIG. 8. Then, under "Program B", perforable wiper plug #1 is attached to the Retrieval Sub in the Smart Shuttle Chamber, and it is placed at and released adjacent to region A in FIG. 8. Not shown in FIG. 8 are optional controllable "wiper holding apparatus" that on suitable commands fit into the wiper plug recession region 614 and temporally hold the wiper plug in place within the pipe in FIG. 8. Then under "Program B", perforable wiper plug #2 is attached to the Retrieval Sub in the Smart Shuttle Chamber, and it is placed at and released adjacent to region B in FIG. 8. Then under "Program B", solid wiper plug #3 is attached to the Retrieval Sub in the Smart Shuttle Chamber, and it is placed at and released adjacent to region C in FIG. 8, and the Smart Shuttle and the Retrieval Sub are "parked" in region E of the Smart Shuttle Chamber in FIG. 8. Then the Smart Shuttle Chamber is closed, and the chamber itself is suitably "primed" with well fluids. Then, with other valves closed, valve 332 is the opened, and "first volume of cement" is pumped into the pipe forcing the pump-down latching one-way valve means to be forced downward. Then valve 332 is closed, and valve 336 is opened, and a predetermined volume of gravel is forced into the pipe that in turn forces wiper plug #1 and the one-way valve means downward. Then, valve 336 is closed, and valve 338 opened, and a "second volume of cement" is pumped into the pipe forcing wiper plugs #1 and #2 and the one-way valve means downward. Then valve #338 is closed, and valve 344 is opened, and water is injected into the system forcing wiper plugs #1, #2, and #3, and the one-way valve means downward. Then the latching apparatus of the pump-down latching one-way valve means appropriately seats in latch recession 210 of the Smart Drilling and Completion Sub in FIG. 7 that was previously used to latch into place the Retrievable Instrumentation Package. From this disclosure, the pump-down latching one-way valve means has latching means resembling element 208 of the Retrievable Instrumentation Package so that it can latch into place in latch recession 210 of the Smart Drilling and Completion Sub. In the end, the sequential charges of cement, gravel, and then cement are forced through the respective perforated wiper plugs and the one-way valve means and through the mud passages in the drill bit and into the annulus between the drill pipe and the wellbore. Valve 344 is then closed, and pressure is then released in the drill pipe, and the one-way valve means allows the first and second volumes of cement to set up properly on the outside of the drill pipe. After "Program B" is completed, the communications system 564 sounds a suitable "alarm" that the next step should be taken to complete the well.

Figure 16:
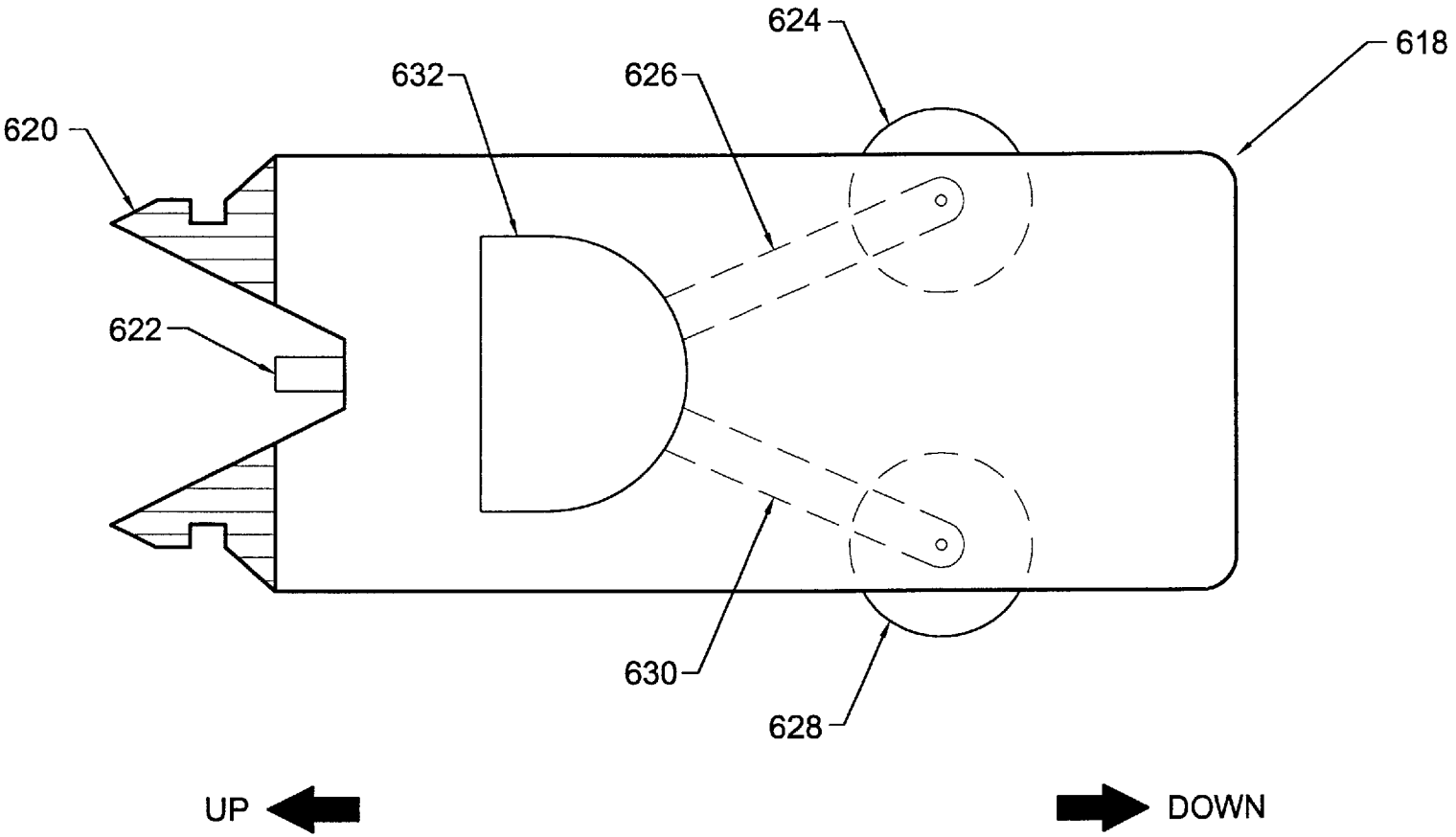
FIG. 16 shows a section view of the Casing Saw that can be attached to the Retrieval Sub and conveyed downhole with the Smart Shuttle.

The sixth step is to saw slots in the drill pipe similar to the slot that is labeled with numeral 178 in FIG. 5. Accordingly, a "Casing Saw" is fitted so that it can be attached to and deployed by the Retrieval Sub. This Casing Saw is figuratively shown in FIG. 16 as element 618. The Casing Saw 618 has upper attachment apparatus 620 that provides similar apparatus and mechanical functions as provided by element 206 of the Retrievable Instrumentation Package in FIG. 7—but, that in addition, it also has top electrical connector 622 that mates to the retrieval sub electrical connector 313 shown in FIG. 9. These mating electrical connectors 313 and 622 provide electrical energy from the wireline and command and control signals to and from the Smart Shuttle as necessary to properly operate the Casing Saw. First casing saw blade 624 is attached to first casing saw arm 626. Second casing saw blade 628 is attached to second casing saw arm 630. Casing saw module 632 provides actuating means to deploy the arms, control signals, and the electrical and any hydraulic systems to rotate the casing saw blades. FIG. 16 shows the saw blades in their extended "out position", but during any trip downhole, the blades would be in the retracted or "in position". Therefore, during this sixth step, the Casing Saw is suitably attached to the Retrieval Sub, the Smart Shuttle Chamber 346 is suitably primed, and then under and then the computer system 556 is operated using "Program C" that automatically controls the wireline drum and the Smart Shuttle so that the Casing Saw is properly deployed at the correct depth, the casing saw arms and saw blades are properly deployed, and the Casing Saw properly cuts slots through the casing. The "internal pump of the smart shuttle" 402 may be used in principle to make the Smart Shuttle go up or down in the well, and in this case, as the saw cuts slots through the casing, it moves up slowly under its own power—and under suitable tension applied to the wireline that is recommended to prevent a disastrous "overrun" of the wireline. After the slots are cut in the casing, the Casing Saw is then returned to the surface of the earth under "Program C" and thereafter, the communications system 564 sounds a suitable "alarm", and the crew that servicing is required—in this case the Casing Saw needs to be retrieved from the Smart Shuttle Chamber.

For a simple single-zone completion system, a coiled tubing conveyed packer can be used to complete the well. For a simple single-zone completion system, only several more steps are necessary. Basically, the wireline system is removed and a coiled tubing rig is used to complete the well.

Figure 17:
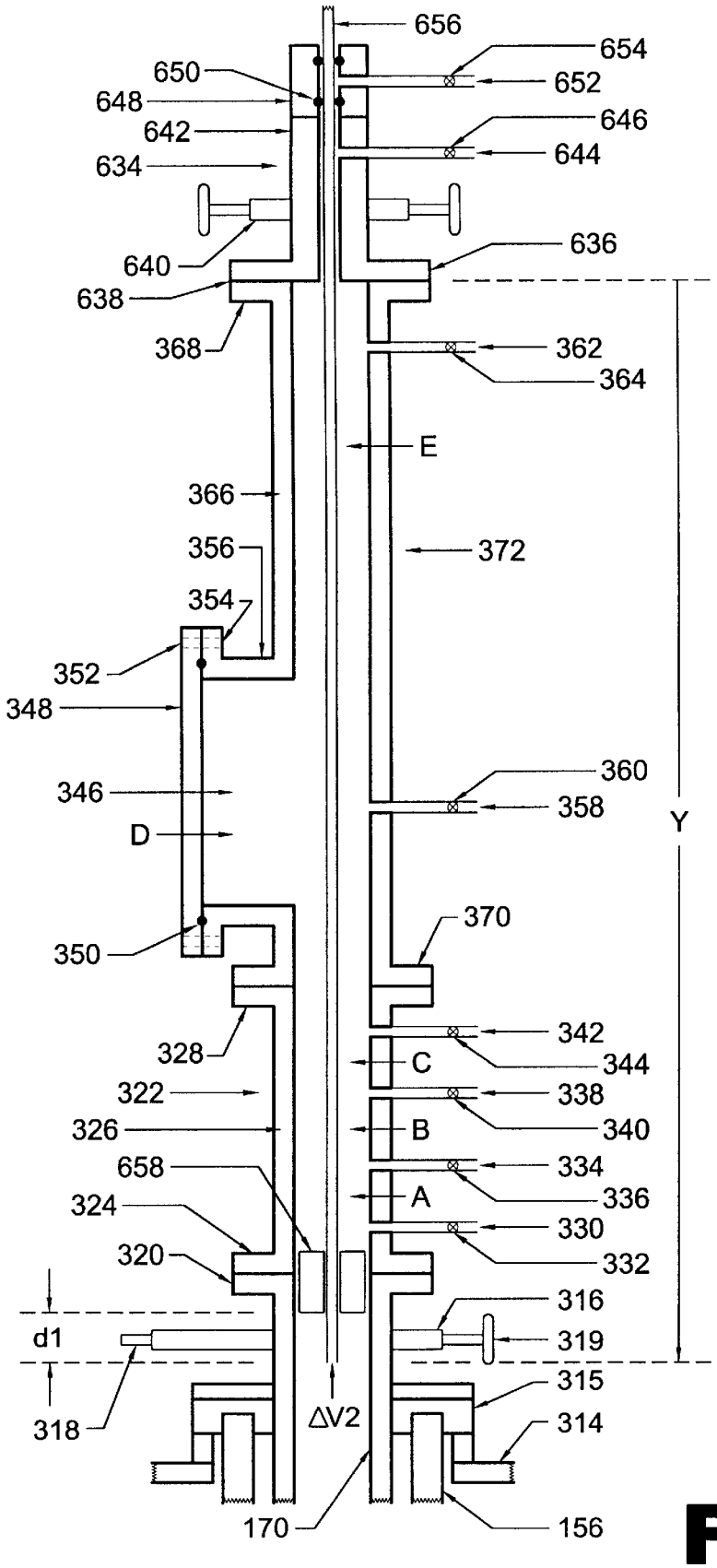
FIG. 17 shows a section view of the wellhead, the Wiper Plug Pump-Down Stack, the Smart Shuttle Chamber, the Coiled Tubing Lubricator System, and the pump-down single zone packer apparatus suspended by the coiled tubing in the well before commencing the final single-zone completion of the well.

The seventh step is to close first blow-out preventer 316 in FIG. 8. This will prevent any well pressure from causing problems in the following procedure. Then, remove the Smart Shuttle and the Retrieval Sub from the cablehead 304, and remove these devices from the Smart Shuttle Chamber. Then, remove the bolts in flanges 376 and 368, and then remove the entire Wireline Lubricator System 374 in FIG. 8. Then replace the Wireline Lubricator System with a Coiled Tubing Lubricator System that looks similar to element 374 in FIG. 8, except that the wireline in FIG. 8 is replaced with a coiled tubing. At this point, the Coiled Tubing Lubricator System is bolted in place to flange 368 in FIG. 8. FIG. 17 shows the Coiled Tubing Lubricator System 634. The bottom flange of the Coiled Tubing Lubricator System 636 is designed to mate to upper smart shuttle chamber flange 368. These two flanges join at the position marked by numeral 638. The Coiled Tubing Lubricator System in FIG. 17 has various additional features, including a second blow-out preventer 640, coiled tubing lubricator top body 642, fluid control pipe 644 and its fluid control valve 646, a hydraulic packing gland generally designated by numeral 648 in FIG. 17, having gland sealing apparatus 650, grease packing pipe 652 and grease packing valve 654. Coiled tubing 656 feeds through the Coiled Tubing Lubricator System and the bottom of the coiled tubing is at the position Y measured from the position marked by numeral 638 in FIG. 17. Attached to the coiled tubing a distance d1 above the bottom of the end of the coil tubing is pump-down single zone packer apparatus 658. The entire system in FIG. 17 is then primed with fluids such as water using techniques already explained. Then, and with the other appropriate valves closed in FIG. 17, primary injector tube valve 344 is then opened, and water or other fluids are injected into primary injector tube 342. Then the pressure on top surface of the pump-down single zone packer apparatus forces the packer apparatus downward, thereby increasing the distance Y, but when it does so, fluid $\Delta V2$ is displaced, and it goes up the interior of the coiled tubing and to coiled tubing pressure relief valve 660 near the coiled tubing rig (not shown in FIG. 17) and the fluid volume $\Delta V2$ is emptied into a holding tank 662 (not shown in FIG. 17). For brevity, the pressure relief valve in the coiled tubing rig is not shown herein nor is the holding tank nor is the coiled tubing rig—solely for the purposes of brevity. For additional references on coiled tubing rigs, apparatus and methods, the interested reader is referred to the book entitled "World Oil's Coiled Tubing Handbook", M. E. Teel, Engineering Editor, Gulf Publishing Company, Houston, Tex., 1993, 126 pages, an entire copy of which is incorporated herein by reference. The coiled tubing rig is controlled with the computer system 556 and through the electronics interfacing system 572 and therefore the coiled tubing rig and the coiled tubing is under computer control. Then, using techniques already described, the computer system 556 runs "Program D" that deploys the pump-down single zone packer apparatus 658 at the appropriate depth from the surface of the earth. In the end, this well is completed in a configuration resembling a "Single-Zone Completion" as shown in detail in FIG. 18 on page 21 of the reference entitled "Well Completion Methods", Lesson 4, "Lessons in Well Servicing and Workover", published by the Petroleum Extension Service, The University of Texas at Austin, Austin, Tex., 1971, total of 49 pages, an entire copy of which is incorporated herein by reference, and that was previously defined as "Ref. 2". It should be noted that the coiled tubing described here can also have a wireline disposed within the coiled tubing using typical techniques in the industry. From this disclosure in the seventh step, it should also be stated here that any of the above defined smart completion devices could also be installed into the wellbore with a tubing conveyed smart shuttle means or a tubing with wireline conveyed smart shuttle means—should any other smart completion devices be necessary before the completion of the above step.

The eighth step includes suitably closing first blow-out preventer 316 or other valve as necessary, and removing in sequence the Coiled Tubing Lubricator System 634, the Smart Shuttle Chamber System 372, and the Wiper Plug Pump-Down Stack 322, and then using usual techniques in the industry, adding suitable wellhead equipment, and commencing oil and gas production. Such wellhead equipment is shown in FIG. 39 on page 37 of the book entitled "Testing and Completing", Second Edition, Unit II, Lesson 5, published by the Petroleum Extension Service of the University of Texas, Austin, Tex., 1983, 56 pages total, an entire copy of which is incorporated herein by reference, that was previously defined as "Ref. 4" above.

List of Smart Completion Devices

In light of the above disclosure, it should be evident that there are many uses for the Smart Shuttle and its Retrieval Sub. One use was to retrieve from the drill string the Retrievable Instrumentation Package. Another was to deploy into the well suitable pump-down latching one-way valve means and a series of wiper plugs. And yet another was to deploy into the well and retrieve the Casing Saw.

The deployment into the wellbore of the well suitable pump-down latching one-way valve means and a series of wiper plugs and the Casing Saw are examples of "Smart Completion Devices" being deployed into the well with the Smart Shuttle and its Retrieval Sub. Put another way, a "Smart Completion Device" is any device capable of being deployed into the well and retrieved from the well with the Smart Shuttle and its Retrieval Sub and such a device may also be called a "smart completion means". These "Smart Completion Devices" may often have upper attachment apparatus similar to that shown in elements 620 and 622 FIG. 16. The following is a brief initial list of Smart Completion Devices that may be deployed into the well by the Smart Shuttle and its Retrieval Sub:

(1) smart pump-down one-way cement valves of all types
(2) smart pump-down one-way cement valve with controlled casing locking mechanism
(3) smart pump-down latching one-way cement valve
(4) smart wiper plug
(5) smart wiper plug with controlled casing locking mechanism
(6) smart latching wiper plug
(7) smart wiper plug system for One-Trip-Down-Drilling
(8) smart pump-down wiper plug for cement squeeze jobs with controlled casing locking mechanism
(9) smart pump-down plug system for cement squeeze jobs
(10) smart pump-down wireline latching retriever
(11) smart receiver for smart pump-down wireline latching retriever
(12) smart receivable latching electronics package providing any type of MWD, LWD, and drill bit monitoring information
(13) smart pump-down and retrievable latching electronics package providing MWD, LWD, and drill bit monitoring information
(14) smart pump-down whipstock with controlled casing locking mechanism
(15) smart drill bit vibration damper
(16) smart drill collar
(17) smart pump-down robotic pig to machine slots in drill pipes and casing to complete oil and gas wells
(18) smart pump-down robotic pig to chemically treat inside of drill pipes and casings to complete oil and gas wells
(19) smart milling "pig" to fabricate or "mill" any required slots, holes, or other patterns in drill pipes to complete oil and gas wells
(20) smart liner hanger apparatus
(21) smart liner installation apparatus
(22) smart packer for One-Trip-Down-Drilling
(23) smart packer system for One-Trip-Down-Drilling
(24) smart drill stem tester From the above list, the "smart completion means" includes smart one-way valve means; smart one-way valve means with controlled casing locking means; smart one-way valve means with latching means; smart wiper plug means; smart wiper plug means with controlled casing locking means; smart wiper plugs with latching means; smart wiper plug means for cement squeeze jobs having controlled casing locking means; smart retrievable latching electronics means; smart whipstock means with controlled casing locking means; smart drill bit vibration damping means; smart robotic pig means to machine slots in pipes; smart robotic pig means to chemically treat inside of pipes; smart robotic pig means to mill any required slots or other patterns in pipes; smart liner installation means; and smart packer means.

In the above, the term "pump-down" may mean one or both of the following depending on the context: (a) "pump-down" can mean that the "internal pump of the smart shuttle" 402 is used to translate the Smart Shuttle downward into the well; or (b) force on fluids introduced by inlets into the Smart Shuttle Chamber and other inlets can be used to force down wiper-plug like devices as described above. The term "casing locking mechanism" has been used above that means, in this case, it locks into the interior of the drill pipe, casing, or whatever pipe in which it is installed. Many of the preferred embodiments herein can also be used in standard casing installations which is a subject that will be described below.

In summary, a "wireline conveyed smart shuttle means" has "retrieval and installation means" for attachment of suitable "smart completion means". A "tubing conveyed smart shuttle means" also has "retrieval and installation means" for attachment of suitable "smart completion means". If a wireline is inside the tubing, then a "tubing with wireline conveyed smart shuttle means" has "retrieval and installation means" for attachment of "smart completion means".

Put yet another way smart shuttle means may be deployed into a pipe with a wireline means, with a tubing means, with a tubing conveyed wireline means, and as a robotic means, meaning that the smart shuttle provides its own power and is untethered from any wireline or tubing, and in such is called "an untethered robotic smart shuttle means" for the purposes herein.

It should also be stated for completeness here that any means that are installed in wellbores to complete oil and gas wells that are described in Ref. 1, in Ref. 2, and Ref. 4 (defined above, and mentioned again below), and which can be suitably attached to the retrieval and installation means of a smart shuttle means shall be defined herein as yet another smart completion means.

More Complex Completions of Oil and Gas Wells

Various different well completions typically used in the industry are described in the following references:

(a) "Casing and Cementing", Unit II, Lesson 4, Second Edition, of the Rotary Drilling Series, Petroleum Extension Service, The University of Texas at Austin, Austin, Tex., 1982 (defined earlier as "Ref. 1" above)
(b) "Well Completion Methods", Lesson 4, from the series entitled "Lessons in Well Servicing and Workover", Petroleum Extension Service, The University of Texas at Austin, Austin, Tex., 1971 (defined earlier as "Ref. 2" above)

(c) "Testing and Completing", Unit II, Lesson 5, Second Edition, of the Rotary Drilling Series, Petroleum Extension Service, The University of Texas at Austin, Austin, Tex., 1983 (defined earlier as "Ref. 4")

(d) "Well Cleanout and Repair Methods", Lesson 8, from the series entitled "Lessons in Well Servicing and Workover", Petroleum Extension Service, The University of Texas at Austin, Austin, Tex., 1971

It is evident from the preferred embodiments above, and the description of more complex well completions in (a), (b), (c), and (d) herein that Smart Shuttles with Retrieval Subs deploying and retrieving various different Smart Completion Devices can be used to complete a vast majority of oil and gas wells. Single string dual completion wells may be completed in analogy with FIG. 21 in "Ref. 4". Single-string dual completion wells may be completed in analogy with FIG. 22 in "Ref. 4". A smart pig to fabricate holes or other patterns in drill pipes (item 19 above) can be used in conjunction with the a smart pump-down whipstock with controlled casing locking mechanism (item 14 above) to allow kick-off wells to be drilled and completed.

Smart Shuttles and Standard Casing Strings

Many preferred embodiments of the invention above have referred to drilling and completing through the drill string. However, it is now evident from the above embodiments, that many of the above inventions can be equally useful to complete oil and gas wells with standard well casing. For a description of this procedure, see Steps 9, 10, 11, 12, 13, and 14 of the specification under the subtitle reading "Typical Drilling Process".

Therefore, any embodiment of the invention that pertains to a drill string also pertains to a casing. Put another way, many of the above embodiments of the invention will function in any pipe of any material, any metallic pipe, any steel pipe, any drill pipe, any drill string, any casing, any casing string, any suitably sized liner, any suitably sized tubing, or within any means to convey oil and gas to the surface for production, hereinafter defined as "pipe means".

Figure 18:
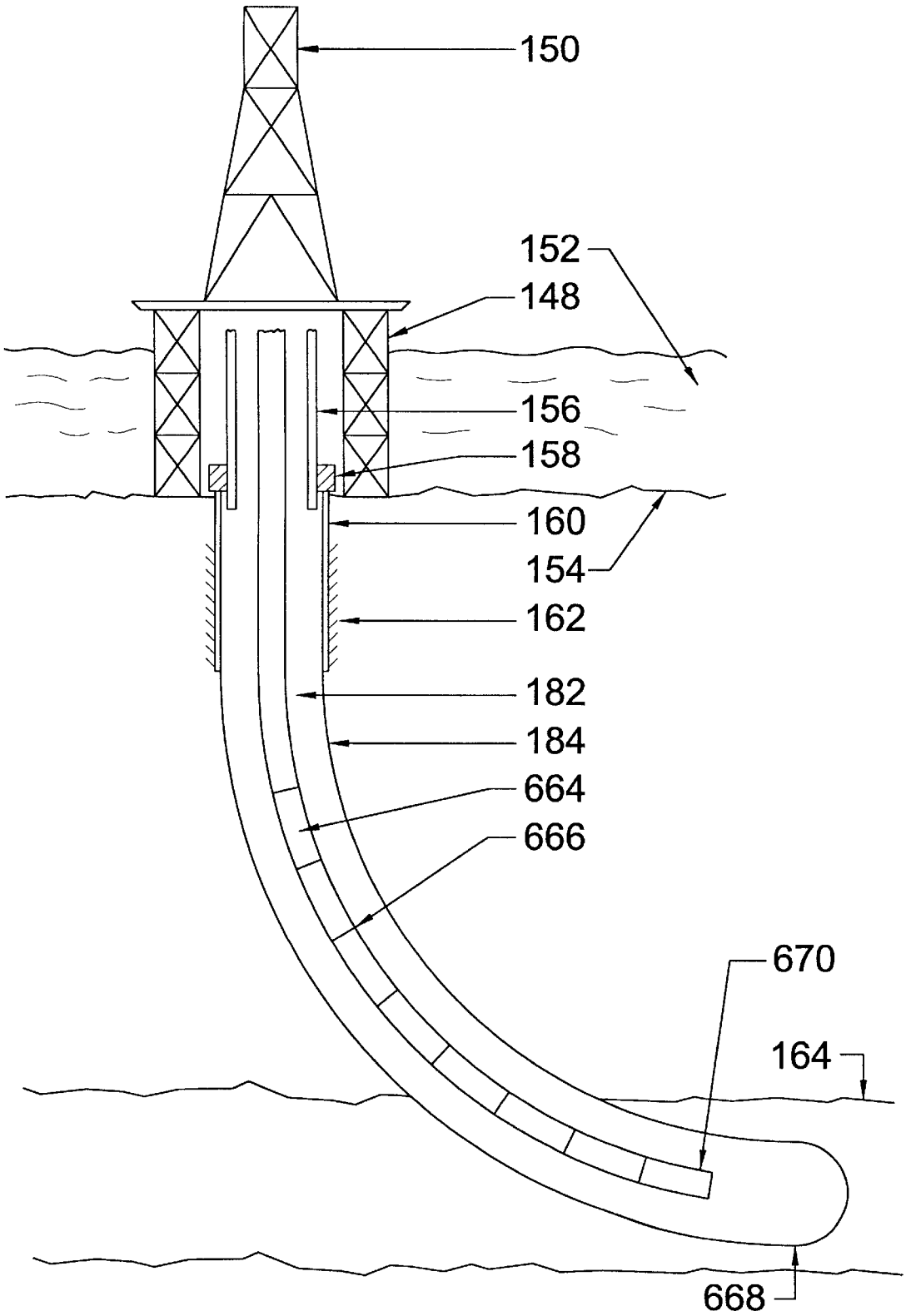
FIG. 18 shows a "pipe means" deployed in the wellbore that may be a pipe made of any material, a metallic pipe, a steel pipe, a drill pipe, a drill string, a casing, a casing string, a liner, a liner string, tubing, or a tubing string, or any means to convey oil and gas to the surface for production that may be completed using a Smart Shuttle, Retrieval Sub, and Smart Completion Devices.

FIG. 18 shows such a "pipe means" disposed in the open hole 184 that is also called the wellbore here. All the numerals through numeral 184 have been previously defined in relation to FIG. 6. A "pipe means" 664 is deployed in the wellbore that may be a pipe made of any material, a metallic pipe, a steel pipe, a drill pipe, a drill string, a casing, a casing string, a liner, a liner string, tubing, or a tubing string, or any means to convey oil and gas to the surface for production. The "pipe means" may, or may not have threaded joints in the event that the "pipe means" is tubing, but if those threaded joints are present, they are labeled with the numeral 666 in FIG. 18. The end of the wellbore 668 is shown. There is no drill bit attached to the last section 670 of the "pipe means". If the "pipe means" is a drill pipe, or drill string, then the retractable bit has been removed one way or another as explained in the next section entitled "Smart Shuttles and Retrievable Drill Bits". If the "pipe means" is a casing, or casing string, then the last section of casing present might also have attached to it a casing shoe as explained earlier, but that is not shown in FIG. 18 for simplicity.

From the disclosure herein, it should now be evident that the above defined "smart shuttle means" having "retrieval and installation means" can be to install within the "pipe means" any of the above defined "smart completion means".

Smart Shuttles and Retrievable Drill Bits A first definition of the phrases "one pass drilling", "One-Trip-Drilling" and "One-Trip-Down-Drilling" is quoted above to "mean the process that results in the last long piece of pipe put in the wellbore to which a drill bit is attached is left in place after total depth is reached, and is completed in place, and oil and gas is ultimately produced from within the wellbore through that long piece of pipe. Of course, other pipes, including risers, conductor pipes, surface casings, intermediate casings, etc., may be present, but the last very long pipe attached to the drill bit that reaches the final depth is left in place and the well is completed using this first definition. This process is directed at dramatically reducing the number of steps to drill and complete oil and gas wells."

This concept, however, can be generalized one step further for another embodiment of the invention. As many prior patents show, it is possible to drill a well with a "retrievable drill bit" that is otherwise also called a "retractable drill bit". For example, see the following U.S. Patents: U.S. Pat. No. 3,552,508, C. C. Brown, entitled "Apparatus for Rotary Drilling of Wells Using Casing as the Drill Pipe", that issued on Jan. 5, 1971; U.S. Pat. No. 3,603,411, H. D. Link, entitled "Retractable Drill Bits", that issued on Sep. 7, 1971; U.S. Pat. No. 4,651,837, W. G. Mayfield, entitled "Downhole Retrievable Drill Bit", that issued on Mar. 24, 1987; U.S. Pat. No. 4,962,822, J. H. Pascale, entitled "Downhole Drill Bit and Bit Coupling", that issued on Oct. 16, 1990; and U.S. Pat. No. 5,197,553, R. E. Leturno, entitled "Drilling with Casing and Retrievable Drill Bit", that issued on Mar. 30, 1993; entire copies of which are incorporated herein in their entirety by reference. For the purposes herein, the terms "retrievable drill bit", "retrievable drill bit means", "retractable drill bit" and "retractable drill bit means" may be used interchangeably.

For the purposes of logical explanation at this point, in the event that any drill pipe is used to drill any extended reach lateral wellbore from any offshore platform, and that wellbore perhaps reaches 20 miles laterally from the offshore platform, then to save time and money, the assembled pipe itself should be left in place and not tripped back to the platform. This is true whether or not the drill bit is left on the end of the pipe, or whether or not the well was drilled with so-called "casing drilling" methods.

Accordingly a more general second definition of the phrases "one pass drilling", "One-Trip-Drilling" and "One-Trip-Down-Drilling" shall include the concept that once the drill pipe means reaches total depth and any extended lateral reach, that the pipe means is thereafter left in place and the well is completed. The above embodiments have adequately discussed the cases of leaving the drill bit attached to the drill pipe and completing the oil and gas wells. In the case of a retrievable bit, it CAN be left in place and the well completed without retrieving the bit, the above apparatus and methods of operation using the Smart Shuttle, the Retrieval Sub, and the various Smart Production Devices can also be used in the drill pipe means that is left in place following the removal of a retrievable bit. This also includes leaving ordinary casing in place following the removal of a retrievable bit and any underreamer during casing drilling operations.

In particular, following the removal of a retrievable drill bit during wellboring activities, one of the first steps to complete the well is prepare the bottom of the well for production using one-way valves, wiper plugs, cement, and gravel as described in relation to FIGS. 4, 5, and 8 and as further described in the "fifth step" above under the subtopic of Steps to Complete Well Shown in FIG. 6". The use of one-way valves installed within a drill pipe means following the removal of a retrievable drill bit that allows proper cementation of the wellbore is another embodiment of the invention. These one-way valves can be installed with the Smart Shuttle and its Retrieval Sub, or they can be simply pumped-down from the surface using techniques shown in FIG. 1 and in the previously described "fifth step". Therefore, an embodiment of this invention is methods and apparatus to install one-way cement valve means in drill pipe means following the removal of a retrievable drill bit to produce oil and gas.

To briefly review the above, a preferred embodiment of the invention discloses methods of causing movement of shuttle means having lateral sealing means within a "pipe means" disposed within a wellbore that includes at least the step of pumping a volume of fluid from a first side of the shuttle means within the pipe means to a second side of the shuttle means within the pipe means, where said shuttle means has an internal pump means. Pumping fluid from one side to the other of the smart shuttle means causes it to move "downward" into the pipe means, or "upward" out of the pipe means, depending on the direction of the fluid being pumped. The pumping of this fluid cause the smart shuttle means to move, translate, change place, change position, advance into the pipe means, or come out of the pipe means, as the case may be, and may be used in other types of pipes. The "pipe means" deployed in the wellbore may be a pipe made of any material, and may be a metallic pipe, a steel pipe, a drill pipe, a drill string, a casing, a casing string, a liner, a liner string, tubing, a tubing string, or any means to convey oil and gas to the surface for oil and gas production.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A method of producing hydrocarbons from a wellbore in a subterranean geological formation using at least the following steps:

(a) drilling a borehole into the earth with a rotary drill bit attached to a drill pipe;

(b) attaching at least one smart completion means to a wireline conveyed smart shuttle means at the surface of the earth, whereby said smart shuttle means has retrieval and installation means for attachment of said smart completion means;

(c) conveying into the drill pipe said smart completion means attached to said smart shuttle means;

(d) releasing said smart completion means from said smart shuttle means at a predetermined depth and installing the smart completion means in the drill pipe at said depth;

(e) returning said smart shuttle means to the surface of the earth; and (f) producing hydrocarbons from said drill pipe with smart completion means installed in said drill pipe at said predetermined depth.

2. A method of producing hydrocarbons from within a pipe that is located within a borehole in a geological formation in the earth comprising at least the following steps:

(a) attaching at least one smart completion means to a smart shuttle means at the surface of the earth;

(b) conveying into the pipe said smart completion means attached to said smart shuttle means;

(c) releasing said smart completion means from said smart shuttle means at a predetermined depth and installing the smart completion means in the pipe at said depth;

(d) returning said smart shuttle means to the surface of the earth; and (e) producing hydrocarbons from the pipe with said smart completion means installed in said pipe at said predetermined depth;

whereby said smart shuttle means possesses at least one electronics system module;

whereby said electronics system module possesses electronics module means having at least one electronic component; and whereby said electronics module means is selected from the group consisting of a depth measurement means, an orientational information measurement means, a power source means, a sensor measurement means, a command receiver means from surface, an information transmission means to surface, a processor means, a computer means, a means for data storage, means for nonvolatile data storage, a recording means, a read only memory means, electronic controller means, an actuator means, standard depth control measurement means, and a geophysical measurement means.

3. The method in claim 2 wherein the smart shuttle means is a wireline conveyed smart shuttle means.

4. The method in claim 3 wherein the pipe located within said borehole is selected from the group consisting of:

a drill string, a casing string, a drill string with retrievable drill bit removed, a casing string with retrievable drill bit removed, any steel pipe, any metallic pipe, any pipe made of any material, any liner and any tubing.

5. The method in claim 3 whereby the wireline conveyed smart shuttle means that is deployed within the pipe possesses lateral sealing means and also possesses internal pump means that pumps fluid from a first side of said shuttle means to a second side of said shuttle means to cause the shuttle means to move in the pipe.

* * * * *